US011434892B2

(12) United States Patent
Hines et al.

(10) Patent No.: US 11,434,892 B2
(45) Date of Patent: Sep. 6, 2022

(54) ELECTRICALLY OPERATED DISPLACEMENT PUMP ASSEMBLY

(71) Applicant: Graco Minnesota Inc., Minneapolis, MN (US)

(72) Inventors: Bradley H. Hines, Andover, MN (US); Paul W. Scheierl, Chisago City, MN (US); Brian W. Koehn, Minneapolis, MN (US); Jacob D. Higgins, White Bear Township, MN (US); Benjamin J. Paar, Minneapolis, MN (US); David L. Fehr, Dayton, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 17/313,594

(22) Filed: May 6, 2021

(65) Prior Publication Data

US 2021/0301808 A1 Sep. 30, 2021

Related U.S. Application Data

(63) Continuation of application No. PCT/US2021/025121, filed on Mar. 31, 2021.
(Continued)

(51) Int. Cl.
*F04B 43/04* (2006.01)
*F04B 53/18* (2006.01)
(Continued)

(52) U.S. Cl.
CPC ..... *F04B 43/04* (2013.01); *F04B 17/03* (2013.01); *F04B 49/065* (2013.01); *F04B 49/20* (2013.01); *F04B 53/18* (2013.01)

(58) Field of Classification Search
CPC ..... F04B 43/04; F04B 53/18; F04B 43/023; F04B 43/025; F04B 43/026; F04B 45/041;
(Continued)

(56) References Cited

U.S. PATENT DOCUMENTS 1,650,377 A 11/1927 Nixon
1,926,403 A * 9/1933 Phillips ..... F16C 35/047 384/585
(Continued)

FOREIGN PATENT DOCUMENTS

CN 102947593 A 2/2013
CN 105673378 A 6/2016
(Continued)

OTHER PUBLICATIONS

Invitation to Pay Additional Fees for PCT Application No. PCT/US2021/025121, dated May 14, 2021, pp. 15.
(Continued)

*Primary Examiner* — Essama Omgba
*Assistant Examiner* — Dnyanesh G Kasture
(74) *Attorney, Agent, or Firm* — Kinney & Lange, P.A.

(57) ABSTRACT

An electrically operated displacement pump includes an electric motor having a stator and a rotor. The rotor is connected to the fluid displacement member to drive axial reciprocation of the fluid displacement member. A drive mechanism is disposed between and connected to each of the rotor and the fluid displacement member. The drive mechanism receives a rotational output from the rotor and provides a linear input to the fluid displacement member.

22 Claims, 40 Drawing Sheets

Related U.S. Application Data

(60) Provisional application No. 63/002,674, filed on Mar. 31, 2020.

(51) Int. Cl.
*F04B 17/03* (2006.01)
*F04B 49/06* (2006.01)
*F04B 49/20* (2006.01)

(58) Field of Classification Search
CPC ..... F04B 45/043; F04B 43/02–43/046; F04B 45/04–45/047; F04B 43/14; F04B 45/10; F16C 35/067; F16C 19/225; F16C 19/385; F16C 19/54; F16C 27/06; F16C 25/083; F16H 25/20–2025/249
USPC ..... 384/562–563, 551, 477, 263–265; 74/424.81–424.93
See application file for complete search history.

(56) References Cited

U.S. PATENT DOCUMENTS 2,069,471 A * 2/1937 Baker ..... F16H 25/2233 74/424.9
2,368,131 A 1/1945 French
2,407,792 A 9/1946 McMillan
2,446,393 A 8/1948 Russell
2,491,230 A 12/1949 Theis
2,508,253 A 5/1950 Haggardt
2,752,854 A 7/1956 Prior et al.
3,075,468 A 1/1963 Eifel
3,164,101 A 1/1965 Van Nederynen
3,207,080 A 9/1965 Schlosser
3,250,225 A 5/1966 Taplin
3,276,389 A 10/1966 Bower, Jr.
3,354,830 A * 11/1967 Mortara ..... F04B 43/04 417/454
3,416,461 A 12/1968 McFarland
3,542,491 A 11/1970 Newman
3,652,187 A 3/1972 Loeffler et al.
3,680,981 A 8/1972 Wagner
3,741,689 A 6/1973 Rupp
3,769,879 A 11/1973 Lofquist
3,775,030 A 11/1973 Wanner
3,849,033 A 11/1974 Schall
3,916,449 A 11/1975 Davis
3,999,896 A 12/1976 Sebastiani
4,008,984 A 2/1977 Scholle
4,068,982 A 1/1978 Quarve
4,123,204 A 10/1978 Scholle
4,145,165 A 3/1979 Perkins et al.
4,276,003 A 6/1981 Perkins et al.
4,277,706 A 7/1981 Isaacson
4,365,745 A 12/1982 Beck
4,366,723 A * 1/1983 Wilke ..... F16H 25/2228 74/216.3
4,403,924 A 9/1983 Gebauer et al.
4,459,089 A 7/1984 Kent et al.
4,526,053 A * 7/1985 Carson ..... F16H 25/2252 74/424.75
4,549,467 A 10/1985 Wilden et al.
4,615,259 A 10/1986 Anbe
4,778,356 A 10/1988 Hicks
4,815,360 A 3/1989 Winterle
4,883,412 A 11/1989 Malizard et al.
4,902,206 A 2/1990 Nakazawa et al.
5,053,660 A 10/1991 Sneddon
5,066,199 A 11/1991 Reese et al.
5,076,761 A 12/1991 Krohn et al.
5,106,274 A 4/1992 Holtzapple
5,128,688 A * 7/1992 West ..... H01Q 1/34 114/340
5,145,339 A 9/1992 Lehrke et al.
5,165,869 A 11/1992 Reynolds
5,174,731 A 12/1992 Korver
5,213,485 A 5/1993 Wilden
5,219,274 A 6/1993 Pawlowski et al.
5,249,932 A 10/1993 Van Bork
5,257,914 A 11/1993 Reynolds
5,279,504 A 1/1994 Williams
5,362,212 A 11/1994 Bowen et al.
5,378,122 A 1/1995 Duncan
5,484,270 A 1/1996 Carmeli
5,527,160 A 6/1996 Kozumplik, Jr. et al.
5,557,154 A 9/1996 Erhart
5,567,118 A 10/1996 Grgurich et al.
5,616,005 A 4/1997 Whitehead
5,649,809 A 7/1997 Stapelfeldt
5,751,125 A * 5/1998 Weiss ..... A61M 60/50 318/280
5,816,778 A 10/1998 Elsey, Jr. et al.
5,927,954 A 7/1999 Kennedy et al.
6,036,445 A 3/2000 Reynolds
6,092,992 A 7/2000 Imblum et al.
6,106,246 A 8/2000 Steck et al.
6,109,878 A 8/2000 Barton et al.
6,135,722 A * 10/2000 Kawaguchi ..... F04B 27/1063 417/270
6,139,288 A 10/2000 Karasawa
6,142,749 A 11/2000 Jack et al.
6,158,982 A 12/2000 Kennedy et al.
6,174,136 B1 1/2001 Kilayko et al.
6,280,149 B1 8/2001 Able et al.
6,299,415 B1 10/2001 Bahrton
6,402,486 B1 6/2002 Steck et al.
6,468,057 B1 10/2002 Beck
6,474,961 B1 11/2002 Timmer et al.
6,811,380 B2 11/2004 Kim
7,128,541 B2 10/2006 Kach
7,399,168 B1 7/2008 Eberwein
7,517,199 B2 4/2009 Reed et al.
7,600,985 B2 10/2009 Meloche et al.
7,626,308 B2 12/2009 Kang et al.
7,654,801 B2 2/2010 Spude
7,658,598 B2 2/2010 Reed et al.
7,758,321 B2 7/2010 Fukano et al.
8,123,500 B2 2/2012 Juterbock et al.
8,167,586 B2 5/2012 Towne
8,182,247 B2 5/2012 Gallwey et al.
8,292,600 B2 10/2012 Reed et al.
8,313,313 B2 11/2012 Juterbock et al.
8,337,166 B2 12/2012 Meza et al.
8,382,445 B2 2/2013 Roseberry
8,393,881 B2 3/2013 Usui et al.
8,405,275 B2 3/2013 Calley et al.
8,485,792 B2 7/2013 McCourt et al.
8,529,223 B2 9/2013 Cohoon et al.
8,585,372 B2 11/2013 Bacher et al.
8,845,298 B2 9/2014 Larsen et al.
8,847,529 B2 9/2014 Dixon et al.
9,212,657 B2 12/2015 Reukers
9,316,218 B2 4/2016 McCourt et al.
9,638,185 B2 5/2017 Hines et al.
10,161,393 B2 12/2018 Hines et al.
10,900,583 B2 1/2021 Gagliano et al.
2001/0048882 A1 12/2001 Layman
2002/0153794 A1 * 10/2002 Kawasaki ..... H02K 1/185 310/156.08
2003/0000765 A1 * 1/2003 Spadafora ..... F15B 13/021 180/417
2003/0099550 A1 5/2003 Kim
2004/0057853 A1 3/2004 Ross et al.
2004/0086398 A1 5/2004 Eugene Lehrke et al.
2005/0156556 A1 7/2005 Hermann et al.
2006/0056979 A1 3/2006 Yoo et al.
2006/0127252 A1 6/2006 Caddell
2006/0257271 A1 11/2006 Juterbock et al.
2007/0092385 A1 4/2007 Petrie Pe
2007/0236089 A1 * 10/2007 Okubo ..... F04B 17/042 310/23
2009/0097987 A1 4/2009 Sung et al.
2009/0196771 A1 8/2009 Juterbock et al.
2010/0045096 A1 2/2010 Schonlau et al.

(56) References Cited

U.S. PATENT DOCUMENTS

| | | | | |
|---|---|---|---|---|
| 2010/0178184 | A1 | 7/2010 | Simmons et al. | |
| 2010/0196176 | A1 | 8/2010 | Kaufmann et al. | |
| 2011/0138949 | A1* | 6/2011 | Himmelmann | F16C 29/0688 74/424.83 |
| 2011/0163704 | A1 | 7/2011 | Wang et al. | |
| 2011/0236236 | A1* | 9/2011 | Larsen | F04B 43/09 417/416 |
| 2012/0000561 | A1 | 1/2012 | Schuttermair et al. | |
| 2012/0063925 | A1 | 3/2012 | Parker | |
| 2012/0065457 | A1* | 3/2012 | Peters | A61M 60/268 600/16 |
| 2012/0227389 | A1 | 9/2012 | Hinderks | |
| 2013/0008538 | A1 | 1/2013 | Schutze | |
| 2013/0101445 | A1 | 4/2013 | Schutze | |
| 2013/0183173 | A1 | 7/2013 | Kohli et al. | |
| 2013/0243630 | A1 | 9/2013 | Simmons et al. | |
| 2014/0260746 | A1* | 9/2014 | Sakaguchi | F16H 25/2204 74/424.81 |
| 2015/0226192 | A1 | 8/2015 | Hines et al. | |
| 2015/0226205 | A1 | 8/2015 | Hines et al. | |
| 2015/0226206 | A1 | 8/2015 | Hines et al. | |
| 2015/0226207 | A1 | 8/2015 | Hines et al. | |
| 2016/0001624 | A1 | 1/2016 | Meissner et al. | |
| 2016/0377065 | A1 | 12/2016 | Parker | |
| 2017/0067455 | A1 | 3/2017 | Reukers et al. | |
| 2017/0149304 | A1 | 5/2017 | Li et al. | |
| 2017/0298930 | A1* | 10/2017 | West | F04B 53/10 |
| 2018/0223817 | A1* | 8/2018 | Turner | F04B 7/0266 |
| 2020/0248682 | A1* | 8/2020 | Reukers | F04B 23/04 |
| 2020/0291936 | A1 | 9/2020 | Brocker et al. | |

FOREIGN PATENT DOCUMENTS

| | | | | |
|---|---|---|---|---|
| DE | 4300512 | A1 | 7/1994 | |
| EP | 0781922 | A1 | 7/1997 | |
| EP | 0799672 | A1 | 10/1997 | |
| JP | 2004210544 | A | 7/2004 | |
| JP | 2005098135 | A | 4/2005 | |
| JP | 2006029302 | A | 2/2006 | |
| JP | 2006291957 | A | 10/2006 | |
| JP | 2007500821 | A | 1/2007 | |
| TW | 200606337 | A | 2/2006 | |
| WO | WO 90/12962 | * | 11/1990 | F04B 43/04 |
| WO | WO9012962 | A1 | 11/1990 | |
| WO | WO2009076429 | A2 | 6/2009 | |
| WO | WO2010066754 | A1 | 6/2010 | |
| WO | WO2011162822 | A2 | 12/2011 | |
| WO | WO2012034238 | A1 | 3/2012 | |
| WO | WO2015127497 | A1 | 9/2015 | |
| WO | WO2016100197 | A1 | 6/2016 | |
| WO | WO2016100707 | A1 | 6/2016 | |
| WO | 3299622 | A1 | 3/2018 | |

OTHER PUBLICATIONS

Invitation to Pay Additional Fees for PCT Application No. PCT/US2021/025132, Dated Jun. 21, 2021, pp. 15.

Invitation to Pay Additional Fees for PCT Application No. PCT/US2021/025086, Dated Jul. 7, 2021, pp. 18.

International Search Report and Written Opinion for PCT Application No. PCT/US2021/025121, dated Jul. 5, 2021, pp. 20.

* cited by examiner

ELECTRICALLY OPERATED DISPLACEMENT PUMP ASSEMBLY

CROSS-REFERENCE TO RELATED APPLICATION(S)

This application is a continuation of International PCT Application No. PCT/US2021/025121 filed Mar. 31, 2021 and entitled "ELECTRICALLY OPERATED DISPLACEMENT PUMP ASSEMBLY," which claims the benefit of U.S. Provisional Application No. 63/002,674 filed Mar. 31, 2020, and entitled "ELECTRICALLY OPERATED DISPLACEMENT PUMP," the disclosures of which are hereby incorporated by reference in their entireties.

BACKGROUND

This disclosure relates to positive displacement pumps and more particularly to a drive system for positive displacement pumps.

Positive displacement pumps discharge a process fluid at a selected flow rate. In a typical positive displacement pump, a fluid displacement member, usually a piston or diaphragm, pumps the process fluid.

Fluid-operated double displacement pumps typically employ diaphragms as the fluid displacement members and air or hydraulic fluid as a working fluid to drive the fluid displacement members. In an air operated double displacement pump, the two diaphragms are joined by a shaft and compressed air is the working fluid. Compressed air is applied to one of two chambers associated with the respective diaphragms. The first diaphragm is driven through a pumping stroke and pulls the second diaphragm through a suction stroke when compressed air is provided to the first chamber. The diaphragms move through a reverse stroke when compressed air is provided to the second chamber. Delivery of compressed air is controlled by an air valve, and the air valve is usually actuated mechanically by the diaphragms. One diaphragm is pulled until it causes the actuator to toggle the air valve. Toggling the air valve exhausts the compressed air from the first chamber to the atmosphere and introduces fresh compressed air to the second chamber, thereby causing reciprocation of the respective diaphragms.

Double displacement pumps can also be mechanically operated such that the pump does not require the use of working fluid. In such a case, a motor is operatively connected to the fluid displacement members to drive reciprocation. A gear train is disposed between the motor and the shaft connecting the fluid displacement members to ensure that the pump can provide sufficient torque during pumping. The motor and gear train are disposed external to the main body of the pump.

SUMMARY

According to one aspect of the disclosure, a displacement pump for pumping a fluid includes an electric motor including a stator and a rotor; a fluid displacement member configured to pump fluid; and a drive mechanism connected to the rotor and the fluid displacement member. The drive mechanism converts a rotational output from the rotor into a linear input to the fluid displacement member. The drive mechanism includes a screw connected to the fluid displacement member and a plurality of rolling elements disposed between the screw and the rotor. The screw is disposed coaxially with the rotor. The plurality of rolling elements support the screw relative the rotor and drive the screw axially.

According to another aspect of the disclosure, a method of pumping includes driving rotation of a rotor of an electric motor; linearly displacing a screw shaft in a first axial direction such that the screw shaft drives a first fluid displacement member attached to a first end of the screw shaft through one of a first suction stroke and a first pumping stroke, wherein the screw is coaxial with the rotor and supported by a plurality of rolling elements disposed between the rotor and the screw shaft; and linearly displacing, by the plurality of rolling elements, the screw shaft in a second axial direction opposite the first axial direction.

According to yet another aspect of the disclosure, a displacement pump for pumping a fluid includes an electric motor disposed in a pump housing; a fluid displacement member configured to pump fluid and interfacing with the pump housing such that the fluid displacement member is prevented from rotating relative to the pump housing; and a drive mechanism connected to a rotor of the electric motor and to the fluid displacement member and configured to convert a rotational output from the rotor into a linear input to the fluid displacement member. The drive mechanism includes a screw connected to the fluid displacement member. The screw provides the linear input to the fluid displacement member. The screw interfaces with the fluid displacement member such that the screw is prevented from rotating relative to the fluid displacement member.

According to yet another aspect of the disclosure, a displacement pump for pumping a fluid includes an electric motor disposed in a pump housing and including a stator and a rotor rotatable about a pump axis; a fluid displacement member configured to reciprocate on the pump axis to pump fluid; and a drive mechanism connected to the rotor and to the fluid displacement member and configured to convert a rotational output from the rotor into a linear input to the fluid displacement member. The fluid displacement member interfaces with the pump housing at a first interface. The drive mechanism includes a screw connected to the fluid displacement member at a second interface. The first interface and the second interface prevent the screw from rotating about the pump axis and relative to the fluid displacement member and the pump housing.

According to yet another aspect of the disclosure, a double diaphragm pump having an electric motor includes a housing; an electric motor comprising a stator and a rotor with the rotor configured to rotate to generate rotational input; a screw that receives the rotational input and converts the rotational input into linear input; a first diaphragm and a second diaphragm. The screw is located between the first and second diaphragms and each of the first and second diaphragms receiving the linear input such that each of the first and second diaphragms reciprocate to pump fluid. Each of the first and second diaphragms are rotationally fixed by the housing. The first and second diaphragms are rotationally fixed with respect to the screw such that the screw is prevented from rotating, despite the rotational input, by the first and second diaphragms rotationally fixing the screw.

According to yet another aspect of the disclosure, a displacement pump for pumping a fluid includes an electric motor disposed in a pump housing, the electric motor comprising a stator and a rotor with the rotor configured to rotate about a pump axis, a fluid displacement member configured to pump fluid by linear reciprocation of the fluid displacement member, and a drive mechanism connected to the rotor and to the fluid displacement member. The fluid displacement member interfaces with the pump housing such that the fluid displacement member is prevented from rotating relative to the pump housing. The drive mechanism includes a screw connected to the fluid displacement member and is configured to receive rotational output from the rotor and convert the rotational output from the rotor into a linear input to the fluid displacement member to linearly reciprocate the fluid displacement member. The screw is prevented from being rotated by the rotational output by an interface between the screw and the pump housing.

According to yet another aspect of the disclosure, a method of pumping fluid by a reciprocating pump includes driving rotation of a rotor of an electric motor by a stator of the electric motor; causing, by rotation of the rotor, a screw shaft disposed coaxially with the rotor to reciprocate along a pump axis, the screw shaft driving a fluid displacement member through a suction stroke and a pumping stroke; preventing rotation of the fluid displacement member relative to a pump housing of the pump by a first interface between the fluid displacement member and the pump housing; and preventing rotation of the screw shaft about the axis by the first interface and a second interface between the screw shaft and the fluid displacement member.

According to yet another aspect of the disclosure, a displacement pump for pumping a fluid includes an electric motor disposed in a pump housing and including a stator and a rotor; a fluid displacement member configured to pump fluid; and a screw connected to the fluid displacement member. The screw is operably connected to the rotor such that rotation of the rotor drives linear displacement of the screw along a pump axis. The screw includes a shaft body and a lubricant pathway extending through the shaft body and configured to provide lubricant to an interface between the screw and the rotor.

According to yet another aspect of the disclosure, a method of lubricating an electric displacement pump includes providing lubricant to an interface between a screw shaft and a rotor of a pump motor of the pump via a lubricant pathway extending through the screw shaft, wherein the screw shaft is disposed coaxially with the rotor.

According to yet another aspect of the disclosure, a displacement pump for pumping a fluid includes an electric motor at least partially disposed in a pump housing and including a stator and a rotor and a first fluid displacement member connected to the rotor such that a rotational output from the rotor provides a linear reciprocating input to the first fluid displacement member. The first fluid displacement member fluidly separates a first process fluid chamber disposed on a first side of the first fluid displacement member from a first cooling chamber disposed on a second side of the first fluid displacement member. The first fluid displacement member simultaneously pumps process fluid through the first process fluid chamber and pumps air through the first cooling chamber.

According to yet another aspect of the present disclosure, a double diaphragm pump having an electric motor includes a housing; an electric motor comprising a stator and a rotor with the rotor configured to rotate to generate rotational input; a first diaphragm connected to the rotor such that a rotational output from the rotor provides a linear reciprocating input to the first diaphragm; and a second diaphragm connected to the rotor such that a rotational output from the rotor provides a linear reciprocating input to the second diaphragm. The first diaphragm fluidly separates a first process fluid chamber disposed on a first side of the first diaphragm from a first cooling chamber disposed on a second side of the first diaphragm. The second diaphragm fluidly separates a second process fluid chamber disposed on a first side of the second diaphragm from a second cooling chamber disposed on a second side of the second diaphragm. The first diaphragm and the second diaphragm reciprocate in a first direction and a second direction. The first diaphragm simultaneously performs a pumping stroke of the process fluid and a suction stroke of the air as the first diaphragm moves in the first direction. The second diaphragm simultaneously performs a suction stroke of the process fluid and a pumping stroke of the air as the second diaphragm moves in the first direction. The first diaphragm simultaneously performs a pumping stroke of the air and a suction stroke of the process fluid as the first diaphragm moves in the second direction. The second diaphragm simultaneously performs a pumping stroke of the process fluid and a suction stroke of the air as the second diaphragm moves in the second direction.

According to yet another aspect of the disclosure, a method of cooling an electrically operated diaphragm pump includes driving reciprocation of a first fluid displacement member and a second fluid displacement member by an electric motor having a rotor configured to rotate about a pump axis, wherein the first fluid displacement member and the second fluid displacement member are disposed coaxially with the rotor and connected to the rotor via a drive mechanism; drawing air into a first cooling chamber of a cooling circuit of the pump by the first fluid displacement member, the first cooling chamber disposed between the first fluid displacement member and the rotor; pumping the air from first cooling chamber to a second cooling chamber disposed between the second fluid displacement member and the rotor; and driving the air out of the second motor chamber by the second fluid displacement member to exhaust the air from the cooling circuit.

According to yet another aspect of the present disclosure, a displacement pump for pumping a fluid includes an electric motor including a rotor and a stator extending about the rotor, a fluid displacement member configured to pump fluid and disposed coaxially with the rotor, a drive mechanism connected to the rotor and the fluid displacement member, and a position sensor disposed proximate the rotor, the position sensor configured to sense rotation of the rotor and to provide data to a controller. The drive mechanism is configured to convert a rotational output from the rotor into a linear input to the fluid displacement member.

According to yet another aspect of the present disclosure, a displacement pump for pumping a fluid includes an electric motor including a stator and a rotor; a fluid displacement member configured to pump fluid and disposed coaxially with the rotor; a drive mechanism connected to the rotor and the fluid displacement member, the drive mechanism configured to convert a rotational output from the rotor into a linear input to the fluid displacement member; and a controller. The controller is configured to regulate current flow to the electric motor such that the rotor applies torque to the drive mechanism with the pump in both a pumping state and a stalled state. In the pumping state, the rotor applies torque to the drive mechanism and rotates about the pump axis causing the fluid displacement member to apply force to a process fluid and displace axially along the pump axis. In the stalled state, the rotor applies torque to the drive mechanism and does not rotate about the pump axis such that the fluid displacement member applies force to the process fluid and does not displace axially.

According to yet another aspect of the present disclosure, a method of operating a reciprocating pump includes electromagnetically applying a rotational force to a rotor of an electric motor; applying, by the rotor, torque to a drive mechanism; applying, by the drive mechanism, axial force to a fluid displacement member configured to reciprocate on a pump axis to pump process fluid; and regulating, by a controller, a flow of current to a stator of the electric motor such that rotational force is applied to the rotor during both a pumping state and a stalled state. In the pumping state, the rotor applies torque to the drive mechanism and rotates about the pump axis causing the fluid displacement member to apply force to a process fluid and displace axially along the pump axis. In the stalled state, the rotor applies torque to the drive mechanism and does not rotate about the pump axis such that the fluid displacement member applies force to the process fluid and does not displace axially.

According to yet another aspect of the present disclosure, a method of operating a reciprocating pump includes providing electric current to an electric motor disposed on a pump axis and connected to a fluid displacement member configured to reciprocate along the pump axis; and regulating, by a controller, current flow to the electric motor to control a pressure output by the pump to a target pressure.

According to yet another aspect of the present disclosure, a displacement pump for pumping a fluid includes an electric motor including a stator and a rotor configured to rotate about a pump axis; a fluid displacement member configured to pump fluid and disposed coaxially with the rotor; a drive mechanism connected to the rotor and the fluid displacement member; and a controller. The drive mechanism is configured to convert a rotational output from the rotor into a linear input to the fluid displacement member. The controller is configured to cause current to be provided to the stator to drive rotation of the rotor, thereby driving reciprocation of the fluid displacement member; and regulate the current flow to the electric motor to control a pressure output by the pump to a target pressure.

According to yet another aspect of the present disclosure, a method of operating a reciprocating pump includes driving, by an electric motor, reciprocation of a fluid displacement member along a pump axis, the fluid displacement member disposed coaxially with a rotor of the electric motor; regulating, by a controller, a rotational speed of the rotor thereby directly controlling an axial speed of the fluid displacement member such that the rotational speed is at or below a maximum speed; regulating, by the controller, current provided to the electric motor such that the current provided is at or below a maximum current.

According to yet another aspect of the present disclosure, a method of operating a reciprocating pump includes driving, by an electric motor, reciprocation of a fluid displacement member along a pump axis, the fluid displacement member disposed coaxially with a rotor of the electric motor, wherein the fluid displacement member includes a variable working surface area; and varying, by a controller, current provided to the electric motor such that a first current is provided to the electric motor at a beginning of a pumping stroke of the fluid displacement member and a second current is provided to the electric motor at an end of the pumping stroke, the second current less than the first current.

According to yet another aspect of the present disclosure, a dual pump for pumping a fluid includes an electric motor comprising a stator and a rotor with the rotor configured to generate rotational input; a controller configured to regulate current flow to the electric motor; a drive mechanism comprising a screw extending within the rotor and configured to receive the rotational input and convert the rotational input into linearly reciprocating motion of the screw, a first fluid displacement member, and a second fluid displacement member. Rotation of the rotor in a first direction drives the screws to linearly move in a first direction along an axis, and rotation of the rotor in a second direction drives the screws to linearly move in a second direction along the axis. The screw is located between the first and the second fluid displacement members. The screw reciprocates the first and the second fluid displacement members in the first direction along the axis when the rotor rotates in the first direction and in the second direction along the axis when the rotor rotates in the second direction. The first fluid displacement performs a pumping stroke of the process fluid and the second fluid displacement performs a suction stroke of the process fluid as the screw moves in the first direction. The first fluid displacement performs a suction stroke of the process fluid and the second fluid displacement performs a pumping stroke of the process fluid as the screw moves in the second direction. The controller regulates output pressure of the process fluid by regulating current flow to the motor such that the rotor rotates to cause the first and the second fluid displacement members to reciprocate to pump the process fluid until pressure of the process fluid stalls the rotor while the first fluid displacement member is in the pump stroke and the second fluid displacement member is in the suction stroke even while current continues to be supplied to the motor by the controller, the first and the second fluid displacement members resuming pumping when the pressure of the process fluid drops enough for the rotor to overcome the stall and resume rotating.

According to yet another aspect of the present disclosure, a displacement pump for pumping a fluid includes an electric motor including a stator and a rotor configured to rotate about a pump axis; a first fluid displacement member configured to pump fluid and disposed coaxially with the rotor; a second fluid displacement member configured to pump fluid and disposed coaxially with the rotor; a drive mechanism connected to the rotor and the first and second fluid displacement members and including a screw and configured to convert a rotational output from the rotor into a linear input to the first and second fluid displacement members, and a controller configured to operate the pump in a start-up mode and a pumping mode. During the start-up mode the controller is configured to cause the motor to drive the first and second fluid displacement members in a first axial direction; and determine an axial location of at least one of the first and second fluid displacement members based on the controller detecting a first current spike when the at least one of the first and second fluid displacement members encounters a first stop. Moving the first and second fluid displacement members in the first axial direction moves one of the first and second fluid displacement members through a pumping stroke and moves the other of the first and second fluid displacement members through a suction stroke. Moving the first and second fluid displacement members in a second axial direction opposite the first axial direction moves the one of the first and second fluid displacement members through a suction stroke and moves the other of the first and second fluid displacement members through a pumping stroke.

According to yet another aspect of the present disclosure, a displacement pump for pumping a fluid includes an electric motor including a stator and a rotor configured to rotate about a pump axis; a fluid displacement member configured to pump fluid and disposed coaxially with the rotor; a drive mechanism connected to the rotor and the fluid displacement member; and a controller configured to operate the pump in a start-up mode and a pumping mode. The drive mechanism is configured to convert a rotational output from the rotor into a linear input to the fluid displacement member. During the start-up mode, the controller is configured to cause the motor to drive the fluid displacement member in a first axial direction; and determine an axial location of the fluid displacement member based on the controller detecting a first current spike when the fluid displacement member encounters a first stop.

According to yet another aspect of the present disclosure, a method of operating a reciprocating pump includes driving, by an electric motor, a first fluid displacement member in a first axial direction on a pump axis, the first fluid displacement member disposed coaxially with a rotor of the electric motor; and determining, by a controller, an axial location of the first fluid displacement member based on the controller detecting a current spike due to the first fluid displacement member encountering a first stop and the rotor stopping rotation.

According to yet another aspect of the present disclosure, a method of operating a reciprocating pump includes driving, by an electric motor, a first fluid displacement member in a first axial direction along a pump axis, the first fluid displacement member disposed coaxially with a rotor of the electric motor; initiating, by a controller, deceleration of the rotor when the first fluid displacement member is at a first deceleration point disposed a first axial distance from a first target point along the pump axis; determining, by the controller, a first adjustment factor based on a first axial distance between a first stopping point and the first target point, wherein the first stopping point is an axial location where the first fluid displacement member stops displacing in the first axial direction; and managing, by the controller, a stroke length based on the first adjustment factor.

According to yet another aspect of the present disclosure, a displacement pump for pumping a fluid includes an electric motor including a stator and a rotor; a fluid displacement member connected to the rotor such that a rotational output from the rotor provides a linear reciprocating input to the first fluid displacement member; and a controller. The controller is configured to regulate current flow to the electric motor based on a current limit to thereby regulate an output pressure of the fluid pumped by the fluid displacement member; regulate a rotational speed of the rotor based on a speed limit to thereby regulate an output flowrate of the fluid pumped by the fluid displacement member; and set a current limit and a speed limit based on a single parameter command received by the controller.

According to yet another aspect of the present disclosure, a method of operating a reciprocating pump includes electromagnetically applying a rotational force to a rotor of an electric motor; applying, by the rotor, torque to a drive mechanism; applying, by the drive mechanism, axial force to a fluid displacement member configured to reciprocate on a pump axis to pump process fluid; regulating, by a controller, a flow of current to a stator of the electric motor based on a current limit; regulating, by the controller, a speed of the rotor based on a speed limit; generating the single parameter command based on a single input from a user; and setting, by the controller, both the current limit and the speed limit based on the single parameter command received by the controller.

According to yet another aspect of the present disclosure, a displacement pump for pumping a fluid includes an electric motor including a stator and a rotor configured to rotate about a pump axis; a fluid displacement member operatively connected to the rotor to be reciprocated to pump fluid; and a controller configured to operate the motor in a start-up mode and a pumping mode. During the pumping mode the controller is configured to operate the electric motor based on a target current and a target speed. During the start-up mode the controller is configured to operate the electric motor based on a maximum priming speed that less than the target speed.

According to yet another aspect of the present disclosure, a method of operating a reciprocating pump includes electromagnetically applying a rotational force to a rotor of an electric motor; applying, by the rotor, torque to a drive mechanism; applying, by the drive mechanism, axial force to a fluid displacement member configured to reciprocate on a pump axis to pump process fluid; regulating, by a controller, power to the electric motor to control an actual speed of the rotor during a start-up mode such that the actual speed is less than a maximum priming speed; regulating, by a controller, the power to the electric motor to control an actual speed of the rotor during a pumping mode such that the actual speed is less than a target speed. The maximum priming speed is less than the target speed.

According to yet another aspect of the present disclosure, a method of operating a reciprocating pump includes driving, by an electric motor, a first fluid displacement member through a pumping stroke in a first axial direction along a pump axis, the first fluid displacement member disposed coaxially with a rotor of the electric motor; and managing, by the controller, a stroke length of the first fluid displacement member during a first operating mode and a second operating mode such that the stroke length during the second operating mode is shorter than the stoke length during the first operating mode.

According to yet another aspect of the present disclosure, a method of operating a reciprocating pump includes driving, by an electric motor, a first fluid displacement member through a pumping stroke in a first axial direction along a pump axis, the first fluid displacement member disposed coaxially with a rotor of the electric motor; and managing, by the controller, a stroke of the first fluid displacement member during a first operating mode such that a pump stroke occurs in a first displacement range along the pump axis; and managing, by the controller, a stroke of the first fluid displacement member during a first operating mode such that the pump stroke occurs in a second displacement range along the pump axis, wherein the second displacement range is a subset of the first displacement range.

According to yet another aspect of the present disclosure, a displacement pump for pumping a fluid includes an electric motor including a stator and a rotor configured to rotate about a pump axis; a fluid displacement member operatively connected to the rotor to be reciprocated along the pump axis to pump fluid; a controller configured to operate the motor in a first operating mode and a second operating mode. During the first operating mode the controller is configured to manage a stroke length of the fluid displacement member such that a pump stroke of the fluid displacement member occurs in a first displacement range along the pump axis. During the second operating mode the controller is configured to manage the stroke length of the fluid displacement member such that the pump stroke of the fluid displacement member occurs in a second displacement range along the pump axis. The second displacement range has a smaller axial extent than the first displacement range.

According to yet another aspect of the present disclosure, a method of operating a reciprocating pump includes driving, by an electric motor, reciprocation of a first fluid displacement member and a second fluid displacement member to pump fluid; and monitoring, by a controller, an actual operating parameter of the electric motor; and determining, by the controller, that an error has occurred based on the actual operating parameter differing from an expected operating parameter during a particular phase of a pump cycle.

According to yet another aspect of the present disclosure, a displacement pump for pumping a fluid includes an electric motor including a stator and a rotor configured to rotate about a pump axis; a drive connected to the rotor, the drive configured to convert a rotational output from the rotor into a linear input; a first fluid displacement member connected to the drive to be driven by the linear input; and a controller. The controller is configured to cause current to be provided to the stator to drive rotation of the rotor, thereby driving reciprocation of the fluid displacement member; and monitor an actual operating parameter of the electric motor; and determine that an error has occurred based on the actual operating parameter differing from an expected operating parameter during a particular phase of a pump cycle.

DETAILED DESCRIPTION

Figure 1A:
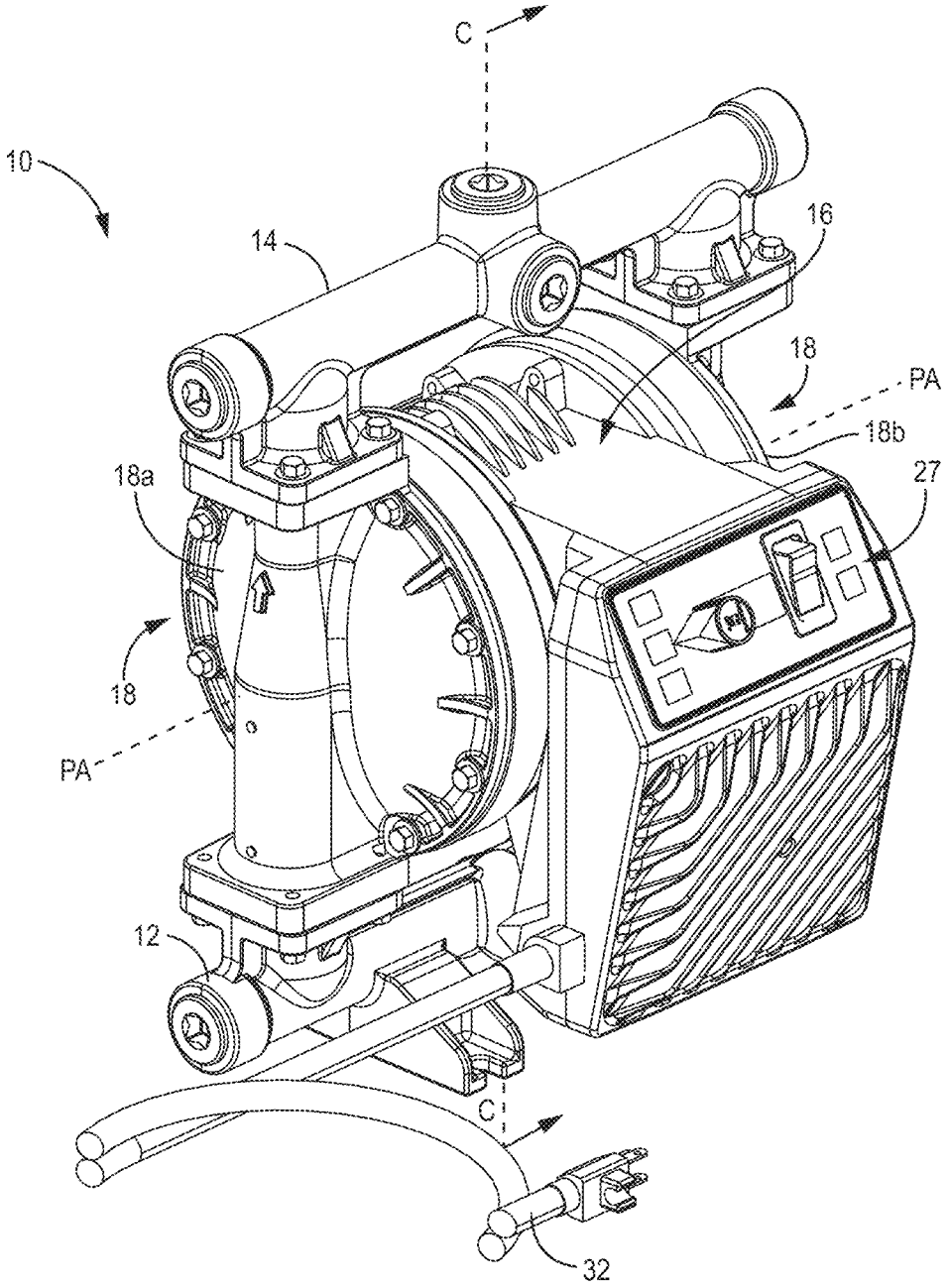
FIG. 1A is a front isometric view of an electrically operated pump.
Figure 1B:
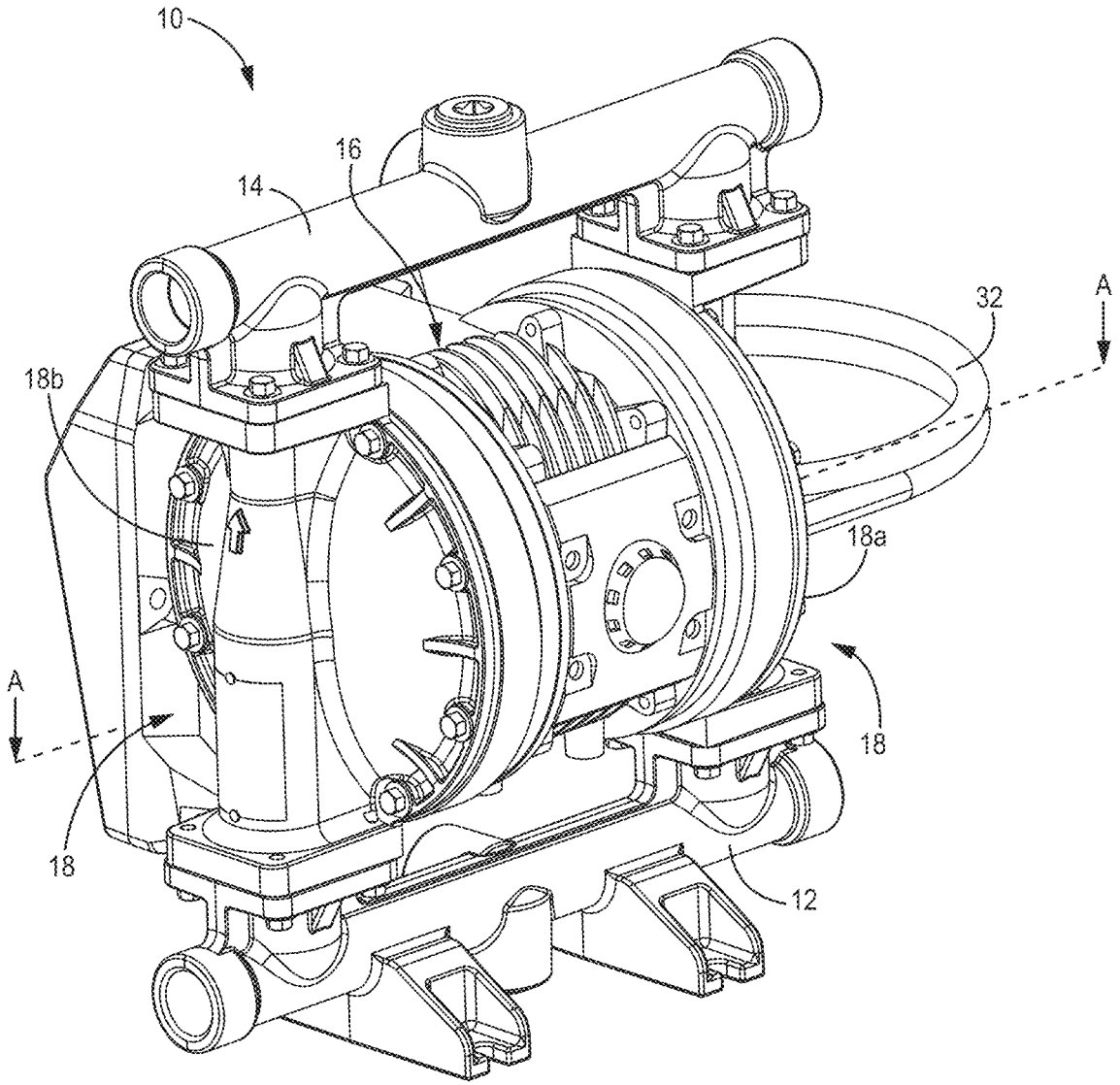
FIG. 1B is a rear isometric view of the electrically operated pump.
Figure 1C:
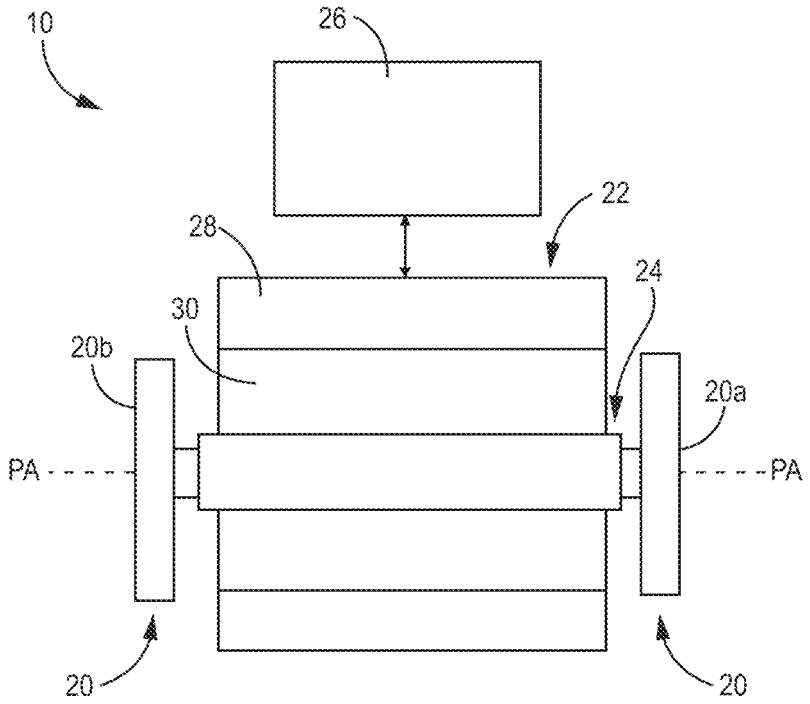
FIG. 1C is a block schematic diagram of the electrically operated pump.

FIG. 1A is a front isometric view of electrically operated pump 10. FIG. 1B is a rear isometric view of pump 10. FIG. 1C is a block schematic diagram of pump 10. FIGS. 1A-1C will be discussed together. Pump 10 includes inlet manifold 12, outlet manifold 14, pump body 16, fluid covers 18*a*, 18*b* (collectively herein "fluid cover 18" or "fluid covers 18"), fluid displacement members 20*a*, 20*b* (collectively herein "fluid displacement member 20" or "fluid displacement members 20"), motor 22, drive mechanism 24, and controller 26. Motor 22 includes stator 28 and rotor 30.

Pump body 16 is disposed between fluid covers 18*a*, 18*b*. Motor 22 is disposed within pump body 16 and is coaxial with fluid displacement members 20, as discussed in more detail below. Motor 22 is an electric motor having stator 28 and rotor 30. Stator 28 includes armature windings and rotor 30 includes permanent magnets. Rotor 30 is configured to rotate about pump axis PA-PA in response to current (such as a direct current (DC) signals and/or alternating current (AC) signals) through stator 28. Motor 22 is a reversible motor in that stator 28 can cause rotor 30 to rotate in either of two rotational directions (e.g., alternating between clockwise and counterclockwise). Rotor 30 is connected to the fluid displacement members 20 via drive mechanism 24, which receives a rotary output from rotor 30 and provides a linear, reciprocating input to fluid displacement members 20. Fluid displacement members 20 can be of any type suitable for pumping fluid from inlet manifold 12 to outlet manifold 14, such as diaphragms or pistons. While pump 10 is shown as including two fluid displacement members 20, it is understood that some examples of pump 10 include a single fluid displacement member 20. Further, while the two fluid displacement members 20 are shown herein as diaphragms, they could instead be pistons in various other embodiments, and the teachings provided herein can apply to piston pumps.

Controller 26 is operatively connected to motor 22 to control operation of motor 22. User interface 27 of controller 26 is shown. During operation, current signals are provided to stator 28 to cause stator 28 to drive rotation of rotor 30. Drive mechanism 24 receives the rotational output from rotor 30 and converts that rotational output into a linear output to drive fluid displacement members 20. In some examples, rotor 30 rotates in the first rotational direction to drive fluid displacement members 20 in a first axial direction and rotates in the second rotational direction to drive fluid displacement members 20 in a second axial direction.

Drive mechanism 24 causes fluid displacement members 20 to reciprocate along pump axis PA-PA through alternating suction and pumping strokes. During the suction stroke, the fluid displacement member 20 draws process fluid from inlet manifold 12 into a process fluid chamber defined, at least in part, by fluid covers 18 and fluid displacement members 20. During the pumping stroke, the fluid displacement member 20 drives fluid from the process fluid chamber to outlet manifold 14. Typically, depending on the arrangement of check valves, the two fluid displacement members 20 are operated 180 degrees out of phase, such that a first fluid displacement member 20 is driven through a pumping stroke (e.g., driving process fluid downstream from the pump) while a second fluid displacement member 20 is driven through a suction stroke (e.g., pulling process fluid upstream from the pump). The two fluid displacement members 20 also simultaneous changeover (e.g., transition between the pumping stroke and the suction stroke) but 180 degrees out of phase with respect to each other.

Drive mechanism 24 is directly connected to rotor 30 and fluid displacement members 20 are directly driven by drive mechanism 24. As such, motor 22 directly drives fluid displacement members 20 without the presence of intermediate gearing, such as speed reduction gearing. Power cord 32 extends from pump 10 and is configured to provide electric power to the electronic components of pump 10. Power cord 32 can connect to a wall socket.

Figure 2:
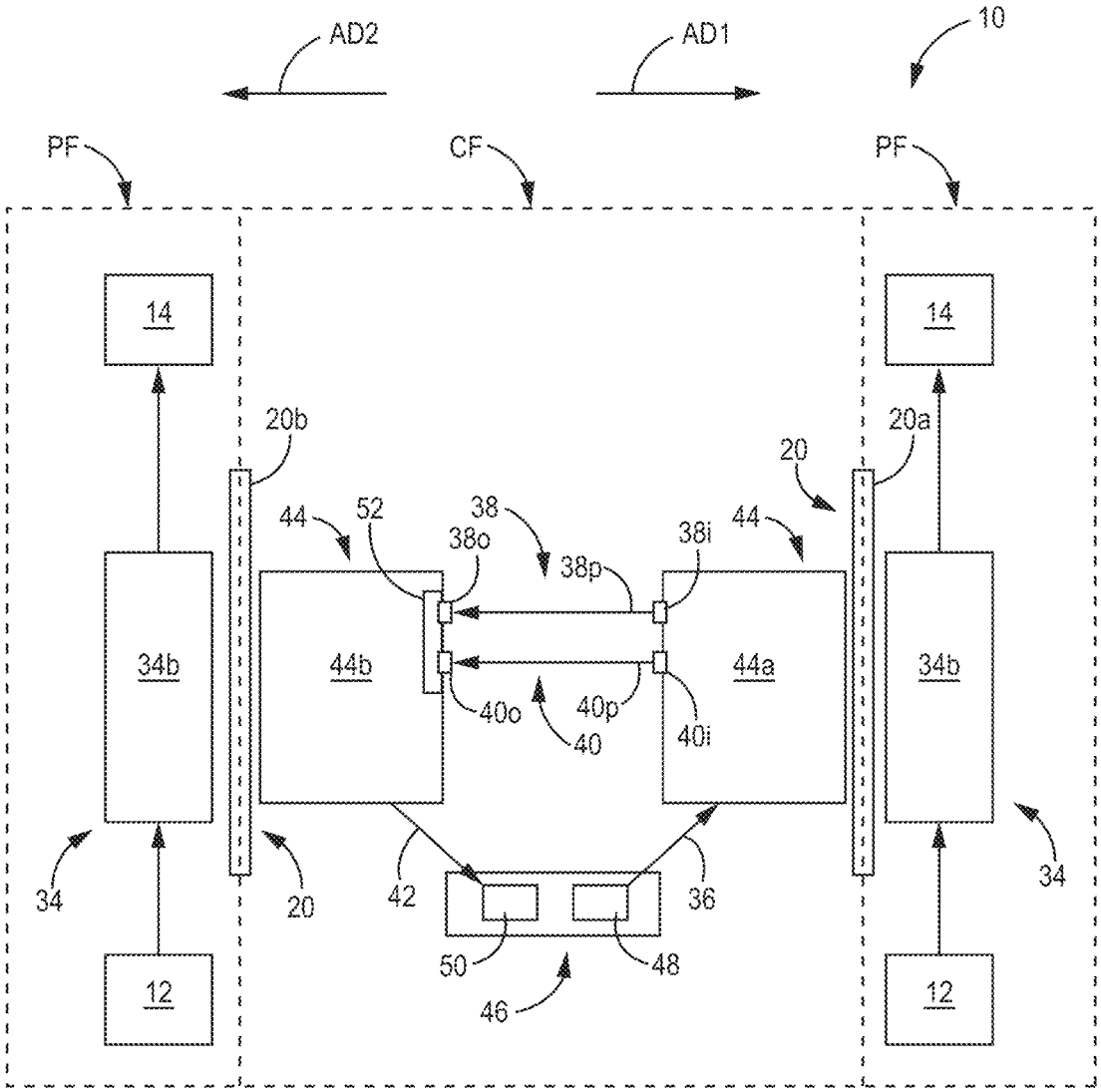
FIG. 2 is a block schematic diagram illustrating flowpaths of an electrically operated pump.

FIG. 2 is a block diagram of pump 10 illustrating fluid flowpaths through pump 10. Process fluid flowpath PF extends from inlet manifold 12 to outlet manifold 14 through process fluid chambers 34*a*, 34*b* (collectively herein "process fluid chamber 34" or "process fluid chambers 34"). It is understood that process fluid chambers 34 can be connected to a common inlet manifold 12 and outlet manifold 14. Cooling fluid circuit CF extends through the interior of pump 10 and routes cooling fluid, such as air, through pump 10 to cool components of pump 10. The main heat sources of pump 10 include controller 26, stator 28, and drive mechanism 24. Cooling fluid circuit CF directs cooling air through passages proximate the heat generating components to affect heat exchange between the cooling air and heat sources and thereby cool pump 10. Not all embodiments necessarily include a cooling fluid circuit or otherwise pump cooling air.

Cooling fluid circuit CF is configured to direct cooling air through pump 10 to cool heat generating components of pump 10, such as drive mechanism 24, controller 26, and stator 28. Pump 10 pumps cooling air through cooling fluid circuit CF. Fluid displacement members 20*a*, 20*b* are disposed out of phase, such that one fluid displacement member 20 moves through a pumping stroke for the cooling air as the other moves through a suction stroke for the cooling air, and the check valves 48, 50, 52 are arranged such that the cooling air enters one side of pump 10 and exits the other side of pump 10. Relatively cooler air enters pump 10 and relatively warmer air exits pump 10. Fluid displacement members 20 can be utilized for pumping the cooling air as fluid displacement members 20 are not moved by a working fluid (e.g., compressed air) but are instead electromechanically driven by motor 22 and drive mechanism 24. Fluid displacement members 20 can thus pump both process fluid and cooling air through pump 10.

Cooling fluid circuit CF includes first cooling passage 36, second cooling passage 38, third cooling passage 40, fourth cooling passage 42, and cooling chambers 44*a*, 44*b* (collectively herein "cooling chamber 44" or "cooling chambers 44"). Air check 46 is disposed at the inlet/exhaust of cooling fluid circuit CF and controls flow of cooling air for unidirectional flow through flowpath CF.

Air check 46 includes inlet valve 48 and outlet valve 50. Inlet valve 48 is a one-way valve that allows cooling air to enter cooling fluid circuit CF and prevents cooling air from backflowing out of cooling chamber 44*a* through air check 46. Outlet valve 50 is a one-way valve that allows cooling air to exit cooling fluid circuit CF and prevents atmospheric air from entering cooling fluid circuit CF through outlet valve 50. Air check 46 can be configured such that one or both of the exhaust and intake flows are directed over cooling fins formed on pump body 16, providing further cooling to pump 10.

Internal valve 52 is disposed in cooling fluid circuit CF where second cooling passage 38 and third cooling passage 40 provide cooling air to cooling chamber 44*b*. Internal valve 52 is a one-way valve that controls flow of cooling air within cooling fluid circuit CF to cause unidirectional flow through cooling fluid circuit CF. Internal valve 52 is a one-way valve that allows cooling air to flow into cooling chamber 44*b* and prevents retrograde flow from cooling chamber 44*b*.

Figure 4A:
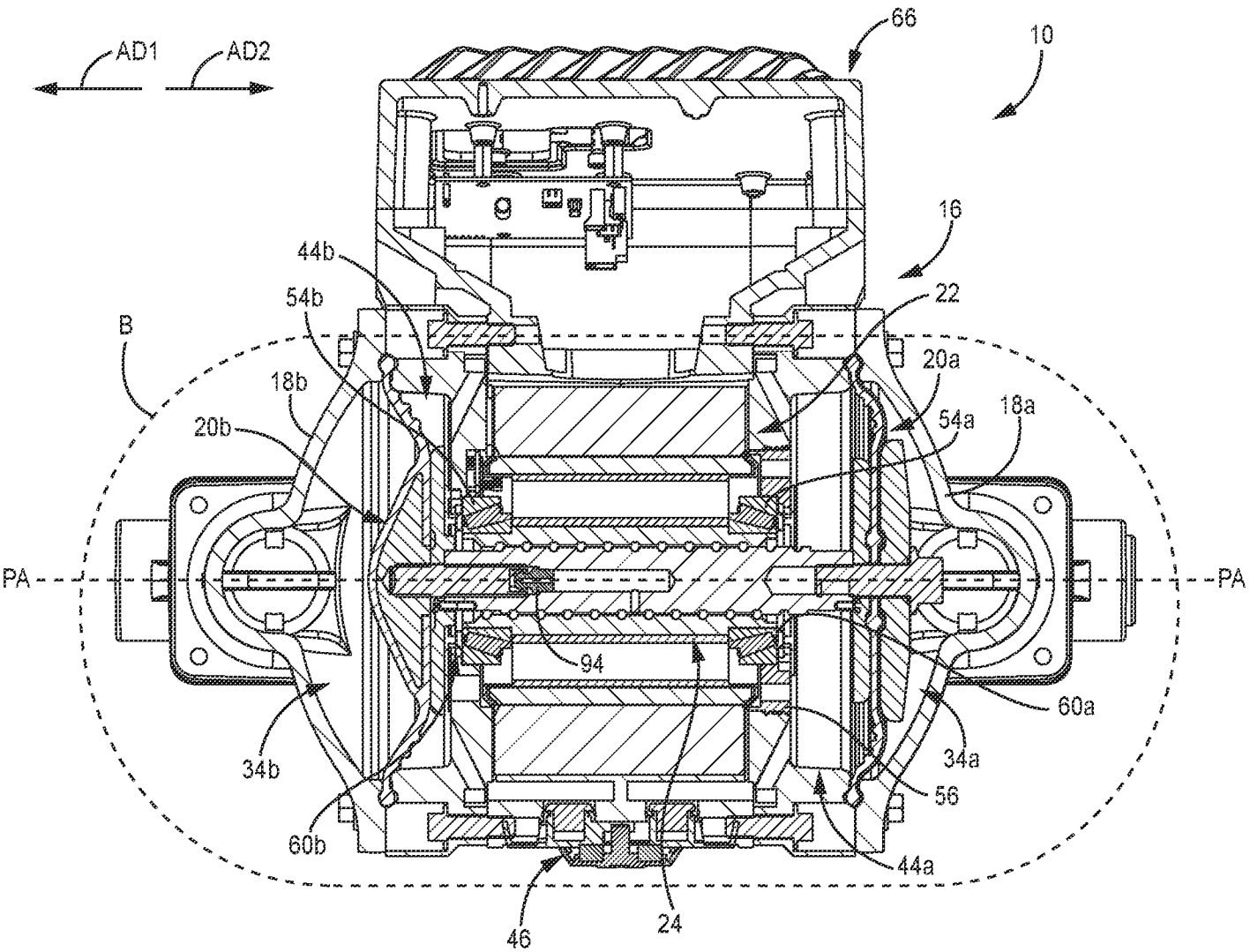
FIG. 4A is a cross-sectional view taken along line A-A in FIG. 1B.
Figure 4B:
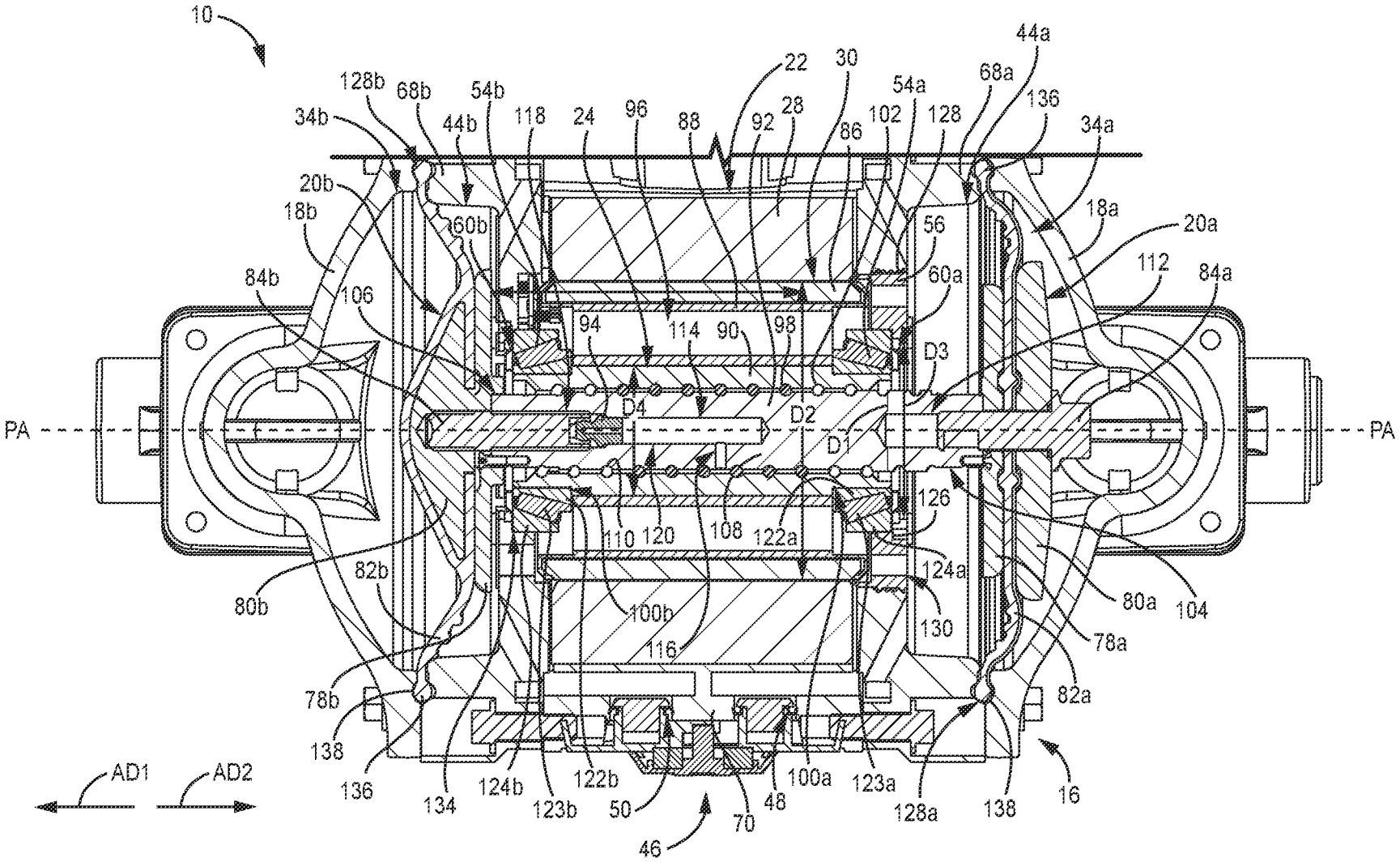
FIG. 4B is an enlarged view of detail B in FIG. 4A.
Figure 4C:
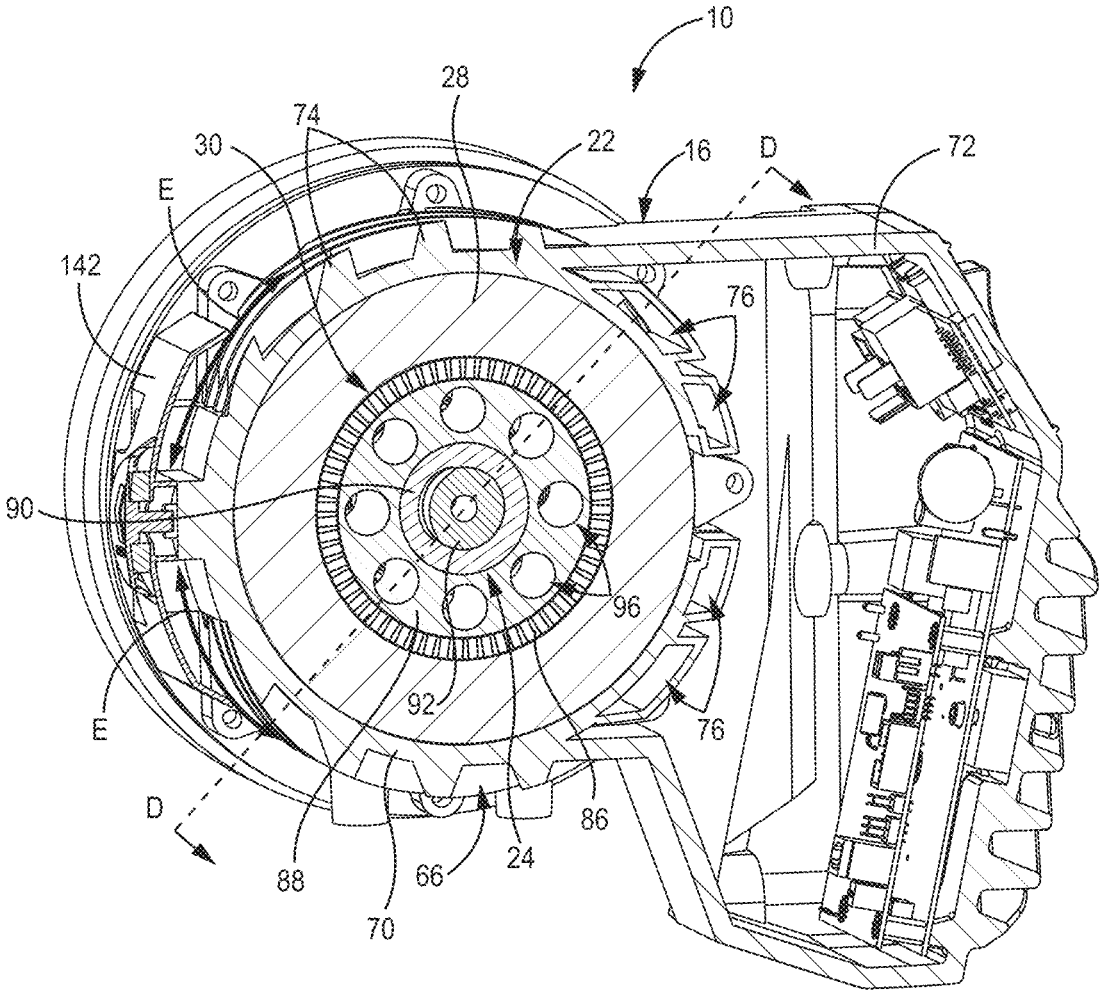
FIG. 4C is a cross-sectional view taken along line C-C in FIG. 1A.
Figure 4D:
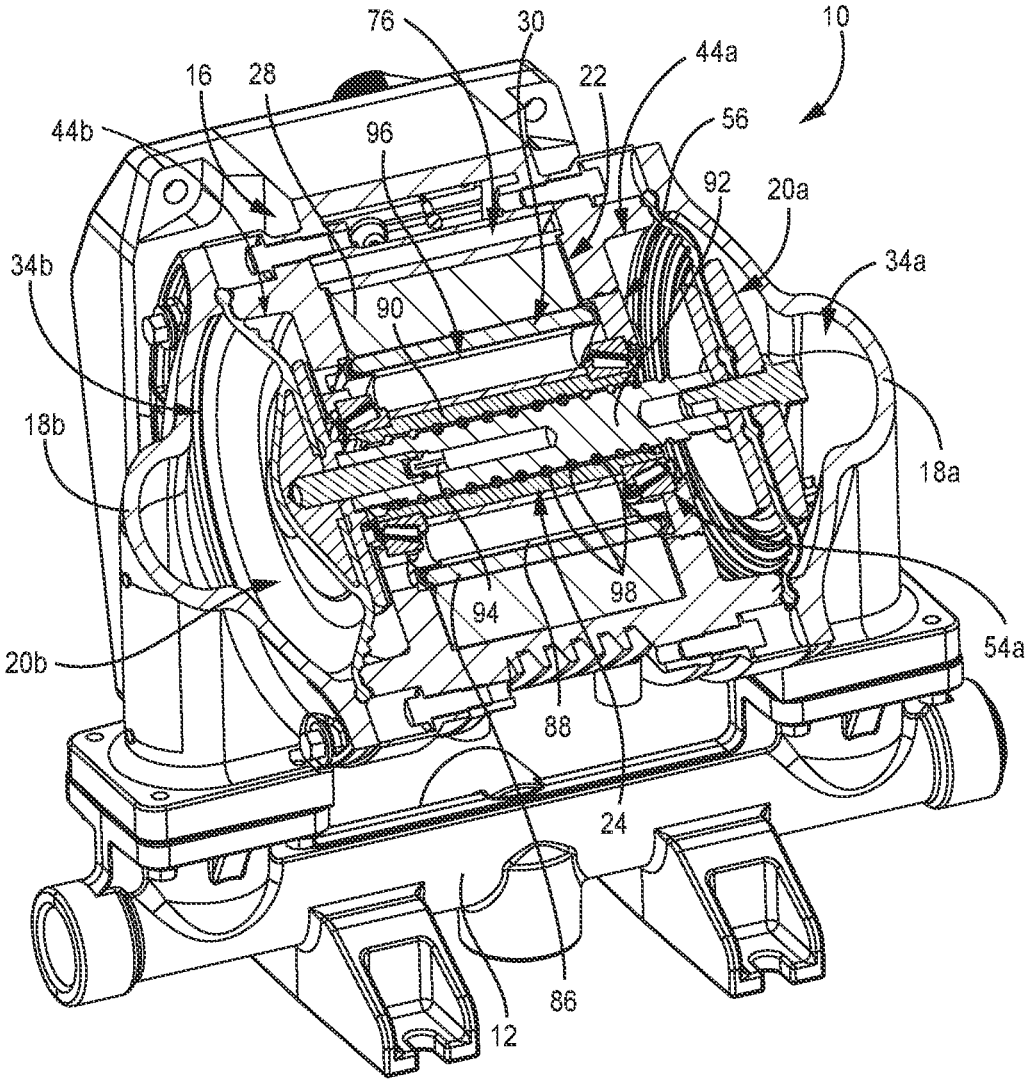
FIG. 4D is a cross-sectional view taken along line D-D in FIG. 4B.

First cooling passage 36 extends from an air inlet at inlet valve 48 to cooling chamber 44*a*. Cooling chamber 44*a* is disposed between fluid displacement member 20*a* and motor 22 (as shown in FIGS. 4A, 4B, and 4D). Second cooling passage 38 and third cooling passage 40 extend from cooling chamber 44*a* to cooling chamber 44*b*. Each of second cooling passage 38 and third cooling passage 40 can include one or more individual passages. In some examples, second cooling passage 38 includes a plurality of individual passages. In some examples, second cooling passage 38 includes different numbers of inlet/outlet apertures 38*i*/38*o* and pathways 38*p* extending between the inlet aperture(s) 38*i* and outlet aperture(s) 380. In one example, second cooling passage 38 includes a single inlet aperture 38*i* in direct fluid communication with cooling chamber 44*a*, a plurality of pathways 38*p*, and a single outlet aperture 38*o* in direct fluid communication with cooling chamber 44*b*. In some examples, third cooling passage 40 includes a plurality of individual passages. In some examples, third cooling passage 40 includes variable numbers of individual passages at different axial locations through third cooling passage 40. For example, third cooling passage 40 can include a first number of inlet apertures 40*i*, a second number of pathways 40*p*, and a third number of outlet apertures 40*o*. The first number, second number, and third number can each be identical, can all be different, or two can be the same with the third different.

In some examples, second cooling passage 38 includes stator passages that remain stationary relative to pump axis PA-PA during operation and third cooling passage 40 includes rotor passages that extends through rotor 30 (best seen in FIGS. 4A-4D and 12) and rotate about pump axis PA-PA during operation. For example, second cooling passage 38 can be formed by portions of pump body 16 and can be disposed at least partially between controller 26 (FIGS. 1C and 16) and stator 28 (best seen in FIGS. 4A-4D and 12). Third cooling passage 40 can be formed through a body of rotor 30 and can be disposed between stator 28 and drive mechanism 24. It is understood, however, that second cooling passage 38 and third cooling passage 40 can be of any desired configuration suitable for passing cooling air between cooling chamber 44*a* and cooling chamber 44*b*.

Internal valve 52 is disposed between second cooling passage 38 and cooling chamber 44*b* and between third cooling passage 40 and cooling chamber 44*b*. Internal valve 52 is disposed at the outlet 38*o* of second cooling passage 38 and the outlet 40*o* of third cooling passage 40. Cooling chamber 44*b* is disposed between fluid displacement member 20*b* and motor 22. Internal valve 52 allows cooling air to flow into cooling chamber 44*b* while preventing retrograde flow through second cooling passage 38 and third cooling passage 40. In some examples, internal valve 52 includes a single valve member associated with each of second cooling passage 38 and third cooling passage 40. For example, a flapper valve member can extend over multiple outlets. In some examples, internal valve 52 includes multiple valve members associated with one or more outlets of second cooling passage 38 and third cooling passage 40. In some examples, internal valve 52 includes the same number of valve members as there are outlets, such that each outlet has a dedicated valve member. For example, ball valves can be disposed in each outlet, among other options. Fourth cooling passage 42 extends from cooing chamber 44*b* to an exhaust outlet at outlet valve 50. The cooling air exits flowpath CF through outlet valve 50.

Fluid displacement member 20*a* is disposed between and fluidly isolates process fluid chamber 34*a* and cooling chamber 44*a*. Fluid displacement member 20*a* can at least partially define each of process fluid chamber 34*a* and cooling chamber 44. Fluid displacement member 20*a* shifts in a first axial direction AD1 to decrease the volume of process fluid chamber 34*a*, driving process fluid out of process fluid chamber 34*a*, and increase the volume of cooling chamber 44*a*, drawing cooling air into cooling chamber 44*a*. Fluid displacement member 20*a* shifts in a second axial direction AD2 opposite the first axial direction AD1 to increase the volume of process fluid chamber 34*a*, drawing process fluid from inlet manifold 12 into process fluid chamber 34*a*, and decrease the volume of cooling chamber 44*a*, driving cooling air out of cooling chamber 44*a*. As such, fluid displacement member 20*a* proceeds through a pumping stroke for the process fluid while simultaneously proceeding through a suction stroke for the cooling air and proceeds through a suction stroke for the process fluid while simultaneously proceeding through a pumping stroke for the cooling air. Fluid displacement member 20*a* simultaneously pumps process fluid and cooling air.

Fluid displacement member 20*b* is substantially similarly to fluid displacement member 20*a*. Fluid displacement member 20*b* pumps process fluid through process fluid chamber 34*b* and cooling air through cooling chamber 44*b*. Fluid displacement member 20*b* is connected to fluid displacement member 20*a* such that pump strokes are reversed. As such, fluid displacement member 20*b* proceeds through a pumping stroke of process fluid chamber 34*b* and a suction stoke of cooling chamber 44*b* when driven in the second axial direction AD2 and proceeds through a suction stroke of process fluid chamber 34*b* and a pumping stroke of cooling chamber 44*b* when driven in the first axial direction AD1.

During operation, fluid displacement members 20 shift axially through first and second strokes. During the first stroke, fluid displacement member 20*a* shifts through a pumping stroke for process fluid chamber 34*a* and a suction stoke for cooling chamber 44*a*. Fluid displacement member 20*a* drives process fluid out of process fluid chamber 34*a* to outlet manifold 14. Simultaneously, fluid displacement member 20*a* causes cooling chamber 44*a* to expand, drawing cooling air into cooling chamber 44*a* through inlet valve 48 and first cooling passage 36. Fluid displacement member 20*b* shifts through a suction stroke for process fluid chamber 34*b* and a pumping stroke for cooling chamber 44*b*. Fluid displacement member 20*b* causes the volume of process fluid chamber 34*b* to increase, drawing process fluid into process fluid chamber 34*b* from inlet manifold 12. Simultaneously, fluid displacement member 20*b* causes cooling chamber 44*b* to contract, thereby driving cooling air from cooling chamber 44*b* and out of flowpath CF through fourth cooling passage 42 and outlet valve 50. Each of inlet valve 48 and outlet valve 50 are open during the first stroke. As such, air check 46 is in an open state during the first stroke. Cooling chamber 44*b* contracting and cooling chamber 44*a* expanding causes internal valve 52 to remain in or return to a closed state, preventing the cooling air from flowing upstream from cooling chamber 44*b* through second cooling passage 38 or third cooling passage 40.

Fluid displacement members 20 changeover at the end of the first stroke and are driven in the opposite axial direction during the second stroke. Fluid displacement member 20*a* shifts through a suction stroke for process fluid chamber 34*a* and draws process fluid into process fluid chamber 34*a* from inlet manifold 12. Simultaneously, fluid displacement member 20*a* shifts through a pumping stroke for cooling chamber 44*a*. The pressure rise in cooling chamber 44*a* causes inlet valve 48 to shift to a closed state, preventing retrograde flow out of cooling air out of flowpath CF through inlet valve 48. Fluid displacement member 20*a* drives the cooling air from cooling chamber 44*a* to cooling chamber 44*b* via second cooling passage 38 and third cooling passage 40.

Fluid displacement member 20*b* shifts simultaneously with fluid displacement member 20*a*. Fluid displacement member 20*b* shifts through a pumping stroke for process fluid chamber 34*b* and a suction stroke for cooling chamber 44*b*. The suction stroke causes outlet valve 50 to shift to a closed state, preventing atmospheric flow into cooling chamber 44*b* through air check 46. Fluid displacement member 20*b* draws the cooling air from cooling chamber 44*a* into cooling chamber 44*b* via second cooling passage 38 and third cooling passage 40. Both inlet valve 48 and outlet valve 50 are closed during the second stroke. As such, air check 46 is in a closed state during the second stroke.

The pressure in cooling chamber 44*a* and the suction in cooling chamber 44*b* cause internal valve 52 to shift to an open state, thereby opening flowpaths between cooling chamber 44*a* and cooling chamber 44*b* through second cooling passage 38 and third cooling passage 40. A first portion of the cooling air in cooling chamber 44*a* is pumped through second cooling passage 38 and a second portion of the cooling air in cooling chamber 44*a* is pumped through third cooling passage 40. The first and second portions of cooling air are routed past heat generating components of pump 10. The cooling air is moved from one side of pump 10 to the other. More specifically, the cooling air is forced to flow through motor 22. The cooling air is forced to flow over drive mechanism 24. In some examples, cooling air is forced to flow through the drive mechanism 24, such that the flowing air contacts the screw and/or plurality of rolling elements. The cooling air absorbs heat from those components as it flows through second cooling passage 38 and third cooling passage 40. The suction stroke in cooling chamber 44*b* and pumping stroke in cooling chamber 44*a* cause internal valve 52 to open, thereby allowing the first and second portions of the cooling air to flow into cooling chamber 44*b*.

After completing the second stroke, fluid displacement members 20 are driven back through the first stroke and continue to pump both cooling air and process fluid. In some examples, fluid displacement members 20*a*, 20*b* are disposed in parallel for process fluid flowpath PF. Each of fluid displacement members 20*a*, 20*b* is downstream of inlet manifold 12 and upstream of outlet manifold 14. Neither one of fluid displacement members 20*a*, 20*b* is upstream or downstream of the other one of fluid displacement members 20*a*, 20*b*. Neither one of fluid displacement members 20*a*, 20*b* receives process fluid from or provides process fluid to the other one of fluid displacement members 20*a*, 20*b*.

While fluid displacement members 20*a*, 20*b* are disposed in parallel in process fluid flowpath PF, fluid displacement members 20*a*, 20*b* are disposed in series in cooling fluid circuit CF. Cooling chamber 44*a* is disposed upstream of and provides cooling air to cooling chamber 44*b*. Fluid displacement member 20*a* forms a pumping element for cooling chamber 44*a* and fluid displacement member 20*b* forms a pumping element for cooling chamber 44*b*. Fluid displacement members 20*a*, 20*b* operate in tandem to drive cooling air from cooling chamber 44*a* to cooling chamber 44*b*.

Cooling fluid circuit CF provides air cooling for pump 10. The main heat generating components of pump 10, which include controller 26, stator 28, and drive mechanism 24, are disposed relative to second cooling passage 38 and third cooling passage 40 to facilitate a heat exchange relationship with the cooling air. The inlet and/or outlet of cooling fluid circuit CF can be oriented to direct airflow over fins formed on pump body 16 to further cool pump 10. Fluid displacement members 20 driving both the process fluid and cooling air provides efficient cooling without requiring additional components, such as fans.

Figure 3A:
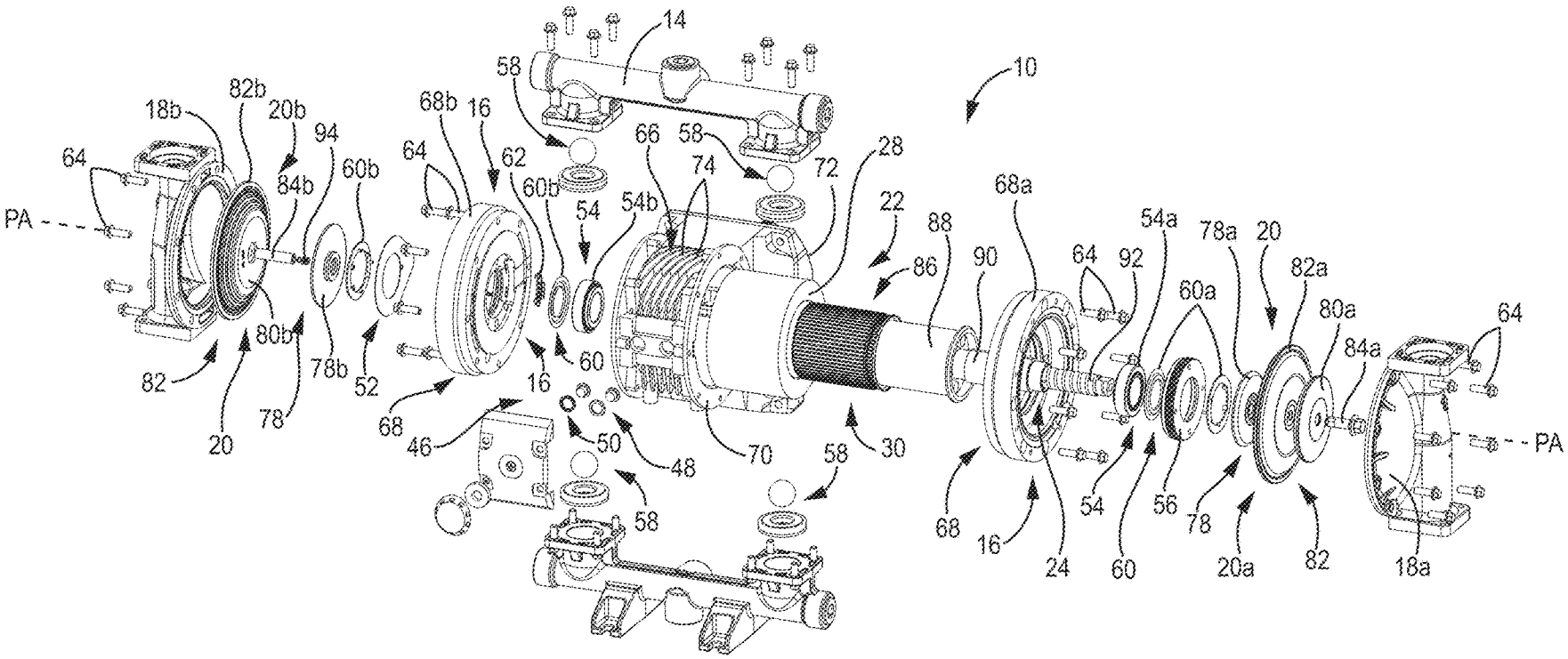
FIG. 3A is an exploded rear isometric view of an electrically operated pump.
Figure 3B:
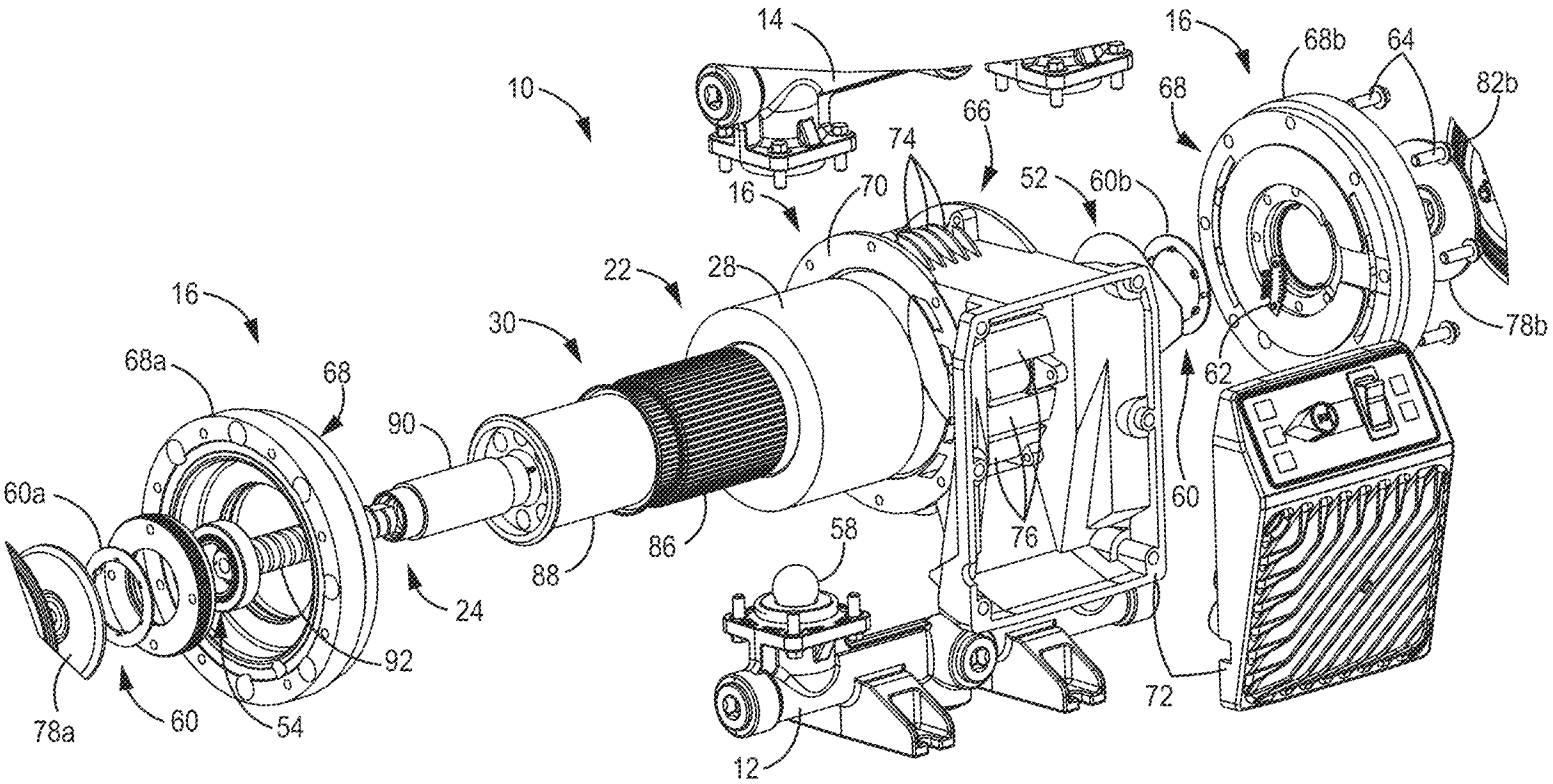
FIG. 3B is an exploded front isometric view of a portion of an electrically operated pump.

FIG. 3A is an exploded front isometric view of pump 10. FIG. 3B is an exploded rear isometric view showing a subset of the components of pump 10. FIGS. 3A and 3B will be discussed together. Pump 10 includes inlet manifold 12, outlet manifold 14, pump body 16, fluid covers 18*a*, 18*b*, fluid displacement members 20*a*, 20*b*, motor 22, drive mechanism 24, air check 46, internal valve 52, bearings 54*a*, 54*b* (collectively herein "bearing 54" or "bearings 54"), motor nut 56, pump check valves 58, grease caps 60*a*, 60*b* (collectively herein "grease cap 60" or "grease caps 60"), position sensor 62, and housing fasteners 64.

Pump body 16 includes central portion 66 and end caps 68*a*, 68*b* (collectively herein "end cap 68" or "end caps 68"). Central portion 66 includes motor housing 70, control housing 72, heat sinks 74, and stator passages 76 (FIG. 3B). Fluid displacement members 20*a*, 20*b* respectively include inner plates 78*a*, 78*b* (collectively herein "inner plate 78" or "inner plates 78"); outer plates 80*a*, 80*b* (collectively herein "outer plate 80" or "outer plates 80"); membranes 82*a*, 82*b* (collectively herein "membrane 82" or "membranes 82"), and fasteners 84*a*, 84*b*. Motor 22 includes stator 28 and rotor 30. Rotor 30 includes permanent magnet array 86 and rotor body 88. Drive nut 90 and screw 92 of drive mechanism 24 are shown.

End caps 68*a*, 68*b* are disposed on opposite lateral sides of central portion 66 and are attached to central portion 66 to form pump body 16. Housing fasteners 64 extend through end caps 68 into pump body 16 to secure end caps 68 to pump body 16. Heat sinks 74 are formed on central portion 66. In the example shown, heat sinks 74 are formed by fins, but it is understood that heat sinks can be of any configuration suitable for increasing the surface area of pump body 16 to facilitate heat exchange to cool pump 10. Stator passages are formed on central portion 66 at an interface between motor housing 70 and control housing 72. Stator passages 76 define portions of second cooling passage 38 (FIG. 2). Stator passages 76 are formed as projections that includes at least four sides exposed to heat generating elements within pump body 16 and cooled air flowing through stator passages 76. For example, one side of each stator passage 76 can be disposed adjacent stator 28 while three sides of each stator passage 76 can be exposed to heated air within control housing 72. In some examples, stator passages 76 are enclosed during operation such that the stator passages 76 are not exposed directly to atmosphere.

Fluid covers 18*a*, 18*b* are connected to end caps 68*a*, 68*b*, respectively. Housing fasteners 64 secure fluid covers 18 to end caps 68. Inlet manifold 12 is connected to each fluid cover 18. Inlet ones of pump checks 58 are disposed between inlet manifold 12 and fluid covers 18*a*, 18*b*. The inlet ones of pump checks 58 are one-way valves configured to allow the process fluid to flow into process fluid chambers 34*a*, 34*b* (FIGS. 2 and 4A) and prevent retrograde flow from process fluid chambers 34*a*, 34*b* to inlet manifold 12. Outlet manifold 14 is connected to each fluid cover 18. Outlet ones of pump checks 58 are disposed between outlet manifold 14 and fluid covers 18*a*, 18*b*. The outlet ones of pump checks 58 are one-way valves configured to allow the process fluid to flow out of process fluid chambers 34*a*, 34*b* to outlet manifold 14 and to prevent retrograde flow from outlet manifold 14 to process fluid chambers 34*a*, 34*b*.

Figure 19:
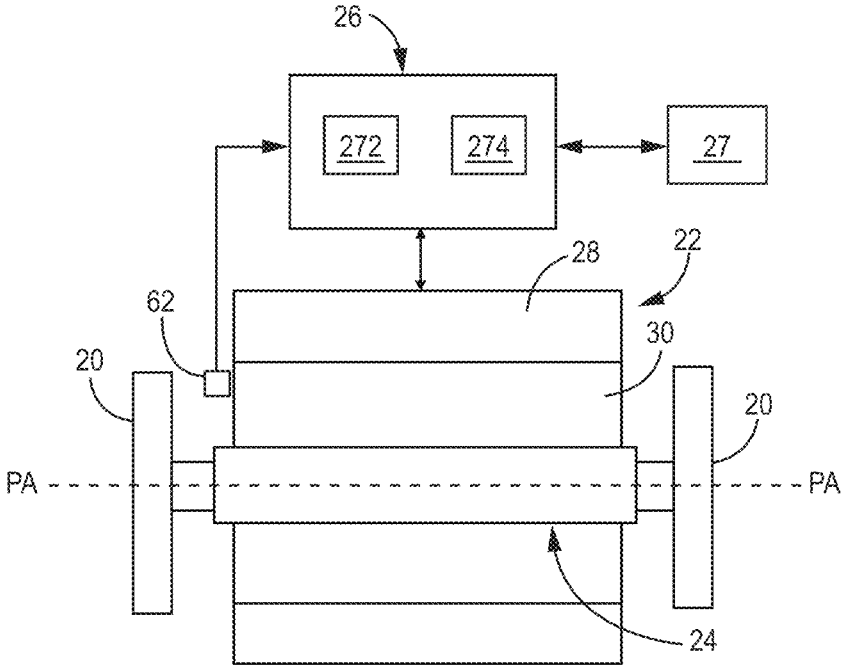
FIG. 19 is a block diagram of an electrically operated pump.

Motor 22 is disposed within motor housing 70 between end caps 68. Control housing 72 is connected to and extends from motor housing 70. Control housing 72 is configured to house control elements of pump 10, such as controller 26 (FIGS. 1C and 19). Stator 28 surrounds rotor 30 and drives rotation of rotor 30. Rotor 30 rotates about pump axis PA-PA and is disposed coaxially with drive mechanism 24 and fluid displacement members 20. Permanent magnet array 86 is disposed on rotor body 88.

Drive nut 90 is disposed within and connected to rotor body 88. Drive nut 90 can be attached to rotor body 88 via fasteners (e.g., bolts), adhesive, or press-fit, among other options. Drive nut 90 rotates with rotor body 88. Drive nut 90 is mounted to bearings 54*a*, 54*b* at opposite axial ends of drive nut 90. Bearings 54 are configured to support both axial and radial forces. In some examples, bearings 54 comprise tapered roller bearings. Screw 92 extends through drive nut 90 and is connected to each fluid displacement member 20. Screw 92 reciprocates along pump axis PA-PA to drive fluid displacement members 20 through respective pumping and suction strokes.

Motor nut 56 connects to a portion of pump body 16 housing stator 28. Motor nut 56 can be considered to connect to a stator housing of pump 10, which stator housing can be formed by the motor housing 70 and end caps 68*a*, 68*b*. In the example shown, motor nut 56 connects to end cap 68*a* and secures bearings 54 within pump body 16. Motor nut 56 preloads bearings 54. Screw 92 can reciprocate through motor nut 56 during operation. Grease cap 60*a* is supported by motor nut 56 and motor nut 56 aligns grease cap 60*a* relative to bearing 54*a*. Grease cap 60*b* is disposed adjacent bearing 54*b*. Grease caps 60 prevent contaminants from entering bearings 54 and retain any grease that may liquify during operation.

Internal valve 52 is connected to end cap 68*b*. Internal valve 52 is connected to end cap 68*b* by grease cap 60*b*. Internal valve 52 is disposed on a side of end cap 68*b* facing fluid displacement member 20*b*. In the example shown, internal valve 52 is a flapper valve.

Fluid displacement member 20*a* is connected to first end of screw 92. Membrane 82*a* is captured between inner plate 78*a* and outer plate 80*a*. Fastener 84*a* extends through each of inner plate 78*a*, outer plate 80*a*, and membrane 82 and into screw 92 to connect fluid displacement member 20*a* to drive mechanism 24. An outer circumferential edge of membrane 82*a* is captured between fluid cover 18*a* and end cap 68*a*. Membrane 82*a* is captured to prevent fluid displacement member 20*a* from rotating about pump axis PA-PA.

Fluid displacement member 20*b* is connected to an opposite axial end of screw 92 from fluid displacement member 20*a*. In the example shown, membrane 82*b* is overmolded onto outer plate 80*b*. Fastener 84*b* extends from outer plate 80*b* through the inner plate 78*b* and into screw 92 to connect fluid displacement member 20*b* to drive mechanism 24. An outer circumferential edge of membrane 82*b* is captured between fluid cover 18*b* and end cap 68*b*. Membrane 82*b* is captured to prevent fluid displacement member 20*b* from rotating about pump axis PA-PA. While fluid displacement members 20 are described as having different configurations, it is understood that pump 10 can include fluid displacement members 20 having the same or differing configurations.

During operation, current signals are provided to stator 28 to drive rotation of rotor 30. Position sensor 62 is disposed proximate rotor 30, as discussed in more detail below, and generates position data regarding the rotational position of rotor 30 relative to stator 28. For example, position sensor 62 can include an array of Hall-effect sensors responsive to the polarity of the permanent magnets in permanent magnet array 86. Controller 26 utilizes the position data to commutate motor 22.

Drive mechanism 24 converts rotational motion from rotor 30 into linear motion of fluid displacement members 20. Rotor body 88 rotates about pump axis PA-PA (best seen in FIG. 4A) and drives rotation of drive nut 90. Drive nut 90 drives screw 92 axially along pump axis PA-PA by engagement of rolling elements, such as rolling elements 98 (best seen in FIGS. 12 and 13), disposed between drive nut 90 and screw 92 and supporting drive nut 90 relative screw 92. The rolling elements support drive nut 90 relative screw 92 such that drive nut 90 does not contact screw 92 during operation. The rolling elements translate the rotation of drive nut 90 into linear movement of screw 92. Screw 92 drives fluid displacement members 20 through respective pumping and suction strokes. Rotor 30 is rotated in a first rotational direction to cause screw 92 to displace in a first axial direction. Rotor 30 is rotated in a second rotational direction opposite the first rotational direction to cause screw 92 to displace in a second axial direction opposite the first axial direction.

Motor 22 is axially aligned with fluid displacement members 20 and drives reciprocation of fluid displacement members 20. Rotor 30 rotates about pump axis PA-PA and fluid displacement members 20 reciprocate on pump axis PA-PA. Pump 10 provides significant advantages. Motor 22 being axially aligned with fluid displacement members 20 facilitates a compact pump arrangement providing a smaller package relative to other mechanically-driven and electrically-driven pumps. In addition, motor 22 does not include gearing, such as reduction gears, between motor 22 and fluid displacement members 20. Eliminating that gearing provides a more reliable, simpler pump by reducing the count of moving parts Eliminating the gearing also provides a quieter pump operation.

Rotor 30 and drive mechanism 24, 24', 24" are sized to provide a desired revolution to stoke ratio. In some examples, rotor 30 and drive mechanism 24, 24', 24" are sized such that one revolution of rotor 30 results in a full stroke of screw 92 in one of first axial direction AD1 and second axial direction AD2. A full revolution in an opposite rotational direction results in a full stroke of screw 92 in the opposite axial direction. As such, two revolutions in opposite directions can provide a full pump cycle for each fluid displacement member 20. Pump 10 can thereby provide a 1:1 ratio between revolutions of rotor 30 and pumping strokes. In the example shown, pump 10 can provide a 1:1 ratio between revolutions of rotor 30 and pump cycles, as one fluid displacement member 20 proceeds through a pumping stroke during a single stroke and the other fluid displacement member 20 proceeds through a suction stroke during the single stroke. The revolution to stroke ratio depends on the stroke length and the lead (the axial travel for a single revolution) of screw 92. In some examples, screw 92 has a lead of about 5-35 millimeters (mm) (about 0.2-1.4 inches (in.)). In some examples, screw 92 has a lead of about 10-25 mm (about 0.4-1.0 in.). In some examples, the stroke length is about 12.7-76.2 mm (about 0.5-3 in.). In some examples, the stroke length is about 19-63.5 mm (about 0.75-2.5 in.). In some examples, the stroke length is about 21.6-58.4 mm (0.85-2.3 in.). It is understood that rotor 30 and drive mechanism 24, 24', 24" can be sized to provide any desired revolution to stroke ratio. For example, pump 10 can have a revolution to stroke ratio of about 0.25:1 to about 7:1. In some examples, pump 10 has a revolution to stroke ratio of about 0.5:1 to about 3:1. In a more particular example, pump 10 has a revolution to stroke ratio of about 0.8:1 to about 1.5:1. A relatively larger revolution to stroke ratio facilitates greater pumping pressures. A relatively smaller revolution to stroke ratio facilitates greater flow rates.

It is understood, however, that rotor 30 and drive mechanism 24, 24', 24" can be sized to provide any desired revolution to stroke ratio. It is further understood that controller 26 can control operation of motor 22 such that the actual stroke length is dynamic and varies can during operation. Controller 26 can cause the stroke length to vary between the downstroke and the upstroke. In some examples, controller 26 is configured to control operation between a maximum revolution to stroke ratio and a minimum revolution to stroke ratio. Pump 10 can be configured to provide any desired revolution to stroke ratio. In some examples, pump 10 provides a revolution to stroke ratio of up to about 4:1. It is understood that other maximum revolution to stroke ratios are possible, such as about 1:1, 2:1, 3:1, or 5:1, among other options. It is understood that any of the ranges discussed can be an inclusive range such that the boundary values are included within the range. It is further understood that each of the ranges discussed can vary from the specified range while still falling within the scope of this disclosure.

Motor 22 and drive mechanism 24, 24', 24" can be configured to displace fluid displacement member 20 at least about 6.35 mm (about 0.25 in.) per rotor revolution. In some examples, motor 22 and drive mechanism 24, 24', 24" are configured to displace fluid displacement member 20 between about 8.9-30.5 mm (about 0.35-1.2 in.) per rotor revolution. In some examples, motor 22 and drive mechanism 24, 24', 24" are configured to displace fluid displacement member 20 between about 8.9-11.4 mm (about 0.35-0.45 in.). In some examples, motor 22 and drive mechanism 24, 24', 24" are configured to displace fluid displacement member 20 between about 19-21.6 mm (about 0.75-0.85 in.). In some examples, motor 22 and drive mechanism 24, 24', 24" are configured to displace fluid displacement member 20 between about 24, 24', 24" 0.1-26.7 mm (about 0.95-1.05 in.). The axial displacement per rotor revolution provided by pump 10 facilitates precise control and quick responsiveness during pumping. The axial displacement per rotor revolution facilitates quick changeover and provides more efficient pumping while reducing wear on components of pump 10.

Pump 10 is configured to pump according to a revolution to displacement ratio. More specifically, motor 22 and drive mechanism 24, 24', 24" are configured to provide a desired revolution to displacement ratio between revolutions of rotor 30 and the linear displacement of fluid displacement member 20, as measured in inches, for each revolution of rotor 30. In some examples, the revolution to displacement ratio (rev/in.) is less than about 4:1. In some examples, the revolution to displacement ratio is between about 0.85:1 and 3.25:1. In some examples, the revolution to displacement ratio is between about 1:1-3:1. In some examples, the revolution to displacement ratio is between about 1:1-2.75:1. In some examples, the revolution to displacement ratio between is about 1:1-2.55:1. In some examples, the revolution to displacement ratio is between about 1:1-1.3:1. In some examples, the revolution to displacement ratio is between about 0.9:1-1.1:1. In some examples, the revolution to displacement ratio is between about 2.4:1-2.6:1. The low revolution to displacement ratio provided by pump 10 relative to other electrically-powered pumps, such as crank-powered pumps that require reduction gearing to generate sufficient pumping torque and typically have revolution to displacement ratios of about 8:1 or higher, facilitates more efficient pumping, generates less wear, and provides quick responsiveness for changing stroke direction. Rotor 30 can be driven at a lower rotational speed to generate the same linear speed, thereby generating less heat during operation.

FIG. 4A is a cross-sectional view of pump 10 taken along line A-A in FIG. 1B. FIG. 4B is an enlarged view of a portion of the cross-section shown in FIG. 4A. FIG. 4C is a cross-sectional view of pump 10 taken along line C-C in FIG. 1A. FIG. 4D is a cross-sectional view taken along line D-D in FIG. 4C. FIGS. 4A-4D will be discussed together. Pump body 16, fluid covers 18*a*, 18*b*, fluid displacement members 20*a*, 20*b*, motor 22, drive mechanism 24, process fluid chambers 34*a*, 34*b*, cooling chambers 44*a*, 44*b*, air check 46, bearings 54*a*, 54*b*, motor nut 56, grease caps 60*a*, 60*b*, and grease fitting 94 of pump 10 are shown.

Pump body 16 includes central portion 66 and end caps 68*a*, 68*b*. Central portion 66 includes motor housing 70, control housing 72, heat sinks 74, and stator passages 76. Fluid displacement members 20*a*, 20*b* respectively include inner plates 78*a*, 78*b*, outer plates 80*a*, 80*b*, membranes 82*a*, 82*b*, and fasteners 84*a*, 84*b*.

Motor 22 includes stator 28 and rotor 30. Rotor 30 includes permanent magnet array 86 and rotor body 88. Rotor body 88 includes rotor bores 96.

Drive mechanism 24 includes drive nut 90, screw 92, and rolling elements 98. Drive nut 90 includes nut notches 100*a*, 100*b* (collectively herein "nut notch 100" or "nut notches 100") and nut thread 102. Screw 92 includes first screw end 104, second screw end 106, screw body 108, screw thread 110, first bore 112, second bore 114, and third bore 116. Second bore 114 includes first diameter portion 118 and second diameter portion 120. Bearings 54*a*, 54*b* include inner races 122*a*, 122*b* and outer races 124*a*, 124*b*, respectively. Motor nut 56 includes motor nut notch 126, outer edge 128, and cooling ports 130.

Components can be considered to axially overlap when the components are disposed at a common position along an axis such that a radial line projecting from that axis extends through each of those axially-overlapped components. Similarly, components can be considered to radially overlap when the components are disposed at common radial distances from the axis such that an axial line parallel to the axis extends through each of those radially-overlapped components.

End caps 68*a*, 68*b* are disposed on opposite lateral sides of central portion 66 and are attached to central portion 66 to form pump body 16. Motor 22 is disposed within motor housing 70 between end caps 68. Control housing 72 is connected to and extends from motor housing 70. Control housing 72 is configured to house control elements of pump 10, such as controller 26 (FIGS. 1C and 19). Stator 28 surrounds rotor 30 and drives rotation of rotor 30. Rotor 30 rotates about pump axis PA-PA and is disposed coaxially with drive mechanism 24 and fluid displacement members 20. Permanent magnet array 86 is disposed on rotor body 88. Fluid covers 18*a*, 18*b* are connected to end caps 68*a*, 68*b*, respectively.

Drive mechanism 24 receives a rotational output from rotor 30 and converts that rotational output into a linear input to fluid displacement members 20. Motor 22 directly drives reciprocation of fluid displacement members 20 via drive mechanism 24 without any intermediate gearing. Drive nut 90 is connected to rotor body 88 to rotate with rotor 30. Screw 92 is elongate along pump axis PA-PA and extends through drive nut 90 coaxially with rotor 30.

Rolling elements 98 are disposed between rotor 30 and screw 92. More specifically, rolling elements 98 are disposed between drive nut 90 and screw 92. Rolling elements 98 are disposed in raceways formed by opposing nut thread 102 and screw thread 110. Rolling elements 98 engage screw thread 110 to drive linear displacement of screw 92 along pump axis PA-PA. Rolling elements 98 can be balls or rollers among other options and as discussed in more detail below. Rolling elements 98 are disposed circumferentially about screw 92 and evenly arrayed around screw 92. Rolling elements 98 are arrayed around, and are arrayed along, an axis that is coaxial with axis PA-PA. Rolling elements 98 separate drive nut 90 and screw 92 such that drive nut does not directly contact screw 92. Instead, both drive nut 90 and screw 92 ride on rolling elements 98. Rolling elements 98 maintain gap 99 (FIG. 12) between drive nut 90 and screw 92 to prevent contact therebetween.

First bore 112 extends into screw body 108 from first screw end 104. First bore 112 is elongate along pump axis PA-PA. First bore 112 is coaxial with pump axis PA-PA. Second bore 114 extends into screw body 108 from second screw end 106. Second bore 114 is elongate along pump axis PA-PA. First diameter portion 118 of second bore 114 extends into screw body 108 from second screw end 106. Second diameter portion 120 of second bore 114 extends into screw body 108 from first diameter portion 118. In the example shown, each of first bore 112 and second bore 114 are closed such that first bore 112 and second bore 114 are fluidly isolated. In the example shown, second bore 114 has a greater length than first bore 112. In the example shown, second diameter portion 120 has a greater length than first bore 112.

Grease fitting 94 is disposed in screw body 108. Grease fitting 94 is disposed within second bore 114. More specifically, grease fitting 94 is disposed at the interface between first diameter portion 118 and second diameter portion 120. Grease fitting 94 is secured to screw body 108. Grease fitting 94 can be secured within second diameter portion 120 and a portion of grease fitting 94 can extend into first diameter portion 118. Grease fitting 94 can be a grease zerk, among other options. Second diameter portion 120 can act as a lubricant reservoir.

Third bore 116 extends from second bore 114 to an outer surface of screw body 108. Third bore 116 extends from second bore 114 to an outlet on the outer surface of screw body 108. The outlet of third bore 116 can be disposed on a portion of screw body 108 intermediate screw thread 110. Third bore 116 can provide lubricant at a point of least clearance between drive nut 90 and screw body 108. Third bore 116 can be elongate along an axis transverse to pump axis PA-PA. In some examples, third bore 116 extends orthogonal to pump axis PA-PA.

First diameter portion 118 of second bore 114 is sized to receive an applicator of a grease gun. The applicator connects to grease fitting 94 to supply lubricant to the rolling elements 98 between drive nut 90 and screw 92 via second bore 114 and third bore 116. Drive mechanism 24 does not require disassembly to access and lubricate rolling elements 98. In some examples, a lubricant drive mechanism can be disposed in second bore 114. The lubricant drive mechanism can physically interface with lubricant in second diameter portion 120 to exert pressure on the lubricant and drive the lubricant through third bore 116. For example, a feed tube can extend from grease fitting 94 and a follower plate can be disposed about the feed tube. A spring can drive the follower plate towards third bore 116. A stop can be disposed in second diameter portion 120 to prevent the follower plate from passing over third bore 116. In other examples, third bore 116 can be disposed closer to grease fitting 94 and a plate and spring can be disposed on an opposite side of third bore 116 from grease fitting 94.

Bearings 54*a*, 54*b* are disposed at opposite axial ends of rotor 30. Bearings 54 are configured to support both axial and radial forces. In some examples, bearings 54 are tapered roller bearings. Bearing 54*a* is disposed at a first end of rotor 30 about drive nut 90. Inner race 122*a* of bearing 54*a* is disposed on and connected to drive nut 90. Inner race 122*a* interfaces with drive nut notch 100*a* formed on drive nut 90. Drive nut notch 100*a* is an annular notch formed on an exterior of drive nut 90 at the first axial end of drive nut 90. Drive nut notch 100*a* interfaces both axially and radially with inner race 122*a*. Outer race 124*a* of bearing 54*a* interfaces with motor nut notch 126 formed in motor nut 56. Outer race 124*a* interfaces both axially and radially with motor nut notch 126. An array of rollers 123*a* is disposed between inner race 122*a* and outer race 124*a*. Each roller 123*a* can be oriented along an axis of the roller 123*a* such that the axis of the roller 123*a* is neither parallel nor orthogonal to the axis of reciprocation of the screw 92. In some examples, the rollers 123*a* can be oriented such that the axes of the rollers 123*a* extended through or converge at point aligned on the pump axis PA. At least a portion of bearing 54*a* can be disposed directly radially inside of rotor 30. In the example shown, bearing 54*a* and permanent magnet array 86 axially overlap. As such, a radial line extending from pump axis PA can pass through both bearing 54*a* and permanent magnet array 86. In the example shown, at least a portion of each of inner race 122*a*, outer race 124*a*, and rollers 123*a* axially overlaps with permanent magnet array 86.

Bearing 54*b* is disposed at a second axial end of rotor 30 about drive nut 90. Inner race 122*b* of bearing 54*b* is disposed on and connected to drive nut 90. Inner race 122*b* interfaces with drive nut notch 100*b* formed on drive nut 90*b*. Drive nut notch 100*b* is an annular notch formed on an exterior of drive nut 90 at the second axial end of drive nut 90. Drive nut notch 100*b* interfaces both axially and radially with inner race 122*a*. Outer race 124*b* of bearing 54*b* interfaces with end cap 68*b* both axially and radially. Outer race 124*b* interfaces both axially and radially with cap notch 134 formed in end cap 68*b*. An array of rollers 123*b* is disposed between inner race 122*b* and outer race 124*b*. Each roller 123*b* can be oriented along an axis of the roller 123*b* such that the axis of the roller 123*b* is neither parallel nor orthogonal to the axis of reciprocation of the screw 92. In some examples, the rollers 123*b* can be oriented such that the axes of the rollers 123*b* extended through or converge at point aligned on the pump axis PA. At least a portion of bearing 54*b* can be disposed directly radially inside of rotor 30. In the example shown, bearing 54*b* and permanent magnet array 86 axially overlap. As such, a radial line extending from pump axis PA can pass through both bearing 54*b* and permanent magnet array 86. In the example shown, at least a portion of each of inner race 122*b*, outer race 124*b*, and rollers 123*b* axially overlaps with permanent magnet array 86.

Motor nut 56 is connected to pump body 16. Motor nut 56 covers at least a portion of an axial end of motor 22. In the example shown, motor nut 56 is connected to end cap 68*a*. In the example shown, outer edge 128 interfaces with end cap 68*a* to secure motor nut 56 to pump body 16. Motor nut 56 and end cap 68*a* can be connected by interfaced threading, among other options. In the example shown, a diameter D1 of motor nut 56 at outer edge 128 is larger than a diameter D2 of rotor 30. As such, motor nut 56 can fully cover an axial end of rotor 30 and partially cover an axial end of stator 28. Motor nut 56 fully radially overlaps with rotor 30 and partially radially overlaps with stator 28. In the example shown, a diameter D3 of central aperture 144 (FIGS. 15A and 15B) of motor nut 56 is larger than a diameter D4 of drive nut 90.

Motor nut 56 preloads bearings 54 and axially aligns rotor 30. Motor nut 56 threads into end cap 68*a* and interfaces with bearing 54*a*. Motor nut 56 clamps bearings 54 and rotor 30 between end cap 68*b* and motor nut 56. Motor nut 56 removes play in bearings 54. Motor nut 56 aligns bearings 54 and rotor 30 axially on pump axis PA-PA by threading into end cap 68*a*. The threaded interface aligns motor nut 56 on pump axis PA-PA. Motor nut 56 aligns rotor 30 relative to stator 28 to maintain an air gap between rotor 30 and stator 28 and to prevent undesired contact between rotor 30 and stator 28.

Grease cap 60*a* is supported by motor nut 56 and encloses an end of bearing 54*a* facing fluid displacement member 20*a*. Grease cap 60*a* being attached to motor nut 56 ensures that grease cap 60*a* is properly positioned relative to and aligned with bearing 54*a*. In the example shown, a plate of grease cap 60*a* is disposed between motor nut 56 and bearing 54*a* and a support is disposed on an opposite side of motor nut 56 and has prongs extending to and supporting the plate. In some examples, the prongs can snap lock onto motor nut 56 to connect grease cap 60*a* to motor nut 56. Grease cap 60*b* is substantially similar to grease cap 60*a*. Grease cap 60*b* is connected to pump body 16 and encloses an end of bearing 54*b* facing fluid displacement member 20*b*. More specifically, grease cap 60*b* is connected to end cap 68*b*. Grease caps 60 prevent contaminants, such as dirt or moisture, from entering bearings 54 and capture grease that may liquify during operation.

Fluid displacement members 20*a*, 20*b* are connected to opposite ends 104, 106 of screw 92. In the example shown, fluid displacement members 20 are flexible and include a variable surface area during pumping. More specifically, fluid displacement members 20 are diaphragms, including diaphragm plates 78, 80 and membranes 82. The membranes 82 can be formed from flexible material, such as rubber or other type of polymer. It is understood, however, that fluid displacement members 20 can be of other configurations, such as pistons.

In the example shown, fluid displacement member 20*a* includes inner plate 78*a* and outer plate 80*a* disposed on opposite sides of membrane 82*a*. A portion of membrane 82*a* is captured between the opposed diaphragm plates 78*a*, 80*a*. Fluid displacement member 20*a* is attached to first screw end 104 of screw 92. Fastener 84*a* extends from fluid displacement member 20*a* into screw 92 to secure fluid displacement member 20*a* to screw 92. Fastener 84*a* extends through each outer plate 80*a*, membrane 82*a*, and inner plate 78*a* and into first bore 112 to connect fluid displacement member 20*a* to drive mechanism 24. Fastener 84*a* engages within first bore 112 to secure fluid displacement member 20*a* to screw 92. For example, the fastener 84*a* and first bore 112 can include interfaced threading, among other options.

In the example shown, fluid displacement member 20*b* is similar to fluid displacement member 20*a*. A portion of membrane 82*b* is captured between the opposed diaphragm plates 78*b*, 80*b*. Outer plate 80*b* is overmolded by membrane 82*b* such that that outer plate 80*b* is disposed within membrane 82*b*. Fastener 84*b* extends from fluid displacement member 20*b* and into screw 92 to connect fluid displacement member 20*b* to drive mechanism 24. Fastener 84*b* extends from outer plate 80*b*, through inner plate 78*b*, and into second bore 114 to connect fluid displacement member 20*b* to drive mechanism 24. Fastener 84*b* engages within second bore 114 to secure fluid displacement member 20*b* to screw 92. For example, fastener 84*b* and second bore 114 can include interfaced threading, among other options. In the example shown, fastener 84*b* extends into and engages with first diameter portion 118 of second bore 114. Fastener 84*b* does not extend into second diameter portion 120 in the example shown.

Drive nut 90 and rolling elements 98 exert a rotational force on screw 92 while driving screw 92 axially. As discussed above, bearings 54 are configured to support both axial and radial forces. Screw 92 is connected to fluid displacement members 20 such that fluid displacement members 20 prevent screw 92 from rotating about pump axis PA-PA. Fluid displacement members 20 interface with pump body 16 to prevent rotation of fluid displacement members 20 and screw 92 relative to pump axis PA-PA.

First screw end 104 of screw 92 interfaces with fluid displacement member 20*a* to prevent screw 92 from rotating relative to fluid displacement member 20*a*. In the example shown, first screw end 104 interfaces with inner plate 78*a* to prevent screw 92 from rotating relative to inner plate 78*a*. In some examples, first screw end 104 and inner plate 78*a* include mating faces configured to interface to prevent relative rotation.

Outer edge 128*a* of membrane 82*a* is secured between fluid cover 18*a* and pump body 16 to provide a fluid-tight seal between wet and dry sides of fluid displacement member 20*a*. Fluid cover 18*a* and fluid displacement member 20*a* at least partially define process fluid chamber 34*a*. Fluid displacement member 20*a* and pump body 16 at least partially define cooling chamber 44*a*. Outer edge 128*a* is clamped such that fluid displacement member 20*a* does not rotate about pump axis PA-PA. Outer edge 128*a* does not rotate about pump axis PA-PA. In the example shown, outer edge 128*a* does not shift axially relative pump axis PA-PA. Outer edge 128*a* includes bead 136 seated within groove 138 formed by opposing trenches of fluid cover 18*a* and end cap 68*a*. Bead 136 has an enlarged cross-sectional area as compared to a portion of membrane 82*a* adjacent bead 136.

The wet side of fluid displacement member 20*a* is oriented towards fluid cover 18*a* and at least partially defines process fluid chamber 34*a*. Outer plate 80*a* and a portion of fastener 84*a* are exposed to the process fluid in process fluid chamber 34*a*. The dry side of fluid displacement member 20*a* is oriented towards motor 22 and at least partially defines cooling chamber 44*a*. Inner diaphragm plate 78*a* is exposed to the cooling air in cooling chamber 44*a*. In some examples, thermally conductive components of fluid displacement members 20 are exposed to the process fluid and the cooling air to effectuate heat exchange between the fluids, thereby cooling pump 10 with the process fluid. For example, inner plate 78*a* and at least one of outer plate 80*a* and fastener 84*a* can be formed from a thermally conductive material, such as aluminum.

Second screw end 106 of screw 92 interfaces with fluid displacement member 20*b* such that screw 92 is prevented from rotating relative to fluid displacement member 20*b*. In the example shown, second screw end 106 interfaces with inner plate 78*b* to prevent screw 92 from rotating relative to inner plate 78*b*. In some examples, second screw end 106 and inner plate 78*b* include contoured surfaces configured to interface to prevent relative rotation.

Outer edge 128*b* of membrane 82*b* is secured between fluid cover 18*b* and pump body 16 to provide a fluid-tight seal between wet and dry sides of fluid displacement member 20*b*. Fluid cover 18*b* and fluid displacement member 20*b* at least partially define process fluid chamber 34*b*. Fluid displacement member 20*b* and pump body 16 at least partially define cooling chamber 44*b*. Outer edge 128*b* is clamped between end cap 68*b* and fluid cover 18*b* such that outer edge 128*b* remains static and does not rotate about pump axis PA-PA. Outer edge 128*b* includes bead 136 seated within groove 138 formed by opposing trenches formed on fluid cover 18*b* and end cap 68*b*. Bead 136 has an enlarged cross-sectional width as compared to a portion of membrane 82*b* adjacent bead 136.

The wet side of fluid displacement member 20*b* is oriented towards end cap 68*b* and at least partially defines process fluid chamber 34*b*. The dry side of fluid displacement member 20*b* is oriented towards motor 22 and at least partially defines cooling chamber 44*b*. In some examples, portions of outer plate 80*b* extend through membrane 82*b* such that those portions are exposed to the process fluid. Fluid displacement member 20*b* can thereby provide additional cooling by a conduction path between the cooling air and the process fluid through fluid displacement member 20*b*.

Air check 46 is mounted on pump body 16. Valve housing 142 is mounted on motor housing 70. Valve housing 142 supports inlet valve 48 and outlet valve 50. Inlet valve 48 controls flow of cooling air into the cooling circuit CF (best seen in FIG. 2) and outlet valve 50 controls flow of cooling air out of the cooling circuit CF. Filter 140 is disposed upstream of inlet valve 48 and is configured to remove contaminants, such as dust, from the air entering the cooling circuit CF. Valve housing 142 is contoured and oriented to direct the flow of cooling air over heat sinks 74 of pump body 16, as shown by arrows E in FIG. 4B. In some examples, valve housing 142 is configured such that the intake flow of cooling air flows over heat sinks 74 to enter valve housing 142. In some examples, valve housing 142 is configured such that the exhaust flow of cooling air flows over heat sinks 74 when exiting valve housing 142. In some examples, both the intake and exhaust flows are directed over heat sinks 74.

First cooling passage 36 is formed in pump body 16. In the example shown, first cooling passage 36 extends through motor housing 70 and end cap 68*a*. First cooling passage 36 extends between air check 46 and cooling chamber 44*a*.

Second cooling passage 38 is formed in pump body 16. In the example shown, second cooling passage 38 extends through end cap 68*a*, through central portion 66 and specifically stator passages 76, and through end cap 68*b*. Second cooling passage 38 includes outer portions extending through end caps 68 and inner portions defined by stator passages 76. Second cooling passage 38 includes different numbers of inner portions and outer portions. For example, each the outer portions of second cooling passage 38 can be formed by single bores through each end cap 68 while the inner portions are formed by multiple stator passages 76. Each end cap 68 can include recesses providing fluid communication between the inlet/outlet bores through end caps 68 and stator passages 76. Second cooling passage 38 can have a larger flow area through the inner portions than through the outer portions. The enlarged flow area of the inner portions relative to the outer portions decelerates airflow through stator pathways, enhancing heat exchange.

Third cooling passage 40 extends between cooling chamber 44*a* and cooling chamber 44*b*. In the example shown, third cooling passage 40 extend through motor nut 56, rotor 30, and end cap 68*b*. More specifically, third cooling passage 40 is formed by cooling ports 130 in motor nut 56, rotor bores 96 in rotor 30, and cap bores 132 in end cap 68*b*. A portion of third cooling passage 40 thus extends through a rotating component of pump 10. Rotor bores 96 form the rotating portion of third cooling passage 40. A non-rotating portion of third cooling passage 40 can be formed by pump body 16. Third cooling passage 40 can include more rotating bores than static bores. For example, rotor body 88 can include more rotor bores 96 than motor nut 56 has cooling ports 130. Third cooling passage 40 can have a greater cross-sectional flow area through the rotating bores than through the static bores disposed at one or both axial ends of third cooling passage 40. The increased cross-sectional area decelerates the cooling airflow through rotor bores 96, enhancing heat exchange.

During operation, electric current is provided to stator 28 to drive rotation of rotor 30. Drive nut 90 is connected to rotor body 88 and rotates with rotor 30. Rolling elements 98 drive screw 92 linearly along pump axis PA-PA. Axial pump reaction forces are generated during pumping and experienced along pump axis PA-PA. The pump reaction forces are initially experienced by fluid displacement members 20 and transferred to screw 92. The pump reaction forces flow through screw to rolling elements 98 and from rolling elements 98 to drive nut 90. The axial forces experienced by drive nut 90 are transferred to bearings 54 and from bearings 54 to pump body 16. In the example shown, the axial forces experienced by drive nut 90 and transferred through bearings 54*a*, 54*b* to end caps 68*a*, 68*b*, respectively, and from end caps 68*a*, 68*b* to other components forming pump body 16. Bearings 54 transfer the axial forces to pump housing 16 to isolate motor 22 from the pump reaction forces. The pump reaction forces experienced by fluid displacement members 20 oppose each other during each stroke as one fluid displacement member 20 is pumping while the other fluid displacement member 20 is in suction.

If screw 92 is initially driven in first axial direction AD1 in FIG. 4A, then screw 92 pulls fluid displacement member 20*b* through a suction stroke and pushes fluid displacement member 20*a* through a pumping stroke for the process fluid. After reaching the end of the first stroke, rotor 30 is driven in an opposite rotational direction such that screw 92 is driven in second axial direction AD2, in the opposite linear direction from the first stroke. When screw 92 is driven in direction AD2, screw 92 pulls fluid displacement member 20*a* through a suction stroke and pushes fluid displacement member 20*b* through a pumping stroke for the process fluid. During a suction stroke, the volume of process fluid chamber 34 increases and process fluid is drawn into process fluid chamber 34 from inlet manifold 12. During the pumping stroke, the volume of process fluid chamber 34 decreases and fluid displacement member 20 drives the process fluid downstream out of process fluid chamber 34 to outlet manifold 14.

Fluid displacement members 20 pump cooling air through the cooling circuit CF (best seen in FIG. 2) of pump 10 simultaneously with pumping the process fluid. As screw 92 is driven in direction AD1, the volume of cooling chamber 44*a* expands and air is drawn into cooling chamber 44*a* through inlet valve 48 and first cooling passage 36. As such, fluid displacement member 20*a* proceeds through a suction stroke for the cooling air while simultaneously proceeding through a pumping stroke for the process fluid. The volume of cooling chamber 44*b* decreases as fluid displacement member 20*b* is pulled in direction AD1. Fluid displacement member 20*b* drives cooling air from cooling chamber 44*b* through fourth cooling passage 42 and out from pump 10 through outlet valve 50. As such, fluid displacement member 20*b* proceeds through a pumping stroke for the cooling air while simultaneously proceeding through a suction stroke for the process fluid.

Valve housing 142 directs the flow of cooling air entering and/or exiting the cooling circuit. Valve housing 142 directs the flow over heat sinks 74 formed on pump body 16. The cooling air flowing over heat sinks 74 enhances heat transfer from pump body 16.

As screw 92 is driven in the second axial direction AD2, the volume of cooling chamber 44*a* decreases and the volume of cooling chamber 44*b* increases. Fluid displacement member 20*a* drives the cooling air from cooling chamber 44*a* to cooling chamber 44*b* through second cooling passage 38 and third cooling passage 40. Fluid displacement member 20*b* draws the cooling air from cooling chamber 44*a* to cooling chamber 44*b* through second cooling passage 38 and third cooling passage 40. The flow of cooling air causes each of inlet valve 48 and outlet valve 50 to shift to respective closed positions and internal valve 52 to shift to an open position, directing unidirectional flow of the cooling air through the cooling circuit CF.

Fluid displacement members 20 are configured to simultaneously pump cooling air and process fluid with opposite axial sides of each fluid displacement member 20 interfacing with the respective pumped fluids. The dry side interfaces with the cooling air and the wet side interfaces with the process fluid. Fluid displacement members 20 are simultaneously driven through both pumping and suction strokes for the two fluids being pumped by that fluid displacement member 20. As such, fluid displacement members 20 is driven through a suction stroke for the process fluid while being driven through a pumping stroke for the cooling air, and fluid displacement members 20 is driven through a suction stroke for the cooling air while being driven through a pumping stroke for the process fluid.

Pump 10 provides significant advantages. Bearings 54 support both axial and radial loads, facilitating coaxial mounting of motor 22 and fluid displacement member 20. In addition, drive mechanism 24 experiences both radial loads and axial loads during pumping. As such, bearings 54 further facilitate the use of drive mechanism 24. Motor nut 56 preloads bearings 54 and aligns rotor 30 relative to stator 28. Motor nut 56 ensures proper alignment of rotating components, thereby preventing unintended contact and increasing the useful life. Motor nut 56 further supports grease cap 60*a* for bearing 54*a*, reducing part count and ensuring proper alignment between grease cap 60*a* and bearing 54*a*, which prevents premature failure that can occur due to lubricant leakage.

Screw 92 is prevented from rotating about pump axis PA-PA. In the embodiment illustrated, screw 92 is prevented from rotating about pump axis PA-PA by fluid displacement members 20. Screw 92 interfaces with fluid displacement members 20 such that screw 92 is prevented from rotating relative to fluid displacement members 20. Fluid displacement members 20 interface with pump body 16 to prevent rotation of fluid displacement members about pump axis PA-PA, thereby preventing rotation of screw 92. Preventing rotation of screw 92 maintains the connection between screw 92 and fluid displacement members 20 throughout operation, preventing undesired loosening between screw 92 and fluid displacement members 20. Preventing screw 92 from rotating about pump axis PA-PA causes screw 92 to displace linearly as drive nut 90 rotates, facilitating pumping by pump 10.

Grease fitting 94 is disposed in screw 92. Grease fitting 94 facilitates quick and simple lubricant application to rolling elements 98. To provide lubricant, the user can remove fluid cover 18*b* from pump body 16 and disconnect fluid displacement member 20*b* from screw 92. Detaching fluid displacement member 20*b* provides access to second bore 114. The user can insert the applicator of a grease gun into second bore 114 and connect the applicator to grease fitting 94 to supply lubricant. The lubricant flows through second diameter portion 120 and third bore 116 to the gap between drive nut 90 and screw 92. As such, the user is not required to fully disassembly pump 10 to access drive mechanism 24 for lubrication. In addition, the user is not required to disassemble drive mechanism 24 to access rolling elements 98 for lubrication, simplifying the lubrication process and preventing the need to access multiple loose and small components, which can be easily lost.

Fluid displacement members 20 pump both cooling air and process fluid. The cooling air circulates through pump 10 along a unidirectional cooling circuit CF. Pumping cooling air with fluid displacement members 20 that also pump the process fluid reduces part count by eliminating additional components with additional moving parts, such as pumps or fans, for driving the cooling air. Fluid displacement members 20 being disposed in series provides efficient flow through cooling flowpath CF. Second cooling passage 38 and third cooling passage 40 are positioned to absorb heat from the main heat generating components of pump 10, including controller 26, stator 28, and drive mechanism 24. At least a portion of second cooling passage 38 is positioned intermediate stator 28 and controller 26 to absorb heat from both sources, increasing cooling efficiency. In addition, at least one of the exhaust and intake flows can be directed over heat sinks 74 to further cool stator 28. Air check 46 and internal valve 52 facilitate unidirectional flow to ensure a flow of fresh cooling air through the cooling circuit CF.

Figure 5A:
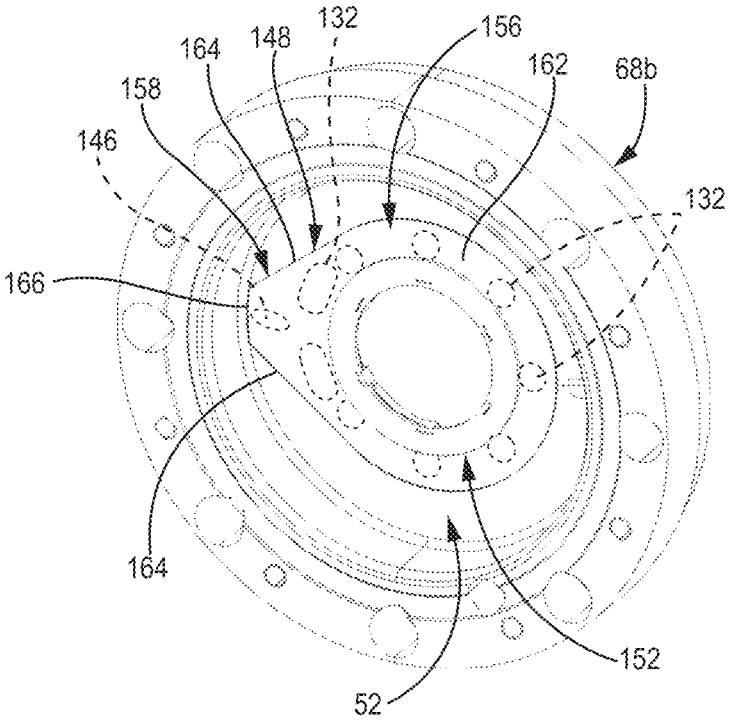
FIG. 5A is an isometric view of an internal check valve and end cap.
Figure 5B:
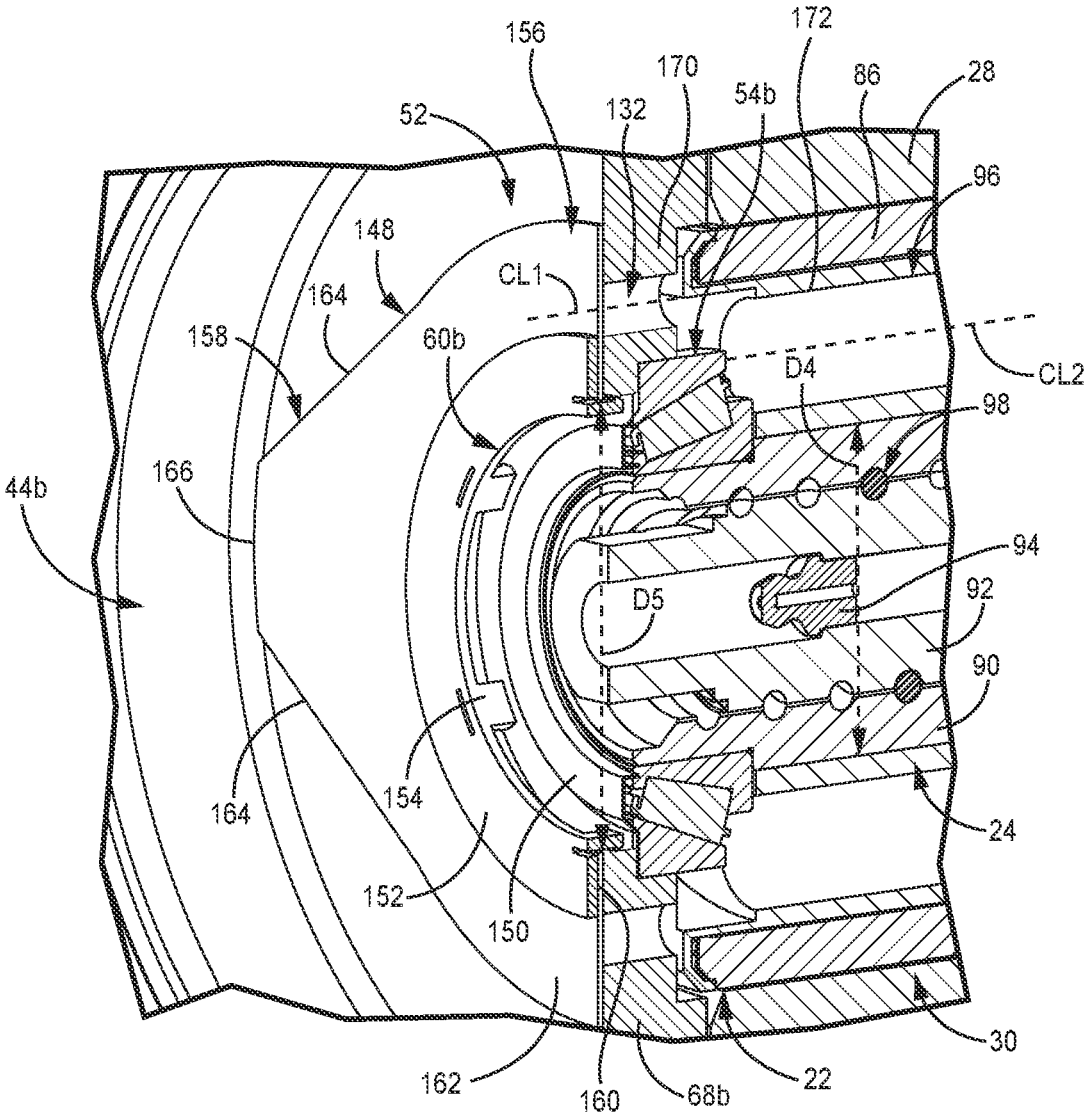
FIG. 5B is an enlarged cross-sectional view of a portion of an electrically operated pump.

FIG. 5A is an isometric view showing internal valve 52 mounted on end cap 68*b*. FIG. 5B is an enlarged cross-sectional view of a portion of pump 10 showing internal valve 52. FIGS. 5A and 5B will be discussed together. FIG. 5A shows internal valve 52, end cap 68*b*, cap bores 132, cap bores 146, valve member 148, support 152, member body 156, projection 158, outer portion 162, tapered edges 164, and end 166. FIG. 5B also shows internal valve 52, end cap 68*b*, cap bores 132, valve member 148, support 152, member body 156, projection 158, outer portion 162, tapered edges 164, and end 166, and in addition shows motor 22, drive mechanism 24, rotor 30, cooling chamber 44*b*, bearing 54*b*, grease cap 60*b*, end cap 68*b*, permanent magnet array 86, grease fitting 94, rotor bores 96, rolling elements 98, plate 150, prongs 154, inner portion 160, radially inner edge 168, radially outer edge 170, and radially outer edge 172.

Cap bores 146 extend through end cap 68*b* and form outlets for second cooling passage 38. Cap bores 132 extend through end cap 68*b* and are outlets for third cooling passage 40. Cap bores 132 can all be of the same configuration or can be of varying configurations.

Cap bores 132 are disposed radially outside of bearing 54*b*. Cap bores 132 are disposed radially outside of rotor bores 96 relative to pump axis PA-PA. For example, a centerline CL1 of cap bores 132 can be radially outside of a centerline CL2 of rotor bores 96, a radially inner edge 168 of cap bores 132 can be radially outside of the centerline CL2 of rotor bores 96, a radially outer edge 170 of cap bores 132 can be radially outside of a radially outer edge 172 of rotor bores 96, the centerline CL1 of cap bores 132 can be radially outside of the radially outer edge 172 of rotor bores 96, and/or the radially inner edge 168 of cap bores 132 can be radially outside of a radially outer edge 172 of rotor bores 96. Cap bores 132 can at least partially overlap radially with permanent magnet array 86.

Internal valve 52 is mounted on end cap 68*b* and controls flow into cooling chamber 44*b* from second cooling passage 38 and third cooling passage 40. In the example shown, internal valve 52 is a flapper valve having flapper valve member 148. Valve member 148 is a flexible member configured to flex between an open state, allowing flow into cooling chamber 44*b*, and a closed state, preventing retrograde flow to second cooling passage 38 and third cooling passage 40 from cooling chamber 44*b*. Valve member 148 seals against end cap 68*b* in the closed state.

Grease cap 60*b* is disposed adjacent bearing 54*b*. Plate 150 of grease cap 60*b* is adjacent bearing 54*b*, protects bearing 54*b* from contamination, and captures any grease that liquifies during operation. Support 152 of grease cap 60*b* is disposed on the opposite side of end cap 68*b* from bearing 54*b*. In some examples, fasteners (not shown) extend into end cap 68 and support 152 to secure grease cap 60*b* to end cap 68*b*. In some examples, prongs 154 extend from support 152 and interface with plate 150 to hold plate 150 relative bearing 54*b*. In some examples, prongs 154 snap lock onto a portion of end cap 68*b*. A portion of valve member 148 is disposed between support 152 and end cap 68*b* such that valve member 148 is connected to end cap 68*b* by grease cap 60*b*. It is understood, however, that valve member 148 can be secured within pump 10 in any manner suitable for facilitating unidirectional flow of cooling air.

Valve member 148 includes member body 156 and projection 158. Member body 156 and projection 158 function as a single part and can be integrally formed as a single part. Member body 156 is secured to end cap 68 by grease cap 60*b*. Member body 156 forms a body of valve member 148. Member body 156 is an annular ring extending about a central aperture in end cap 68*b*. Screw 92 of drive mechanism 24 reciprocates through a central opening of member body 156. In the example shown, the inner diameter D5 of member body 156 is larger than diameter D4 of drive nut 90.

Inner portion 160 of member body 156 interfaces with support 152 of grease cap 60*b*. Inner portion 160 is clamped between support 152 and end cap 68*b*. Outer portion 162 does not interface with an axial face of support 152. Outer portion 162 extends radially from inner portion and covers cap bores 132. Outer portion 162 interfaces with end cap 68*b* to seal cap bores 132. Member body 156 flexes to open the flowpaths through cap bores 132 in response to cooling air being pumped from cooling chamber 44*a* to cooling chamber 44*b*. More specifically, outer portion 162 flexes away from end cap 68*b* to open the flowpaths.

Projection 158 extends from member body 156 and covers cap bores 146. Second portion includes tapered edges 164 reducing a width of projection 158 between member body 156 and end 166 of projection 158. End 166 extends between and connects tapered edges 164. End 166 can be of any desired profile between tapered edges, such as flat, curved, pointed, etc. Projection 158 interfaces with end cap 68*b* to seal flowpaths through cap bores 146. Projection 158 flexes away from end cap 68*b* to open the flowpaths through cap bores 146.

While internal valve 52 is described as having a flapper valve member 148, it is understood that internal valve 52 can be of any desired configuration for facilitating unidirectional flow. For example, internal valve 52 can include one or more of ball valves, diaphragm valves, swing valves, or any other one-way valve. In some examples, internal valve 52 includes the same number of valve members as there are bores 132, 146. For example, a valve element can be disposed in each one of bores 132, 146 to facilitate unidirectional flow of the cooling air. In some examples, internal valve 52 includes fewer valve elements than there are outlet bores 132, 146.

During operation, cooling air is pumped through second cooling passage 38 (FIG. 2) and third cooling passage 40 (FIG. 2) to cooling chamber 44*b*. Valve member 148 extends over both cap bores 146 and cap bores 132 to control flow through second cooling passage 38 and third cooling passage 40. Valve member 148 lifts off of end cap 68*b* to shift to an open state and allow cooling air flow into cooling chamber 44. In some examples, a 360-degree portion of outer portion 162 of valve member 148 lifts off of end cap 68*b* to expose the full circumferential array of cap bores 132. After pumping the cooling air to cooling chamber 44*b*, fluid displacement members 20 reverse stroke direction. The increase in pressure in cooling chamber 44*b* and suction in cooling chamber 44*a* drive valve member 148 back to the closed state. The structural configuration of valve member 148 also biases valve member 148 towards the closed state. As such, internal valve 52 can be a normally closed valve.

Internal valve 52 provides significant advantages. Internal valve 52 prevents retrograde flow from cooling chamber 44*b* to cooling chamber 44*a*. Internal valve 52 thereby ensures continuous circulation of fresh cooling air, providing more efficient cooling. Internal valve 52 being a single piece valve controlling flow through both second cooling passage 38 and third cooling passage 40 provides for simpler assembly, reduces part count, simplifies operation, and decreases costs. Valve member 148 is secured by grease cap 60*b*, further decreasing part by providing a dual function for grease cap 60*b*.

Figure 6B:
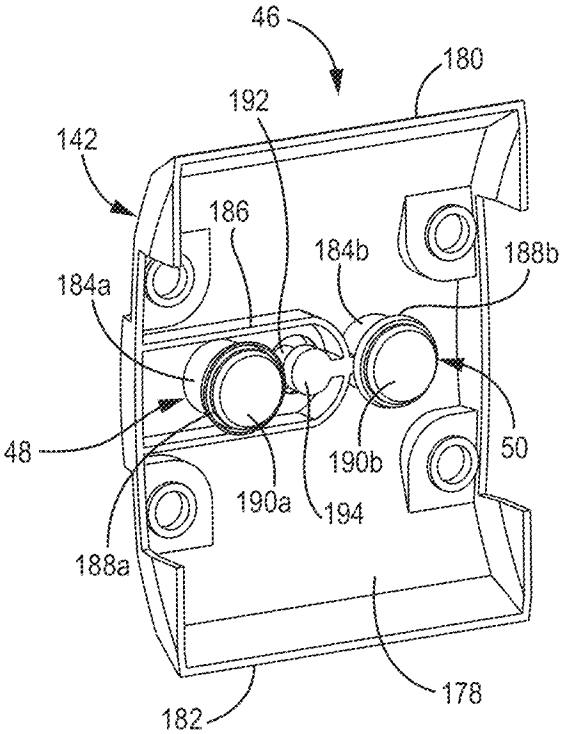
FIG. 6B is an isometric view of an inner side of the air check assembly.
Figure 6A:
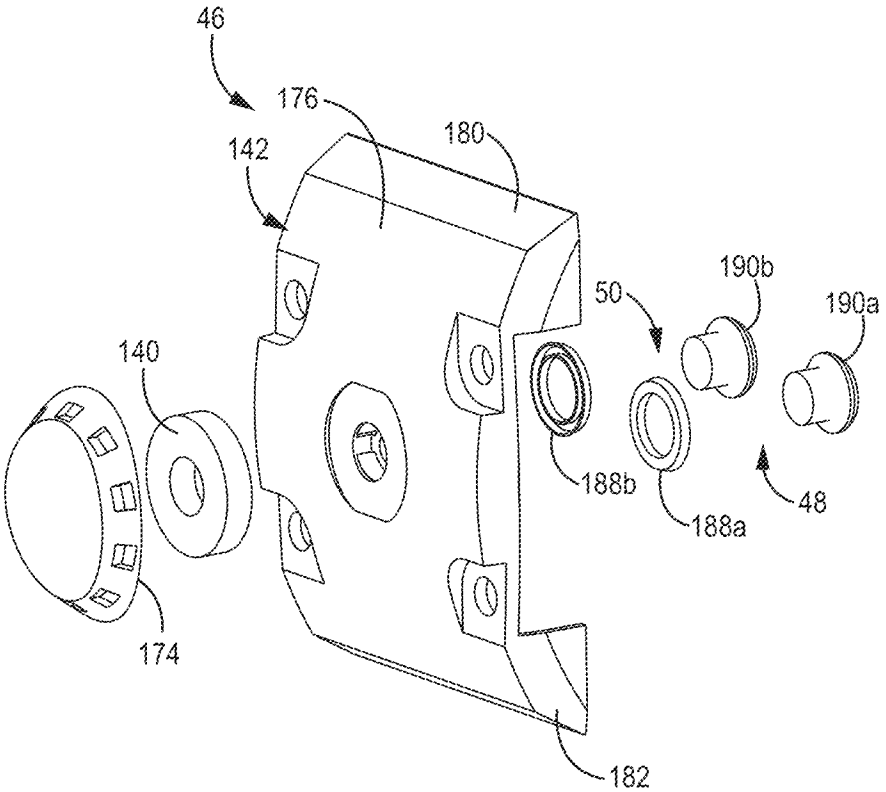
FIG. 6A is an exploded view of an air check assembly.
Figure 6C:
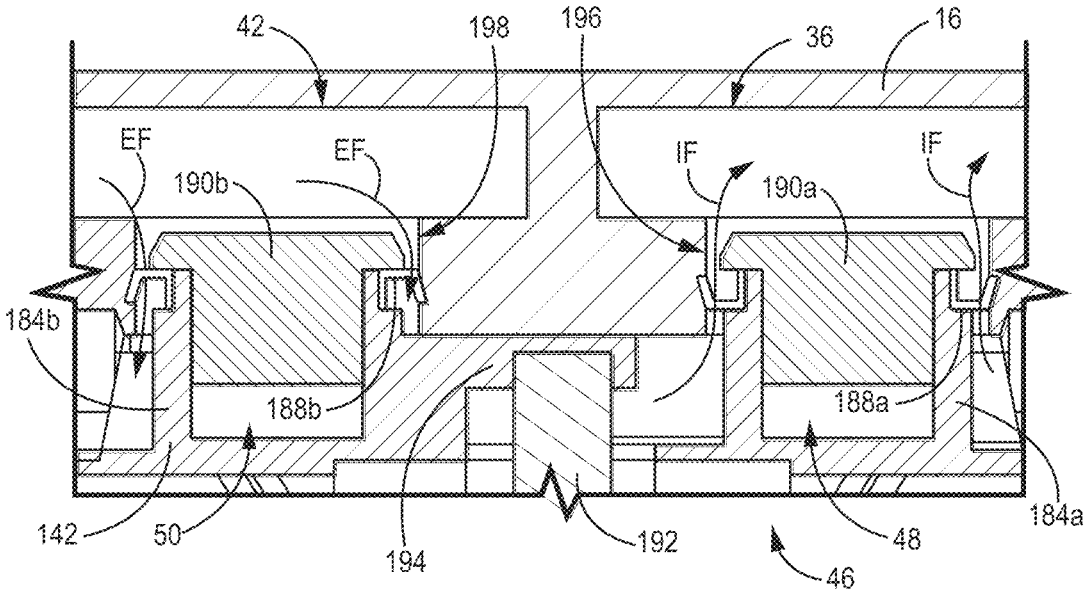
FIG. 6C is an enlarged cross-sectional view of the air check assembly mounted to a pump.

FIG. 6A is an exploded view of air check 46. FIG. 6B is a rear isometric view of air check 46. FIG. 6C is an enlarged cross-sectional view showing air check 46 mounted on pump body 16. FIGS. 6A-6C will be discussed together. Air check 46 includes inlet valve 48, outlet valve 50, filter 140, valve housing 142, and air cap 174. Valve housing 142 includes outer side 176, inner side 178, upper end 180, lower end 182, mounting cylinders 184*a*, 184*b* (collectively herein "mounting cylinders 184"), and wall 186. Inlet valve 48 and outlet valve 50 respectively include valve members 188*a*, 188*b* and retaining members 190*a*, 190*b*.

Air check 46 is mounted to pump body 16 and is configured to control airflow into and out of cooling circuit CF (FIG. 2). In some examples, valve housing 142 is disposed on and connected to motor housing 70. In some examples, valve housing 142 is disposed axially between end caps 68*a*, 68*b* (best seen in FIGS. 4A, 4B and 4D). Valve housing 142 can be connected to motor housing 70 by fasteners extending through valve housing 142 into motor housing 70. Upper end 180 and lower end 182 of valve housing 142 are contoured to direct a flow of cooling air over heat sinks 74 (best seen in FIG. 3A) formed on pump body 16. In some examples, upper end 180 and lower end 182 are contoured to direct the cooling air flow generally tangentially to pump body 16.

Filter 140 is disposed on outer side 176 of valve housing 142. Filter 140 is configured to filter contaminants, such as dirt and dust, from air prior to the air entering cooling circuit CF. Air cap 174 is mounted to valve housing 142 and retains filter 140. In some examples, air cap 174 provides an adjustable restriction such that air cap 174 can be adjusted to control a volume of air flowing into cooling circuit CF. Post 192 of air cap 174 extends through filter 140 and connects with tab 194. In some examples, tab 194 extends from mounting cylinder 184*b* to secure air cap 174 to valve housing 142.

Mounting cylinders 184 are formed on inner side 178 of valve housing 142. Mounting cylinder 184*a* projects into inlet bore 196 formed in pump housing 16. Inlet bore 196 forms an inlet of cooling circuit CF. Mounting cylinder 184*b* projects into outlet bore 198 formed in pump housing 16. Outlet bore 198 forms an outlet of cooling circuit CF.

Mounting cylinders 184*a*, 184*b* receive retaining members 190*a*, 190*b* to secure inlet valve 48 and outlet valve 50 to valve housing 142. Retaining members 190 extend into mounting cylinders 184 and are configured to remain stationary relative to mounting cylinders 184 during operation. Wall 186 extends around the mounting cylinder 184 associated with inlet valve 48. Wall 186 interfaces with pump body 16 to isolate the inlet flow through inlet valve 48 from the outlet flow through outlet valve 50.

Valve member 188*a* is disposed on a shoulder of mounting cylinder 184*a* and is secured by retaining member 190*a*. A shaft of retaining member 190*a* is secured in mounting cylinder 184*a*, such as by a press-fit connection. A head of retaining member 190*a* extends over a portion of valve member 188*a* to retain valve member 188*a* on mounting cylinder 184*a*. In the example shown, valve member 188*a* includes a u-cup ring oriented with an open end facing towards pump housing 16 and away from valve housing 142. Valve member 188*a* forms a one-way seal between valve housing 142 and inlet bore 196. Valve member 188*a* is configured to allow unidirectional flow into first cooling passage 36, as shown by arrow IF in FIG. 6C.

Valve member 188*b* is disposed on a shoulder of mounting cylinder 184*b* and is secured by retaining member 190*b*. A shaft of retaining member 190*b* is secured in mounting cylinder 184*b*, such as by a press-fit connection. A head of retaining member 190*b* extends over a portion of valve member 188*b* to retain valve member 188*b* on mounting cylinder 184*b*. In the example shown, valve member 188*b* includes a u-cup ring oriented with an open end facing towards valve housing 142 and away from pump body 16. Valve member 188*b* forms a one-way seal between valve housing 142 and outlet bore 198. Valve member 188*b* is configured to allow unidirectional flow out of fourth cooling passage 42, as shown by arrow EF in FIG. 6C. The inverse orientations of valve members 188*a*, 188*b* relative each other facilitates unidirectional flow through cooling circuit CF. Valve member 188*a* allows cooling air to enter but not exit cooling circuit CF, while valve member 188*b* allows cooling air to exit but not enter cooling circuit CF.

During operation, a first stroke occurs during which a suction stroke occurs in a first cooling chamber associated with inlet valve 48 (e.g., cooling chamber 44*a* (FIGS. 2 and 4A)) and a pumping stroke occurs in a second cooling chamber associated with outlet valve 50 (e.g., cooling chamber 44*b* (FIGS. 2 and 4A)). The suction causes valve member 188*a* to flex and disengage from pump body 16, thereby opening a flowpath through inlet bore 196 between mounting cylinder 184*a* and pump body 16. An intake portion of cooling air is drawn into air check 46 through air cap 174 and filter 140. The intake portion of cooling air flows past valve member 188*a* through inlet bore 196 and into cooling circuit CF. Simultaneously, the pressure in the second cooling chamber causes valve member 188*b* to flex and disengage from pump body 16, thereby opening a flowpath through outlet bore 198 between mounting cylinder 184*b* and pump body 16. An exhaust portion of the cooling air is driven downstream through fourth cooling passage 42 and through outlet bore 198 past valve member 188*b*. The exhaust portion exits cooling circuit CF through outlet bore 198. The exhaust portion exits outlet bore 198 and is disposed between valve housing 142 and pump body 16. The exhaust portion is driven towards upper end 180 and lower end 182 of valve housing 142. The contouring of upper end 180 and lower end 182 direct the exhaust flow over heat sinks 74 formed on pump body 16. Inlet valve 48 and outlet valve 50 are simultaneously in open states.

After completing the first stroke, a second stroke occurs during which a pumping stroke occurs in the first cooling chamber and a suction stroke occurs in the second cooling chamber. The pressure in the first cooling chamber causes valve member 188*a* to widen and engage with pump body 16 thereby closing the flowpath through inlet bore 196. Simultaneously, the suction in the second cooling chamber causes valve member 188*b* to widen and engage with pump body 16 thereby closing the flowpath through outlet bore 198. As such, each of inlet valve 48 and outlet valve 50 are simultaneously in closed states.

While inlet valve 48 and outlet valve 50 are described as respectively including valve members 188*a*, 188*b* and retaining members 190*a*, 190*b*, it is understood that inlet valve 48 and outlet valve 50 can be of any desired configuration for facilitating unidirectional flow. For example, one or both of inlet valve 48 and outlet valve 50 can include ball valves, gate valves, disk valves, flapper valves, or be of any other suitable configuration.

Air check 46 provides significant advantages. Air check 46 provides unidirectional flow into and out of cooling pathway CF. Valve housing 142 directs cooling airflow over heat sinks 74 formed on pump body 16, providing additional cooling to pump 10. Inlet valve 48 and outlet valve 50 are simultaneously in the same state, either open or closed. As such, fresh cooling air is entering the cooling circuit CF as warm air is exhausted.

Figure 7:
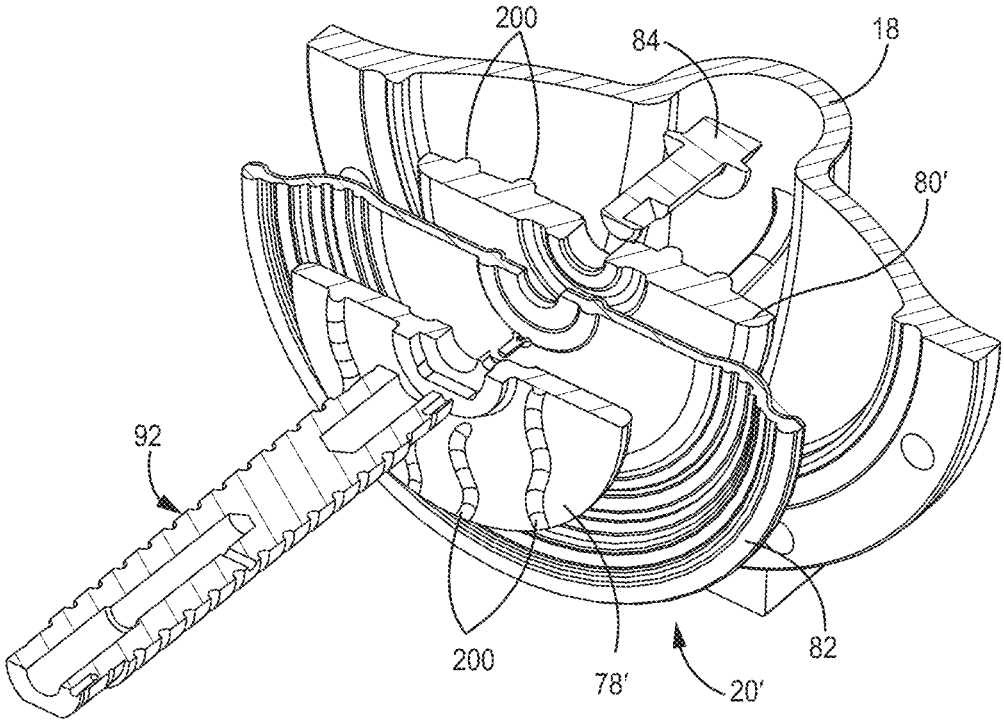
FIG. 7 is a cross-sectional exploded view of a fluid displacement member, fluid cover, and portion of a drive mechanism.

FIG. 7 is a cross-sectional view showing fluid displacement member 20'. Fluid displacement member 20' is substantially similar to fluid displacement member 20 (best seen in FIGS. 3A and 4A). Fluid displacement member 20' includes inner plate 78', outer plate 80', membrane 82, and fastener 84. Inner plate 78' and outer plate 80' each include heat sinks 200. Fluid displacement member 20' facilitates additional cooling of pump 10 during operation.

Heat sinks 200 of inner plate 78' are formed on a portion of inner plate 78' contacting the cooling air in a cooling chamber, such as cooling chambers 44*a*, 44*b* (FIGS. 2 and 4A). Heat sinks 200 of outer plate 80' are formed on a portion of outer plate 80' contacting process fluid in a process fluid chamber, such as process fluid chambers 34*a*, 34*b*. Fastener 84 extends through and is in contact with each of inner plate 78' and outer plate 80'. Each of inner plate 78', outer plate 80', and fastener 84 can be made from thermally conductive material, such as aluminum, among other options. Fluid displacement member 20 acts as a heat exchange element between the relatively cool process fluid and relatively warm cooling air. The process fluid can absorb heat generated during pumping, further cooling pump 10. Heat sinks 200 increase the surface area of the conductive surfaces exposed to the cooling air and the process fluid, providing better heat transfer efficiency. In some examples, the central aperture of membrane 82, through which fastener 84 passes, is enlarged such that portions of inner plate 78' and outer plate 80' can be in physical contact through that central aperture, increasing the conductive capacity of fluid displacement member 20.

Heat sinks 200 can be applied to any desired configuration of fluid displacement member to increase heat transfer efficiency. For example, fluid displacement member 20*b* (best seen in FIGS. 3A and 4A) includes a membrane overmolded on the portion of the outer plate that would contact the process fluid. The membrane is typically formed from a material with low thermal conductivity, such as rubber that inhibits heat transfer. Fluid displacement member 20*b* can be configured such that heat sinks extend from the outer plate and through the overmolding to be exposed to the process fluid. Fluid displacement member 20' provides significant advantages by increasing heat transfer efficiency for pump 10. In addition, fluid displacement member 20' utilizes the process fluid as a heat transfer fluid, simplifying heat transfer by utilizing a fluid already present in the system.

Figure 8A:
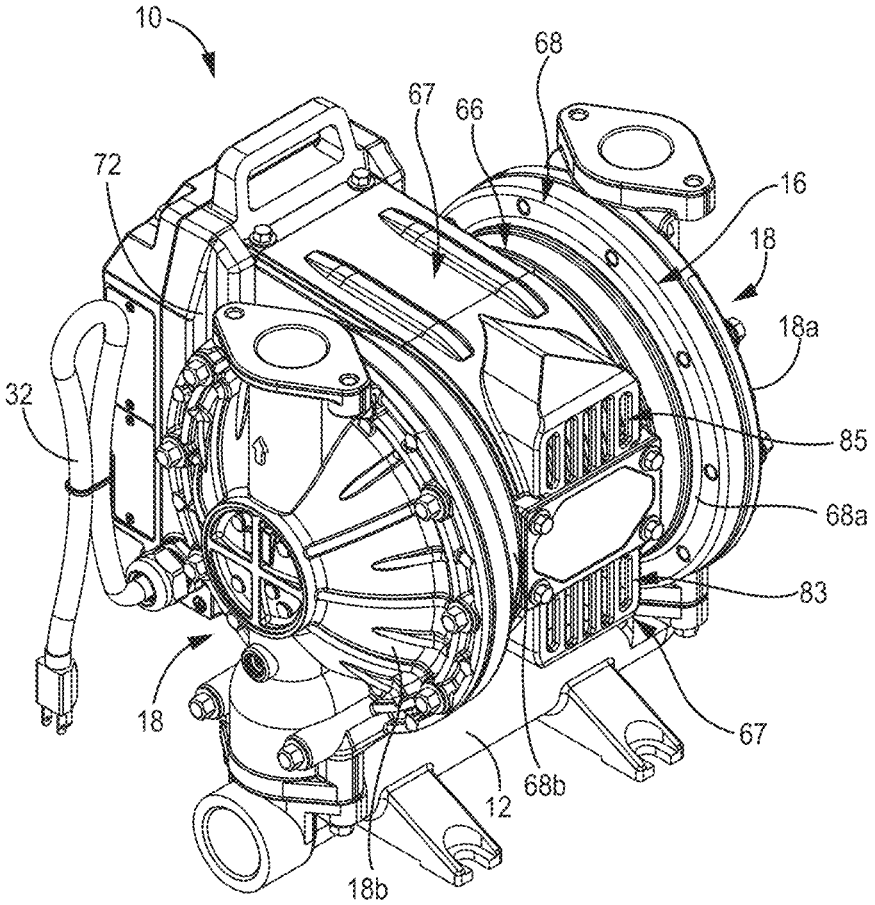
FIG. 8A is an isometric view of an electrically operated pump.
Figure 8B:
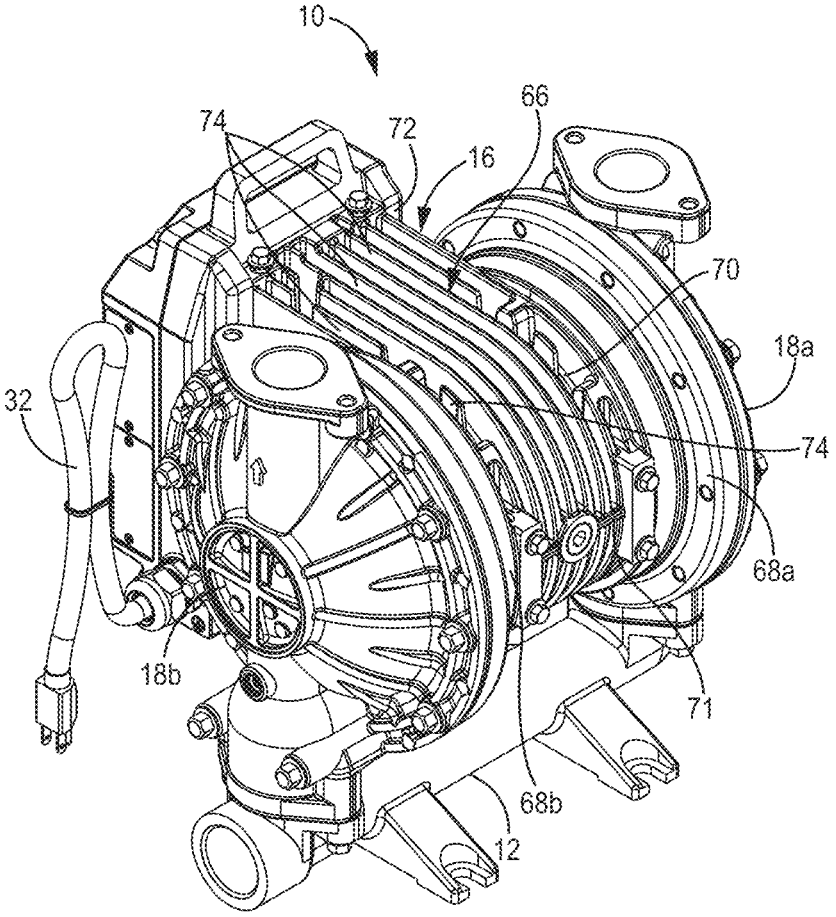
FIG. 8B is an isometric view of the electrically operated pump shown in FIG. 8A but with a housing cover removed.
Figure 8C:
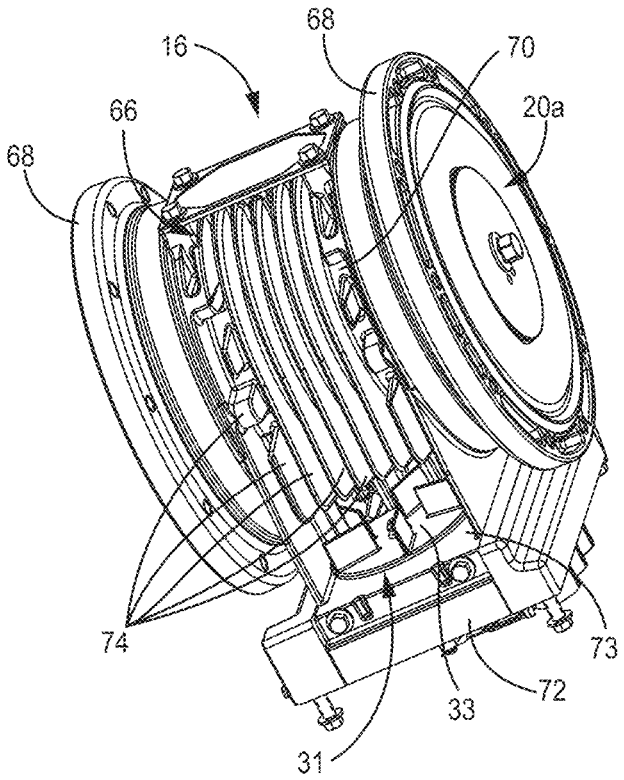
FIG. 8C is an isometric view of a pump body of the electrically operated pump shown in FIG. 8A.
Figure 8D:
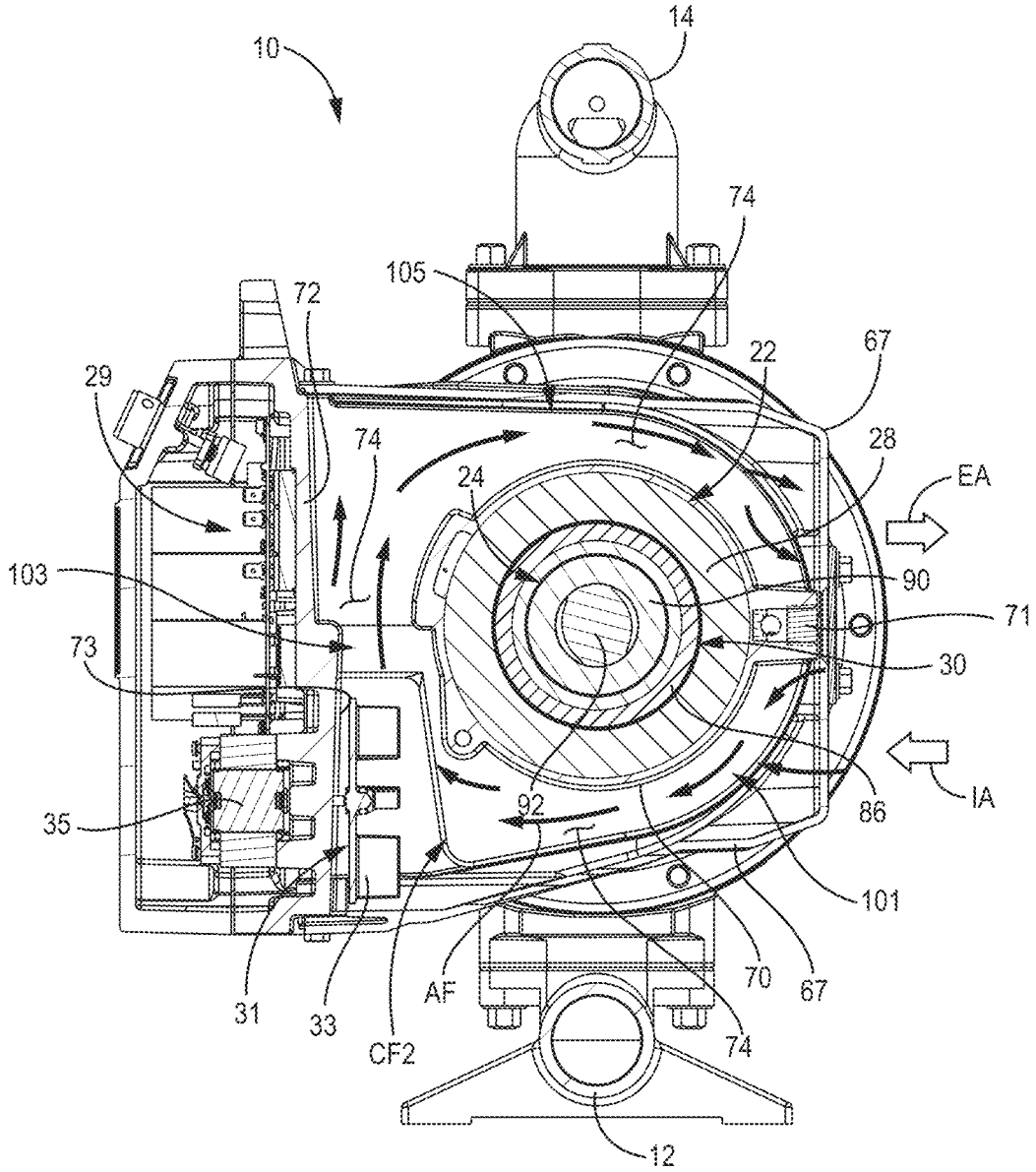
FIG. 8D is a cross-sectional view taken along line D-D in FIG. 8A.
Figure 8E:
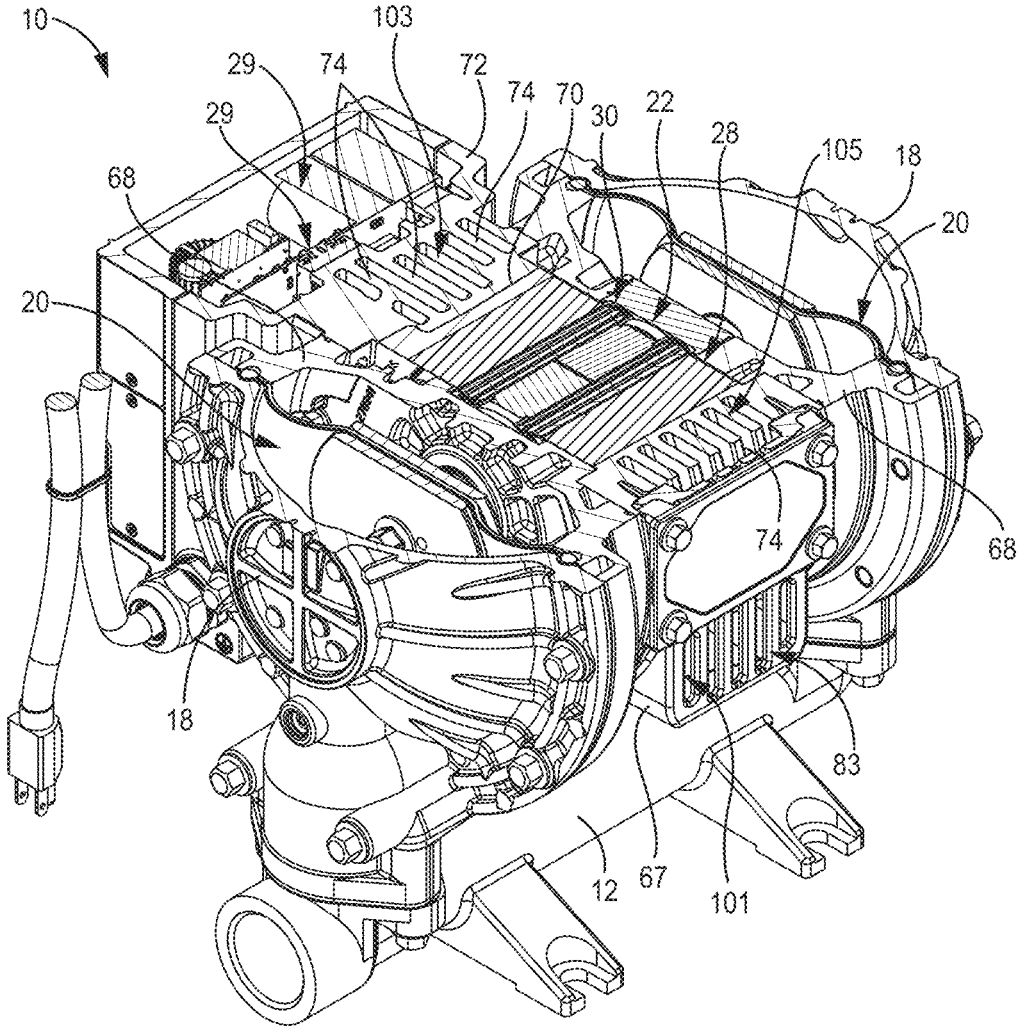
FIG. 8E is a cross-sectional view taken along line E-E in FIG. 8A.

FIG. 8A is a rear isometric view of electrically operated pump 10. FIG. 8B is a rear isometric view of pump 10 with housing cover 67 removed. FIG. 8C is an isometric view of pump body 16 of pump 10. FIG. 8D is a cross-sectional view taken along line D-D in FIG. 8A. FIG. 8E is a cross-sectional view taken along line E-E in FIG. 8A. FIGS. 8A-8E will be discussed together. Pump 10 includes inlet manifold 12, outlet manifold 14, pump body 16, fluid covers 18*a*, 18*b* (collectively herein "fluid cover 18" or "fluid covers 18"), fluid displacement members 20*a*, 20*b* (collectively herein "fluid displacement member 20" or "fluid displacement members 20"), motor 22, drive mechanism 24, controller 26, fan assembly 31, and housing cover 67. Motor 22 includes stator 28 and rotor 30. Fan assembly 31 includes impeller 33 and fan motor 35.

Pump body 16 includes central portion 66 and end caps 68*a*, 68*b* (collectively herein "end cap 68" or "end caps 68"). Central portion 66 includes motor housing 70, control housing 72, and heat sinks 74. Rotor 30 includes permanent magnet array 86 and rotor body 88. Drive nut 90 and screw 92 of drive mechanism 24 are shown.

End caps 68*a*, 68*b* are disposed on opposite lateral sides of central portion 66 and are attached to central portion 66 to form pump body 16. Fluid covers 18*a*, 18*b* are connected to end caps 68*a*, 68*b*, respectively. Inlet manifold 12 is connected to each fluid cover 18 to provide fluid to process fluid chambers 34*a*, 34*b*. Outlet manifold 14 is connected to each fluid cover 18 to receive fluid from process fluid chambers 34*a*, 34*b*.

Motor 22 and control elements 29 (such as controller 26 (FIGS. 1C and 19) among other elements) are supported by pump body 16. More specifically, motor 22 and control elements 29 are supported by central portion 66 of pump body 16. Motor 22 is disposed within motor housing 70 between end caps 68. Stator 28 surrounds rotor 30 and drives rotation of rotor 30, such that motor 22 can be considered to be an inner rotator motor. Rotor 30 rotates about pump axis PA-PA and is disposed coaxially with drive mechanism 24 and fluid displacement members 20. Permanent magnet array 86 is disposed on rotor body 88.

Control housing 72 is connected to and extends from motor housing 70. In the example shown, control housing 72 and motor housing 70 can be integrally formed as a single housing (e.g, by casting among other options). Control housing 72 is configured to house control elements 29 of pump 10, such as controller 26 (FIGS. 1C and 19).

Heat sinks 74 are formed on central portion 66. In the example shown, heat sinks 74 are formed in multiple configurations and include projections and fins, but it is understood that heat sinks 74 can be of any configuration suitable for increasing the surface area of pump body 16 to facilitate heat exchange to cool pump 10. In the example shown, some of heat sinks 74 define flow passages forming an outer cooling fluid circuit CF2 for pump 10. In the example shown, support ones of heat sinks 74 extends between and connect control housing 72 and motor housing 70.

Housing cover 67 is mounted to pump body 16 and at least partially defines flow passages of the cooling fluid circuit CF2. Inlet openings 83 and outlet openings 85 are formed through housing cover 67. In some examples, housing cover 67 is formed as an upper portion connected to pump body 16 on an upper side of central portion 66 (e.g., between outlet manifold 14 and central portion 66 in the example shown), and as a lower portion connected to pump body 16 on a lower side of central portion 66 (e.g., between inlet manifold 12 and central portion 66 in the example shown). As such, housing cover 67 can be formed from multiple discrete components assembled to pump 10 to at least partially define cooling fluid circuit CF2. It is understood, however, that housing cover 67 can be formed by as many or as few components as desired.

The main heat sources of pump 10 include controller 26, stator 28, and drive mechanism 24. Cooling fluid circuit CF directs cooling air through passages proximate the heat generating components to effect heat exchange between the cooling air and heat sources and thereby cool pump 10. Cooling fluid circuit CF2 is configured to direct cooling air around motor housing 70. Cooling fluid circuit CF2 directs cooling air circumferentially around pump axis PA. Cooling fluid circuit CF2 is configured to direct cooling air to provide cooling to elements in both motor housing 70 and control housing 72. It is understood that not all embodiments necessarily include a cooling fluid circuit CF2 or otherwise pump cooling air.

In the example shown, cooling fluid circuit CF2 includes an inlet passage 101, intermediate passage 103, and outlet passage 105. In the example shown, there is no valving in cooling fluid circuit CF2 to direct flow. Instead, fan 31 is configured to actively drive cooling air through cooling fluid circuit CF2. Fan 31 is supported by pump body 16. More specifically, fan 31 is supported by a wall forming control housing 72. Impeller 33 is disposed within cooling fluid circuit CF2. In the example shown, impeller 33 is disposed at an intersection between inlet passage 101 and outlet passage 105. Fan 31 is thereby at least partially disposed within the cooling fluid circuit CF2. More specifically, impeller 33 is disposed in the flowpath between an inlet of cooling fluid circuit CF2 and an outlet of cooling fluid circuit CF2. In the example shown, impeller 33 is unshrouded, but it is understood that impeller 33 can be shrouded in other examples. Fan motor 35 is disposed in control housing 72. Fan motor 35, which can be an electric motor, is isolated from the environment surrounding stator 28 by the wall of control housing 72, such that the cooling arrangement shown is suitable for use in hazardous locations.

Inlet passage 101 is defined between motor housing 70 and housing cover 67. In the example shown, inlet passage 101 includes multiple individual passages partially defined by heat sinks 74. The individual passages extend circumferentially around motor housing 70. An axial side of each flowpath is formed by a heat sink 74. In the example shown, at least some of heat sinks 74 can extend circumferentially, but not axially, on motor housing 70 and about pump axis PA. At least three sides of each flowpath in inlet passage 101 is defined by thermally conductive material (e.g., the motor housing 70 and heat sinks 74). The body of motor housing 70 at least partially defines inlet passage 101. Motor housing 70 is thereby directly exposed to the cooling flow through cooling fluid circuit CF2. Motor housing 70 is disposed directly between stator 28 and inlet passage 101 to provide efficient heat transfer from stator 28 to the cooling flow through cooling fluid circuit CF2.

Intermediate passage 103 is disposed between control housing 72 and motor housing 70. A wall of control housing 72 at least partially defines intermediate passage 103. One or more of the heat generating elements in control housing 72 can be mounted to control housing wall 73. The heat generating elements are thereby mounted control housing wall 73 that is also directly in contact with the cooling air flowing through cooling fluid circuit CF2. Mounting the heat generating elements to control housing wall 73 facilitates efficient heat transfer from those components to the cooling flow through cooling fluid circuit CF2. Intermediate passage 103 is at least partially defined by the body of motor housing 70. Motor housing 70 is thereby directly exposed to the cooling flow through cooling fluid circuit CF2. Motor housing 70 is disposed directly between stator 28 and intermediate passage 103 to provide efficient heat transfer from stator 28 to the cooling flow through cooling fluid circuit CF2. Heat sinks 74 extend between and connect control housing 72 and motor housing 70. The heat sinks 74 at least partially defining intermediate passage 103 directly contact both control housing 72 and motor housing 70. Such heat sinks 74 transfer heat from both control housing 72 and motor housing 70.

Outlet passage 105 is defined between motor housing 70 and housing cover 67. In the example shown, outlet passage 105 includes multiple individual passages partially defined by heat sinks 74. The individual passages extend circumferentially around motor housing 70. An axial side of each flowpath is formed by a heat sink 74. In the example shown, at least some of heat sinks 74 can extend circumferentially, but not axially, on motor housing 70 and about pump axis PA. At least three sides of each flowpath in outlet passage 105 is defined by thermally conductive material (e.g., the motor housing 70 and heat sinks 74). The body of motor housing 70 at least partially defines outlet passage 105. Motor housing 70 is thereby directly exposed to the cooling flow through cooling fluid circuit CF2. Motor housing 70 is disposed directly between stator 28 and outlet passage 105 to provide efficient heat transfer from stator 28 to the cooling flow through cooling fluid circuit CF2.

During operation, fan motor 35 is powered to drive rotation of impeller 33. Fan 31 draws air into cooling fluid circuit CF2 through inlet openings 83. Inlet openings 83 provide locations for air to enter into cooling fluid circuit CF2 and are in fluid communication with the surrounding environment. As such, the ambient air in the environment of pump 10 can form the cooling fluid of cooling fluid circuit CF2. While multiple inlet openings 83 are shown, it is understood that cooling fluid circuit CF2 can include any desired number of inlet openings 83, such as one or more. Inlet openings 83 can also be spaced circumferentially along inlet passage 101. For example, one or more additional or alternative inlet openings 83 can be formed at circumferential locations along housing cover 67 between the location currently shown and the position of fan 31.

Fan 31 draws intake air (shown by arrow IA) through inlet passage 101 and over motor housing 70 and heat sinks 74. The flow of cooling air (shown by arrows AF in FIG. 8D) passes over heat sinks 74 and motor housing 70 and cools those elements. Fan 31 blows the air downstream through intermediate passage 103 and outlet passage 105. The cooling air blown by the fan 31 initially flows through intermediate passage 103. The air flowing through intermediate passage 103 contacts both control housing 72 and motor housing 70 to transfer heat from both the heat generating components in control housing 72 (e.g., controller 26 among others) and from the heat generating components of in motor housing 70 (e.g., stator 28 and drive mechanism 24). At least a portion of the flow through cooling fluid circuit CF2 flows directly between the motor 22 and an electric component 29 mounted to housing wall 73. A radial line extending from pump axis PA can extend through drive mechanism 24, stator 28, a passage through cooling fluid circuit CF2 and an electric component 29 mounted to housing wall 73.

At least a portion of cooling fluid circuit CF2 is radially bracketed by two unique heat sources. Specifically, intermediate passage 103 is exposed to thermally conductive element on both radial sides of intermediate passage 103. The electric elements within control housing 72 form a first heat source cooled by the flow through cooling fluid circuit CF2 and the stator 28 and drive mechanism 24 within motor housing 70 form a second heat source cooled by the flow through cooling fluid circuit CF2. Intermediate passage 103 is disposed directly downstream from impeller 33. As such, the air entering and then flowing through intermediate passage 103 has the greatest velocity of the flow through cooling fluid circuit CF2. The high velocity facilitates quick air exchange and decreases residence time, providing enhanced cooling efficiency in the portion of cooling fluid circuit CF2 exposed to two independent heat sources.

Fan 31 blows the air downstream through intermediate passage 103. The air flow exits intermediate passage 103 and flows through outlet passage 105. The air further cools pump 10 as the air flows through outlet passage 105 to outlet openings 85. The air is exhausted through outlet openings 85 as exhaust air (shown by arrow EA). In some examples, pump 10 includes deflectors and/or contouring to direct heated exhaust air exiting outlet openings 85 away from inlet openings 83. In some examples, pump 10 includes deflectors and/or contouring such that an air intake is oriented away from outlet openings 85 to void intake of hot exhaust air. Blocker wall 71 extends radially from motor housing 70. Blocker wall 71 is disposed circumferentially between inlet passage 101 and outlet passage 105. Blocker wall 71 prevents cool intake air entering inlet passage 101 from crossing into outlet passage 105 and prevents heated exhaust air form outlet passage 105 from crossing into inlet passage 101. Blocker wall 71 can further act as a heat sink to conduct heat away from stator 28 and drive mechanism 24.

One or more of heat sinks 74 can be formed as a continuous projection extending through multiple portions of the cooling fluid flowpath CF2. For example, a single heat sink 74 can extend from blocker wall 71, through inlet passage 101, through intermediate passage 103, and through outlet passage 105 and back to blocker wall 71. As such, one or more of heat sinks 74 can extend fully circumferentially about motor 22 between a common connection point (e.g., blocker wall 71 in the example shown).

The cooling air flow AF is drawn into cooling fluid circuit CF2 by fan 31 and blown between two independent heat sources contained in control housing 72 and motor housing 70 and downstream out of cooling fluid circuit CF2. The cooling air flow AF is routed circumferentially about motor housing 70 and pump axis PA. The cooling air flow AF thereby flows around both the axis of rotation of rotor 30 and the axis of reciprocation of fluid displacement members 20. In the example shown, the cooling air flow AF contacts motor housing 70 about a full circumferential length of the cooling fluid circuit CF2. The cooling air flow AF contacts control housing 72 for a portion of the length of the cooling fluid circuit CF2.

Cooling fluid circuit CF2 provides significant advantages. Cooling fluid circuit CF2 draws cooling air from the environment surrounding pump 10, providing an unlimited source of cooling air. Fan 31 actively pulls the cooling fluid into cooling fluid circuit CF2 and blows the cooling fluid downstream through cooling fluid circuit CF2 to the outlet. Fan 31 actively blows the air through cooling fluid circuit CF2, facilitating greater flow and more efficient cooling. Cooling fluid circuit CF2 provides cooling to both the heating elements of control housing 72 and the heating elements in motor housing 70. By cooling multiple distinct heat sources, cooling fluid circuit CF2 simplifies the arrangement of pump 10 and provides for a more compact, efficient pumping assembly. Cooling fluid circuit CF2 routes the cooling air circumferentially around motor housing 70, maximizing the heat transfer area between motor housing 70 and the cooling air flow AF.

Figure 9A:
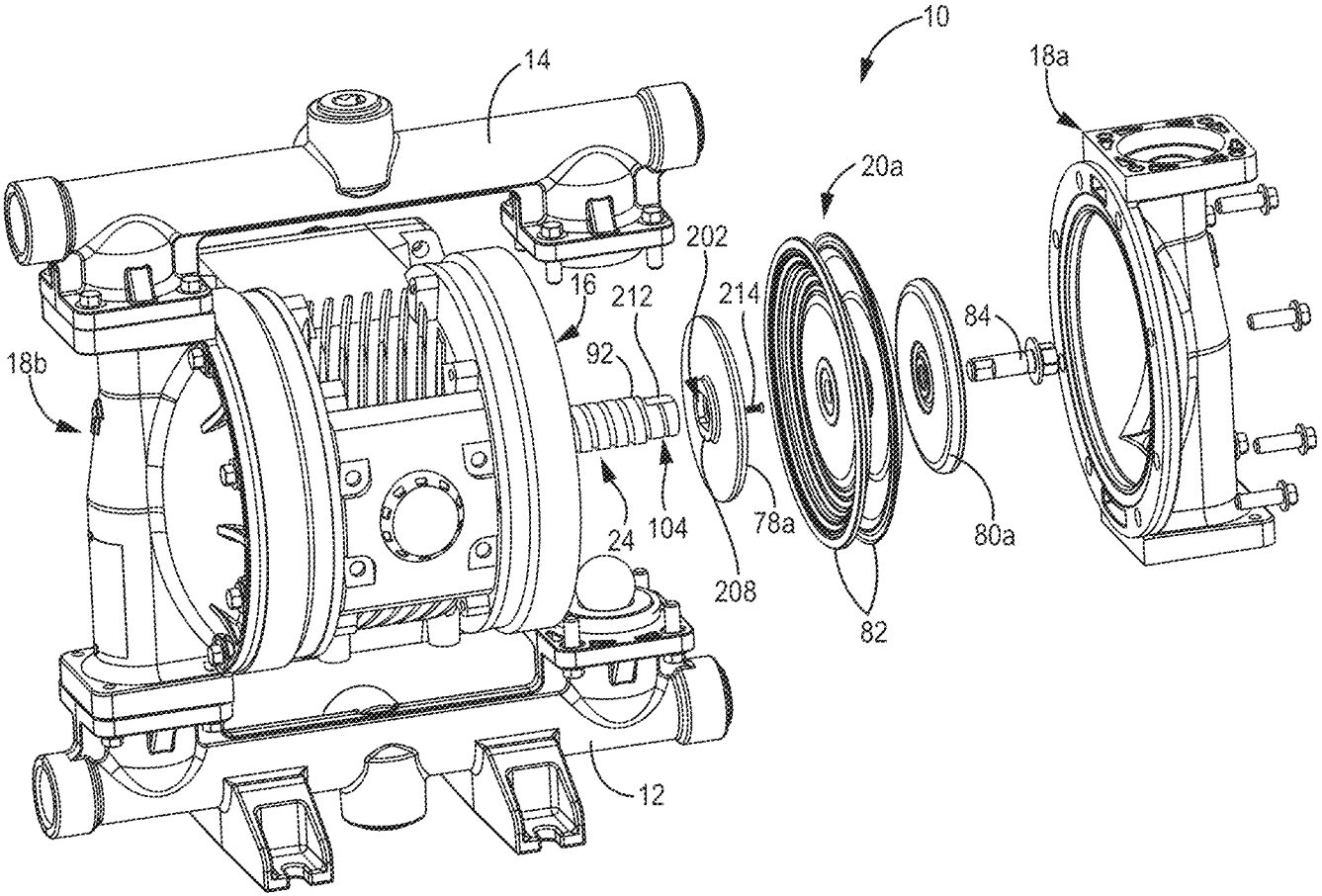
FIG. 9A is a partially exploded isometric view of an electrically operated pump.
Figure 9B:
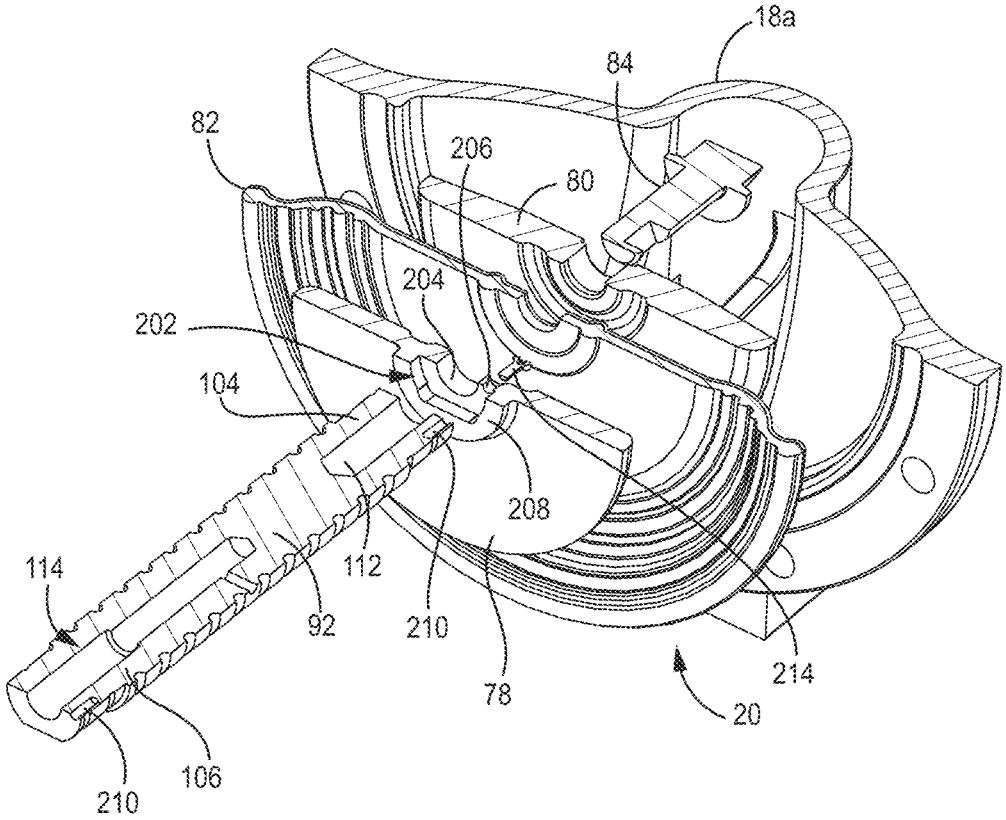
FIG. 9B is an exploded cross-sectional view of an interface between a fluid displacement member and a drive mechanism.
Figure 9C:
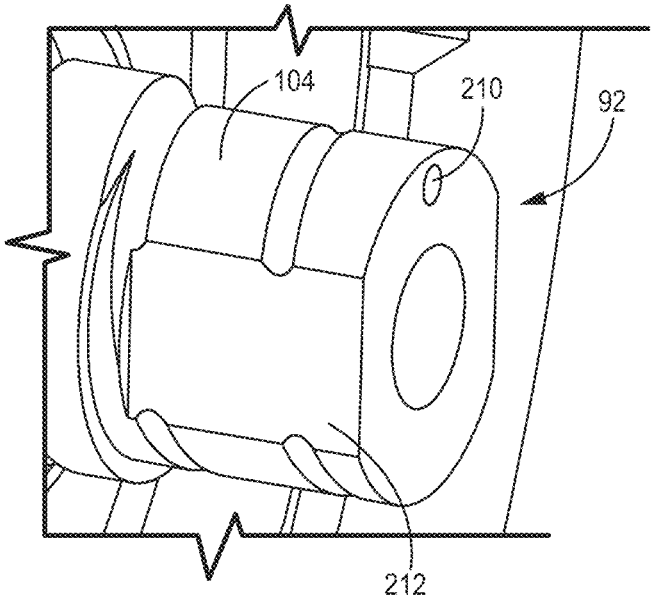
FIG. 9C is an isometric view of an end of a screw.

FIG. 9A is a partially exploded view of pump 10. FIG. 9B is an enlarged cross-sectional view showing an interface between drive mechanism 24 and fluid displacement member 20*a*. FIG. 9C is an enlarged isometric view of an end 104, 106 of screw 92. FIGS. 9A-9C will be discussed together. Inlet manifold 12, outlet manifold 14, pump body 16, fluid covers 18*a*, 18*b*, fluid displacement member 20*a*, and screw 92 of drive mechanism 24 are shown. Fluid displacement member 20*a* includes inner plate 78*a*, outer plate 80*a*, membrane 82, and fastener 84. Inner plate 78*a* includes receiving chamber 202, fastener opening 204, and set screw opening 206. Receiving chamber 202 includes chamber wall 208. First end 104 of screw 92 includes first bore 112, locating bore 210, and flats 212.

As discussed above, fluid displacement member 20*a* is mounted within pump 10 such that fluid displacement member 20*a* does not rotate about pump axis PA-PA. In the example shown, an outer circumferential edge of membrane 82 is captured between fluid cover 18*a* and pump body 16 to prevent fluid displacement member 20*a* from rotating about pump axis PA-PA.

Screw 92 is connected to fluid displacement member 20*a* such that screw 92 is prevented from rotating relative to fluid displacement member 20*a*. Outer plate 80*a* is disposed on a side of membrane 82 facing fluid cover 18*a*. Inner plate 78*a* is disposed on a side of membrane 82 facing end cap 68*a*. Fastener 84 extends through each of outer plate 80*a*, membrane 82*a*, and inner plate 78*a* and into screw 92 to connect fluid displacement member 20 to screw 92.

Chamber wall 208 projects from an inner side of inner plate 78*a*. Chamber wall 208 at least partially defines receiving chamber 202. Chamber wall 208 is profiled such that to engage screw 92 and prevent screw 92 from rotating relative to fluid displacement member 20. Fastener opening 204 and set screw opening 206 extend through inner plate 78 into receiving chamber 202. While receiving chamber 202 is described as defined by a projection from inner plate 78*a*, it is understood that receiving chamber 202 can be formed in any desired manner. For example, receiving chamber 202 can be formed by a recess extending into inner plate 78*a*.

In the example shown, first screw end 104 extends into receiving chamber 202. First end 104 is profiled complementary to chamber wall 208 to prevent rotation of screw 92 relative to fluid displacement member 20*a*. In the example shown, flats 212 are formed on opposite radial sides of first end 104. Chamber wall 208 includes corresponding features configured to mate with flats 212. The interface between screw 92 and inner plate 78*a* prevents screw 92 from rotating relative to inner plate 78*a*. While fluid displacement member 20*a* and screw 92 are described as having mating flats to prevent rotation, it is understood that fluid displacement member 20*a* and screw 92 can interface in any desired manner suitable for keying screw 92 to fluid displacement member 20*a* and preventing relative rotation.

Set screw 214 extends through set screw opening 206 and into locating bore 210. Set screw 214 extending into locating bore 210 further locks screw 92 to fluid displacement member 20*a*. Locating bores 210 extend into screw 92 from first end 104 and second end 106. In some examples, locating bores 210 extends parallel to first bore 112 and second bore 114. Locating bores 210 can include threading configured to mate with threading formed on set screw 214.

Screw 92 is connected to fluid displacement member 20*a* such that screw 92 cannot rotate relative to fluid displacement member 20*a*. Screw 92 is connected to fluid displacement member 20*b* in substantially the same manner screw 92 connects to fluid displacement member 20*a*. In some examples inner plate 78*a* is identical to inner plate 78*b*. Fluid displacement members 20*a*, 20*b* thereby prevent rotation of screw 92 relative pump axis PA-PA.

The connection between screw 92 and fluid displacement member 20 also prevents loosening of or disconnecting of fastener 84 during operation. The rotational moment exerted on screw 92 during pumping does not cause unthreading of fastener 84 from first bore 112 because screw 92 is prevented from rotating relative to fluid displacement member 20. Fluid displacement member 20*a* is secured within pump 10 such that fluid displacement member 20 cannot rotate relative to pump axis PA-PA. Fluid displacement members 20 prevent screw 92 from rotating about pump axis PA-PA further facilitating translation of screw 92 along pump axis PA-PA.

Figure 10:
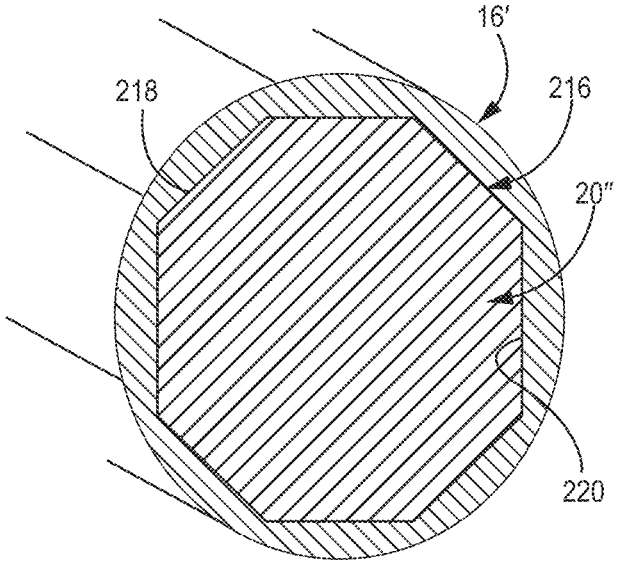
FIG. 10 is a cross-sectional block diagram showing an anti-rotation interface.

FIG. 10 is a schematic block diagram showing an interface between pump body 16' and fluid displacement member 20". In the example shown, fluid displacement member 20" is a piston. Pump body 16' includes piston bore 216. Pump body 16' can be any housing of pump 10 within which a piston reciprocates during pumping, such as an end cap configured to house a reciprocating piston. Piston bore 216 includes housing contour 218. Fluid displacement member 20" includes piston contour 220. Piston contour 220 mates with housing contour 218 such that fluid displacement member 20" can travel axially relative to pump body 16' but is prevented from rotating relative to pump body 16'. The interface between fluid displacement member 20" and pump body 16' prevents fluid displacement member 20" from rotating relative to axis PA-PA and relative to pump body 16'. Screw 92 (best seen in FIGS. 4A and 12) can be connected to fluid displacement member 20" to prevent relative rotation, similar to the connection shown in FIGS. 9A and 9B.

Figure 11:
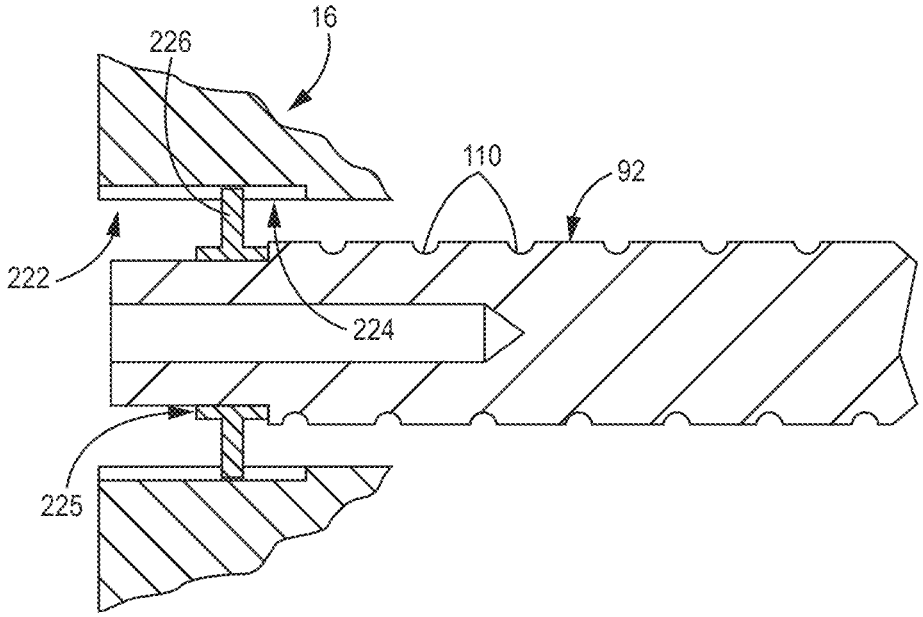
FIG. 11 is a block diagram showing an anti-rotation interface.

FIG. 11 is a schematic block diagram showing anti-rotation interface 222. Second end 106 of screw 92 is shown. Slot 224 is formed in pump body 16. It is understood that slot 224 can be formed on one of an end 104, 106 of screw 92 and in pump housing 16. Slot 224 can be open at the end of screw 92.

Projection 226 extends from screw 92. In the example shown, projection 226 is formed as part of collar 225 connected to the end of screw 92. In examples where slot 224 is formed in screw 92, projection 226 can extend from a static component of pump 10, such as pump body 16. Projection 226 extends into and mates with slot 224. Projection 226 mating with slot 224 prevents screw 92 from rotating relative to pump axis PA-PA as screw 92 reciprocates. Screw 92 reciprocates relative to projection 226. Projection 226 is shown as a pin, but it is understood that projection can be of any configuration suitable for extending into slot 224 to prevent rotation of screw 92. For example, projection 226 can be a fin, a detent, or a bump, among other options.

Figure 12:
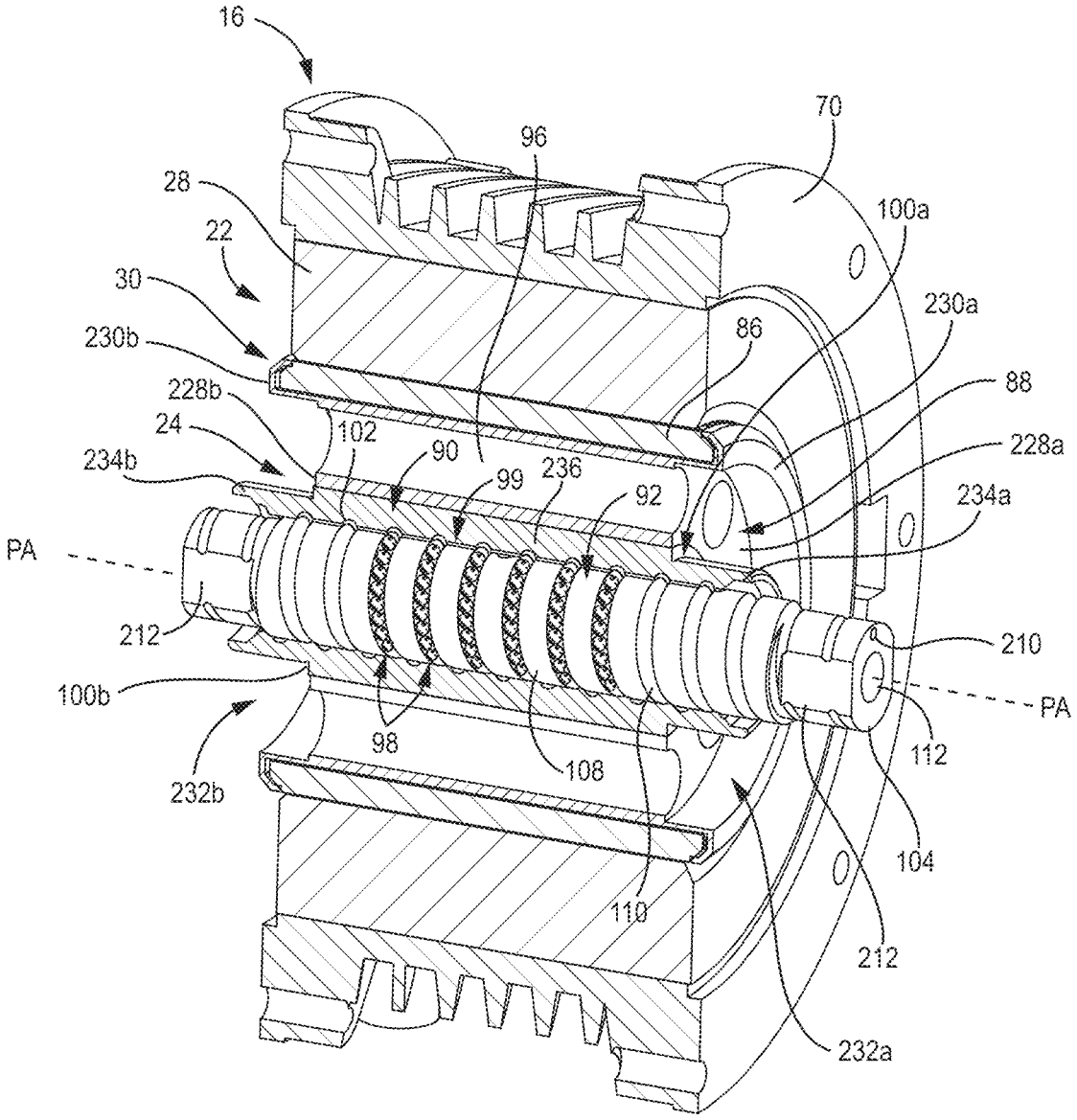
FIG. 12 is an isometric partial cross-sectional view showing a motor and drive mechanism of an electrically operated pump.

FIG. 12 is an isometric partial cross-sectional view of motor 22 and drive mechanism 24. Motor 22 includes stator 28 and rotor 30 and is mounted in motor housing 70. Rotor 30 includes permanent magnet array 86 and rotor body 88. Rotor body 88 includes rotor bores 96; rotor ends 228*a*, 228*b* (collectively herein "rotor ends 228"); axial extensions 230*a*, 230*b* (collectively herein "axial extensions 230"); and axial recesses 232*a*, 232*b* (collectively herein "axial recesses 232"). Drive mechanism 24 includes drive nut 90, screw 92, and rolling elements 98. Gap 99 between drive nut 90 and screw 92 is shown. Drive nut 90 includes nut notches 100*a*, 100*b*, nut thread 102, nut ends 234*a*, 234*b*, and nut body 236. First screw end 104, second screw end 106, screw body 108, screw thread 110, first bore 112, locating bore 210, and flats 212 of screw 92 are shown.

Rotor 30 is disposed within stator 28 on pump axis PA-PA. Axial extensions 230*a*, 230*b* are disposed at and extend from rotor ends 228*a*, 228*b*, respectively. Axial extensions 230*a*, 230*b* extend beyond axial ends of stator 28. Permanent magnet array 86 is mounted on rotor 30. Axial ends of permanent magnet array 86 extend onto axial extensions 230. Axial extensions 230 extending beyond the axial ends of stator 28 facilitates top and/or end mounting of position sensor 62 (best seen in FIGS. 17A and 18), as discussed in more detail below. Rotor bores 96 extend through rotor body 88 between rotor end 228*a* and rotor end 228*b*. Rotor bores 96 extend axially in the example shown. Rotor bores 96 can be of any configuration suitable for effecting cooling flow through rotor 30 and/or reducing weight of rotor 30.

Drive nut 90 extends through rotor 30 and is disposed coaxially with rotor 30. Drive nut 90 is connected to rotor body 88 such that drive nut 90 rotates about pump axis PA-PA with rotor 30. Nut thread 102 are formed on an inner radial surface of drive nut 90. Nut end 234*a* extends in a first axial direction from nut body 236 and nut end 234*b* extends in a second axial direction from nut body 236. Nut notch 100*a* is formed at an interface between nut end 234*a* and nut body 236. Nut notch 100*b* is formed at an interface between nut end 234*b* and nut body 236. Inner races 122*a*, 122*b* of bearings 54*a*, 54*b* (best seen in FIGS. 4A, 4B, and 4D) are respectively disposed at nut notches 100*a*, 100*b* and seated on nut ends 234*a*, 234*b*. Axial recesses 232*a*, 232*b* are annular recesses disposed between axial extensions 230*a*, 230*b* and nut ends 234*a*, 234*b*. Bearings 54 are at least partially disposed in axial recesses 232. Axial recesses 232 provide space for position sensor 62 to extend under permanent magnet array 86.

Screw 92 extends axially through drive nut 90 and is disposed coaxially with rotor 30 and drive nut 90. Screw thread 110 are formed on an exterior of screw body 108. First screw end 104 extends axially from a first end of screw body 108 and second screw end 106 extends axially from a second end of screw body 108. Flats 212 are formed on each of first screw end 104 and second screw end 106. Flats 212 form anti-rotational surfaces configured to interface with features on fluid displacement members 20 to prevent screw 92 from rotating relative fluid displacement members 20. First bore 112 and locating bore 210 extend axially into first screw end 104.

Rolling elements 98 are disposed in raceways formed by screw thread 110 and nut thread 102. Rolling elements 98 support screw 92 relative drive nut 90 such that each of drive nut 90 and screw 92 ride on rolling elements 98. Rolling elements 98 support screw 92 relative drive nut 90 such that drive nut 90 and screw 92 are not in contact during operation. Rolling elements 98 maintain gap 99 between drive nut 90 and screw 92 and prevent contact therebetween.

Drive nut 90 rotates relative to screw 92. Rolling elements 98 exert forces on screw 92 at screw thread 110 to cause axial displacement of screw 92 along pump axis. Rotor 30 can be driven in a first rotational direction to drive screw 92 in a first axial direction. Rotor 30 can be driven in a second rotational direction opposite the first rotational direction to drive screw 92 in a second axial direction opposite the first axial direction.

Figure 13:
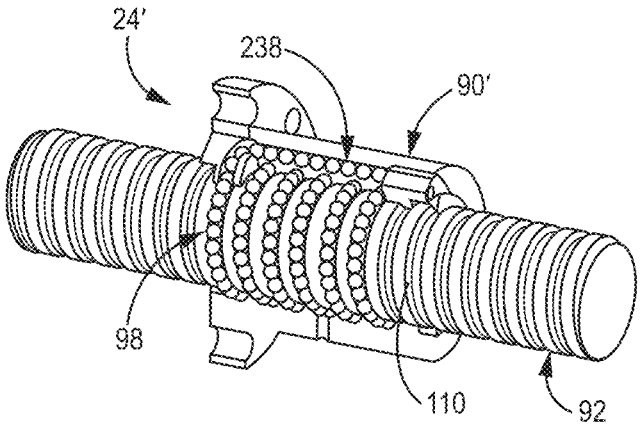
FIG. 13 is an isometric view of a drive mechanism with a portion of the drive nut removed.

FIG. 13 is a partial cross-sectional view of drive mechanism 24'. Drive mechanism 24' includes drive nut 90', screw 92, rolling elements 98, and ball return 238.

Drive nut 90' surrounds a portion of screw 92 and rolling elements 98 are disposed between drive nut 90' and screw 92. In the example shown, rolling elements 98 are balls. As such, drive mechanism 24' can be considered to be a ball screw. Rolling elements 98 support drive nut 90' relative screw 92 such that drive nut 90' does not contact screw 92. Rolling elements 98 are disposed in raceways formed by screw thread 110 and nut thread 102 (best seen in FIG. 12). Ball return 238 is configured to pick up rolling elements 98 and recirculate the rolling elements 98 within the raceway formed by screw thread 110 and nut thread 102. Ball return 238 can be of any type suitable for circulating rolling elements 98. In some examples, ball return 238 is an internal ball return such that rolling elements 98 not within raceway pass through body of drive nut 90'.

Drive nut 90' rotates relative to screw 92 and causes rolling elements 98 to exert an axial force on screw 92 to drive screw linearly. Drive mechanism 24' can thereby convert a rotational input to a linear output.

Figure 14:
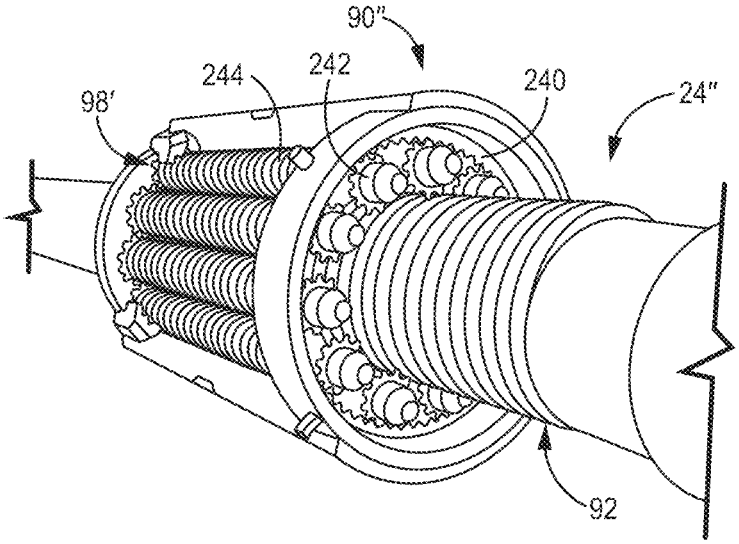
FIG. 14 is an isometric view of a drive mechanism with a portion of the drive nut removed.
Figure 15:
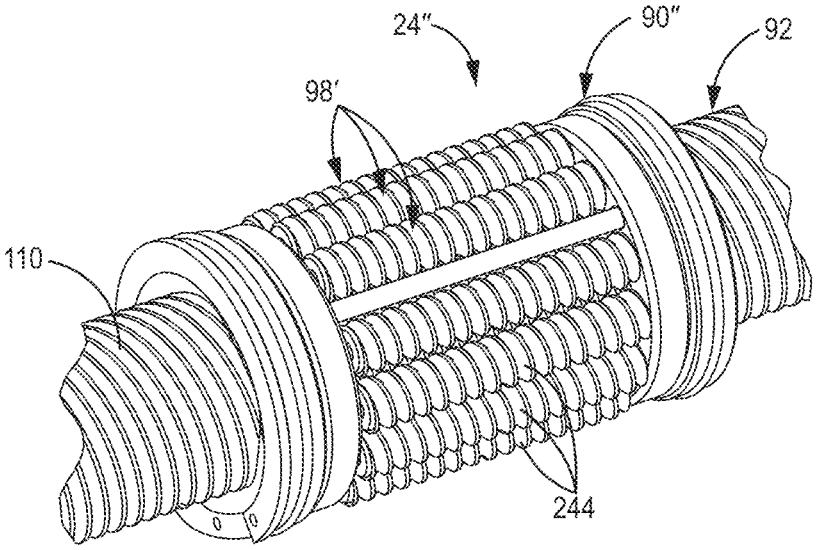
FIG. 15 is an isometric view of the drive mechanism shown in FIG. 13 with the body of the drive nut removed to show the rolling elements.

FIG. 14 is an isometric view of drive mechanism 24" with a portion of drive nut 90" removed. FIG. 15 is an isometric view of drive mechanism 24" with the body of drive nut 90" removed to show rolling elements 98'. FIGS. 14 and 15 will be discussed together. Drive mechanism 24" includes drive nut 90", screw 92, and rolling elements 98'. Drive nut 90" includes drive rings 240. Each one of rolling elements 98' includes end rollers 242 and roller shaft 244.

Drive nut 90" surrounds a portion of screw 92 and rolling elements 98' are disposed between drive nut 90" and screw 92. In the example shown, rolling elements 98' include rollers. As such, drive mechanism 24" can be considered to be a roller screw. Rolling elements 98' support drive nut 90" relative screw 92 such that drive nut 90" does not contact screw 92. Rolling elements 98' are disposed circumferentially and symmetrically about screw 92. Roller shafts 244 extend between and connect pairs of end rollers 242. As such, each rolling element 98' can include an end roller 242 at a first end of the shaft 244 and can further include an end roller 242 at a second end of the roller shaft 244. In some examples, roller shafts 244 include threading configured to mate with screw thread 110 to exert additional driving force on screw 92. Each end roller 242 includes teeth. End rollers 242 extend between and engages thread 110 and drive ring 240. The teeth of end rollers 242 engage the teeth of drive ring 240.

Drive nut 90" includes a first drive ring 240 at a first end of drive nut 90" and a second drive ring 240 at a second end of drive nut 90". For each rolling element 98', a first one of the end rollers 242 engages the teeth of the drive ring 240 at the first end of drive nut 90" and the second one of the end rollers 242 engages the teeth of the drive ring 240 at the second end of drive nut 90". As drive nut 90" rotates, engagement between end rollers 242 and drive rings 240 causes each rolling element 98' to rotate about its own axis and causes the array of rolling elements 98' to rotate about pump axis PA-PA. The threads of roller shafts 244 engage and exert a driving force on screw thread 110 to linearly displace screw 92.

Drive nut 90" rotates relative to screw 92 and causes rolling elements 98' to exert an axial force on screw 92 to drive screw 92 linearly. Drive mechanism 24" thereby converts a rotational input to a linear output.

Figure 16A:
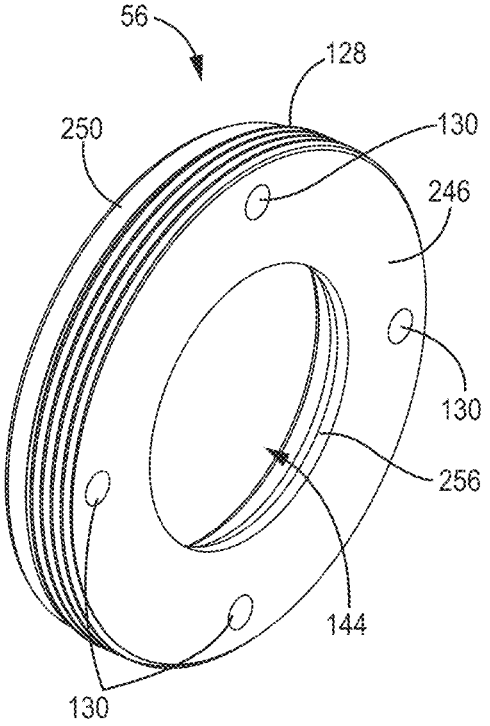
FIG. 16A is a first isometric view of a motor nut.
Figure 16B:
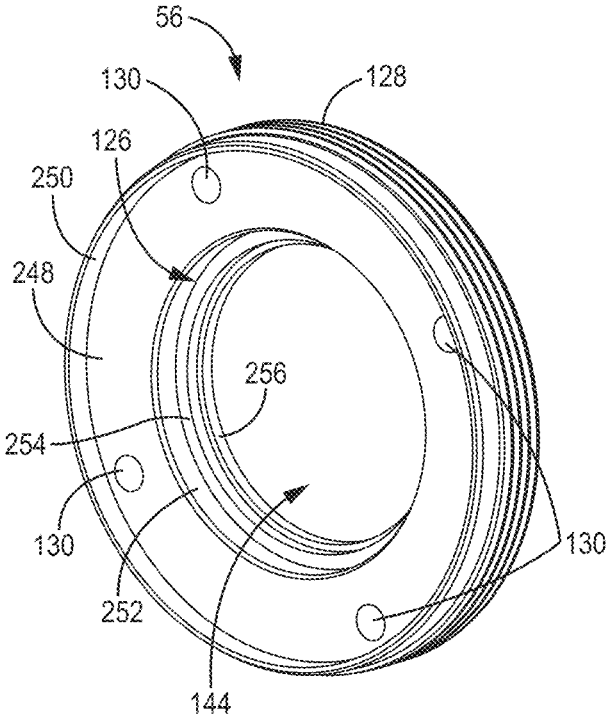
FIG. 16B is a second isometric view of the motor nut.

FIG. 16A is a first isometric view of motor nut 56. FIG. 16B is a second isometric view of motor nut 56. FIGS. 16A and 16B will be discussed together. Motor nut 56 includes motor nut notch 126, outer edge 128, cooling ports 130, central aperture 144, first side 246 (seen in FIG. 16A), second side 248 (seen in FIG. 16B), flange 250, and lip 256. Motor nut notch 126 includes axial surface 252 and radial surface 254.

Central aperture 144 extends through motor nut 56 between first side 246 and second side 248. Central aperture 144 provides an opening that screw 92 can reciprocate through during operation. First side 246 of motor nut 56 is oriented towards fluid displacement member 20*a* (best seen in FIGS. 4A, 9A, and 9B) and second side 248 of motor nut 56 is oriented towards motor 22 (best seen in FIGS. 4A-4D and 12). Motor nut 56 is configured to mount to a pump housing, such as pump body 16 (best seen in FIGS. 3A-4C). Outer edge 128 includes threading configured to connect to threading formed in the pump housing. As such, motor nut 56 can be threadedly connected to pump body 16. Flange 250 projects axially from second side 248 of motor nut 56. Flange 250 interfaces with pump housing 16 as motor nut 56 is installed to ensure proper alignment between motor nut 56 and pump body 16. In the example shown, flange 250 aligns with end cap 68*a*, and end cap 68*a* aligns with central portion 66. In some examples, the threading does not extend onto flange 250.

Motor nut notch 126 is formed within central aperture 144. Motor nut notch 126 is configured to extend around and receive an outer race of bearing 54. Outer race 124 interfaces with both axial surface 252 and radial surface 254 of motor nut notch 126. Motor nut 56 preloads bearings 54 of pump 10 via the interface with bearing 54*a*.

Lip 256 extends radially from first side 246 into central aperture 144. Lip 256 extends circumferentially about central aperture 144. Lip 256 defines a narrowest diameter of central aperture 144. In some examples, lip 256 forms a mounting feature on which a portion of grease cap 60*a* can mount. For example, a support, such as support 152 (FIG. 5A), of grease cap 60 can mount to lip 256 via a snap lock configuration. Cooling ports 130 extend through motor nut 56 between first side 246 and second side 248. Cooling ports 130 form the upstream-most portions of third cooling passage 40 (best seen in FIGS. 2 and 4A). Cooling ports 130 provide pathways for a portion of the cooling air to enter third cooling passage 40.

Figure 17A:
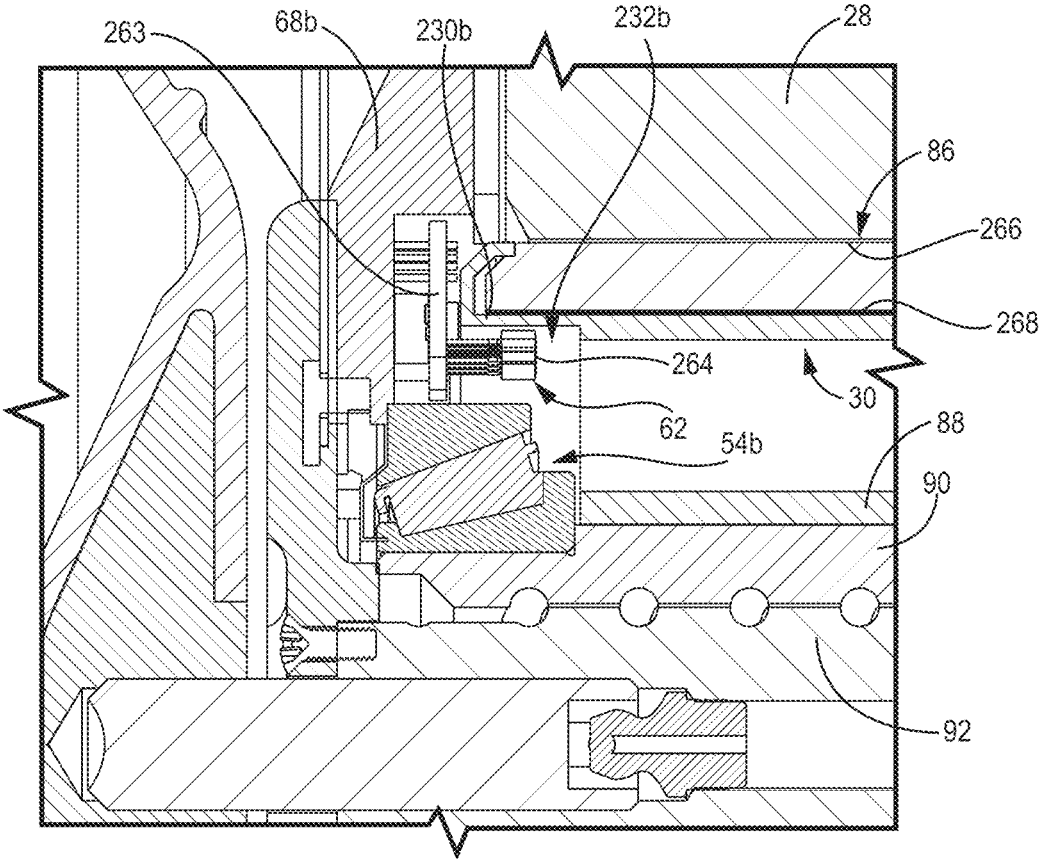
FIG. 17A is an enlarged cross-sectional view of a portion of an electrically operated pump.
Figure 17B:
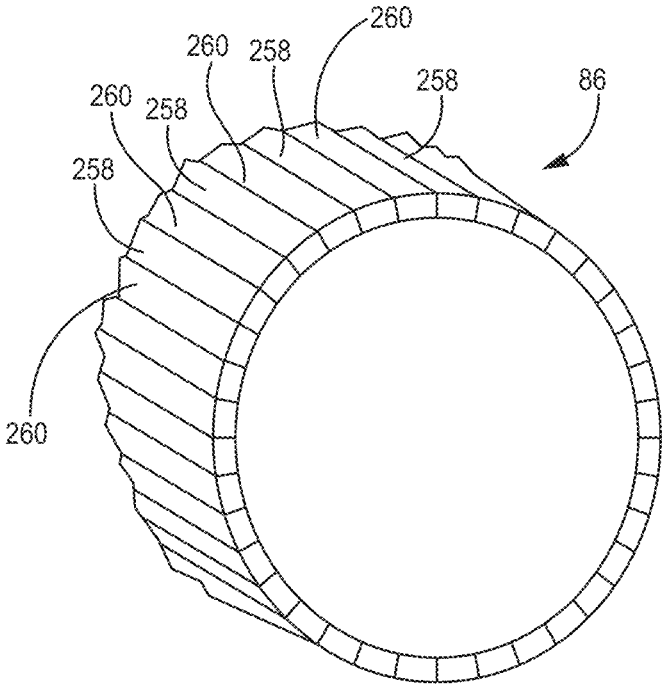
FIG. 17B is an isometric view of a portion of a rotor.
Figure 18:
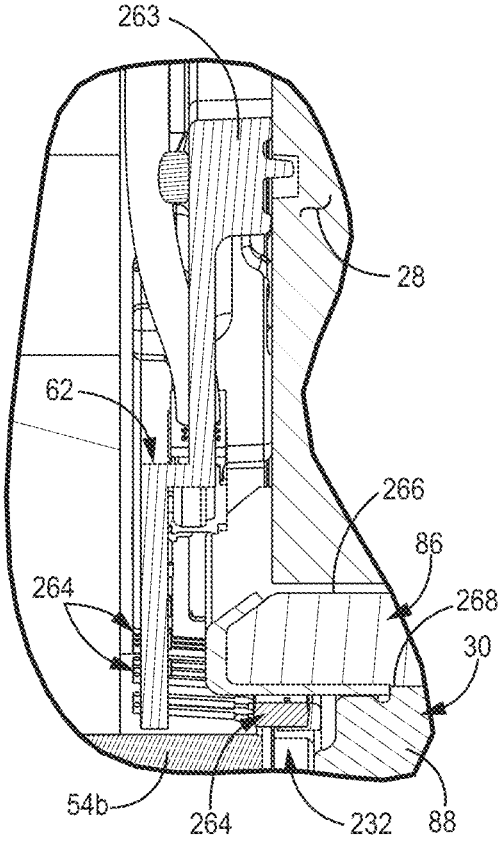
FIG. 18 is an enlarged cross-sectional view of a portion of an electrically operated pump.

FIG. 17A is an enlarged cross-sectional view showing the location of position sensor 62 relative motor 22. FIG. 17B is an isometric schematic view of a permanent magnet array, specifically of permanent magnet array 86. FIG. 18 is an enlarged cross-sectional view showing a location of position sensor 62 relative to motor 22. FIGS. 17A-18 will be discussed together. Motor 22 includes stator 28 and rotor 30. Rotor 30 includes rotor body 88 and permanent magnet array 86. Position sensor 62 includes support body 263 and sensing components 264. Permanent magnet array 86 includes permanent magnets 258 and back irons 260.

Position sensor 62 is mounted within pump 10 and adjacent to rotor 30. Position sensor 62 is mounted such that rotor 30 moves relative to position sensor 62. For example, position sensor 62 can be mounted to pump body 16 or stator 28, among other options. In the example shown in FIG. 17A, position sensor 62 is mounted to end cap 68*b*. More specifically, sensor body 263 is fixed to end cap 68*b* to secure position sensor 62 at a fixed position about pump axis PA. In the example shown in FIG. 18, sensor body 263 is fixed to stator 28 to secure position sensor 62 at a fixed position about pump axis PA. For example, sensor body 263 can be connected to stator 28 by fasteners extending into stator 28, such as into a potting compound of stator 28. Sensor body 263 can support other components of position sensor 62, such as electronic components thereof, relative to motor 22 and other components of pump 10.

Position sensor 62 is communicatively connected to controller 26 (FIGS. 1A and 19). As discussed above, screw 92 does not rotate as screw 92 translates during operation. As such, rotation of screw 92 cannot be sensed to generate commutation data. Instead, position sensor 62 is disposed proximate permanent magnet array 86 such that the magnetic fields of permanent magnets 258 are sensed by position sensor 62. Specially, position sensor 62 includes an array of sensing components 264 spaced circumferentially about pump axis PA. For example, the array of sensing components 264 can be an array of Hall-effect sensors responsive to the magnetic fields generated by permanent magnets 258. For example, position sensor 62 can utilize an array of three Hall effect sensors as the sensing components 264 of position sensor 62. The position information generated by position sensor 62 provides commutation data that controller 26 utilizes to commutate motor 22.

As shown in FIG. 17A, permanent magnet array 86 includes outer radial edge 266 and inner radial edge 268. Outer radial edge 266 is oriented towards stator 28 and spaced from stator 28 by an air gap. Inner radial edge 268 is oriented towards pump axis PA-PA. During operation, back irons 260 concentrate flux and direct the magnetic field from permanent magnets on opposite circumferential sides of back iron 260. The stray flux through rotor 30 affects operation of position sensor 62 and can prevent sensing components 264 from accurately sensing the polarity of permanent magnets 258. The stray flux is concentrated in the region radially aligned with permanent magnet array 86 (e.g., between inner radial edge 268 and outer radial edge 266) and the region radially outside of permanent magnet array 86 (e.g., radially outside of outer radial edge 266).

Position sensor 62 is mounted such that sensing components 264 are disposed at a mounting region radially inward of permanent magnet array 86 (e.g. radially between pump axis PA and permanent magnet array 86) to isolate sensing components 264 from the stray flux during operation. In FIG. 17A, position sensor 62 is mounted to and supported by end cap 68. In FIG. 18, position sensor 62 is mounted to and supported by stator 28. In both the examples shown in FIGS. 17A and 18, sensing components 264 are disposed radially inward of permanent magnet array 86 such that permanent magnet array 86 is radially between sensing components 264 and stator 28. While sensing components 264 are disposed radially inward of rotor 30, it is understood that position sensor 62 can span radially over permanent magnet array 68 such that a portion of position sensor 62 is disposed radially inside of permanent magnet array 68 and a portion of position sensor 62 is disposed radially outside of permanent magnet array 68.

Sensing components 264 of position sensor 62 are disposed radially between inner radial edge 268 and pump axis PA-PA. Permanent magnet array 86 is disposed between sensing components 264 and stator 28. Sensing components 264 are disposed radially inward of inner radial edge 268 of permanent magnet array 86. Sensing components 264 are disposed radially between bearing 54*b* and inner radial edge 268. Sensing components 264 extend below permanent magnet array 86 and between permanent magnet array 86 and pump axis PA-PA. Sensing component 264 extend axially into rotor body 88 such that axial extension 230*b* is disposed between sensing component 264 and permanent magnet array 86. Sensing components 264 extend into axial recess 232*b*. Sensing components 264 can axially overlap with permanent magnet array 86 such that a radial line extending from pump axis PA passes through a portion of each of sensing components 264 and permanent magnet array 86. When mounted in the mounting region, sensing components 264 do not radially overlap with permanent magnet array 86, such that an axial line parallel to pump axis PA will not pass through both sensing components 264 and permanent magnet array 86. Locating sensing components 264 radially inward of permanent magnet array 86 shields sensing components 264 from the stray flux. Position sensor 62 can generate data regarding the permanent magnets 258 and provide commutation information to controller 26 with sensing components 264 mounted in the mounting region. Sensing components 264 can be mounted radially inward of permanent magnet array and can generate commutation data from that position.

Mounting the position sensor 62 such that sensing components 264 are radially inside of permanent magnet array 86 reduces the effect of the stator flux on position sensor 62. Sensing components 264 mounting radially inside of permanent magnet array 86 shields sensing components 264 and facilitates sensing by position sensor 62. Sensing components 264 axially overlap with rotor 30 and extend into a portion of rotor 30, facilitating a compact arrangement of pump 10.

FIG. 19 is a block diagram of pump 10. Fluid displacement members 20, motor 22, drive mechanism 24, controller 26, and user interface 27 are shown. Motor 22 includes stator 28 and rotor 30. Controller 26 includes control circuitry 272 and memory 274.

Motor 22 is disposed within a pump body and is coaxial with the fluid displacement members 20 of pump 10 in the example shown. Controller 26 is operably connected to motor 22 to control operation of motor 22. While motor 22 and fluid displacement members 20 are shown as coaxial, it is understood that, in some examples, rotor 30 can be configured to rotate on a motor axis that is not coaxial with a reciprocation axis of the fluid displacement members 20. In addition, each fluid displacement member 20 can be configured to reciprocation on its own reciprocation axis that is not coaxial with the reciprocation axis of the other fluid displacement member 20. It is further understood that, while pump 10 is shown as including two fluid displacement members 20, some examples of pump 10 can include a single fluid displacement member or more than two fluid displacement members.

Motor 22 is an electric motor having stator 28 and rotor 30. Stator 28 includes armature windings and rotor 30 includes a permanent magnet array, such as permanent magnet array 86 (best seen in FIG. 17B). Rotor 30 is configured to rotate about pump axis PA-PA in response to current through stator 28, which can be referred to as current, voltage, or power. It is understood that a reference to the term "current" can be replaced with a different measure of power such as voltage or the term "power" itself.

Position sensor 62 is disposed proximate rotor 30 and is configured to sense rotation of rotor 30 and to generate data in response to that rotation. In some examples, position sensor 62 includes an array of Hall-effect sensors disposed proximate rotor 30 to sense the polarity of permanent magnets forming the permanent magnet array of rotor 30. Controller 26 commutates motor 22 based on data generated by position sensor 62.

The position sensor 62 counts the magnetic sections of rotor 30 as the permanent magnets pass by the position sensor 62, each magnet being detected as the magnetic field measured by the position sensor 62 increases above a threshold and then decreases back below the threshold, the threshold corresponding to the position sensor being proximate a magnet. The controller can be configured to know what number of passing magnetic sections corresponds with what angular displacement of the rotor 30, a full turn of the rotor 30, linear displacement of the screw 92 (and fluid displacement member 20), and/or portion of a pump cycle, among other options. The position sensor 62 does not provide information regarding which rotational direction the rotor 30 is spinning, but the controller 26 knows in which direction the rotor 30 is being driven. The controller 26 can then calculate the position of the screw 92 and/or fluid displacement members 20 along pump axis PA-PA based on counting the number of magnets passing the position sensor 62. In some examples, the number of magnet passes is added to a running total when the rotor is driven in a first direction (e.g., one of clockwise and counterclockwise) and subtracted from the running total when the rotor is driven in the opposite direction (e.g., the other of clockwise and counterclockwise).

Motor 22 is a reversible motor in that stator 28 can cause rotor 30 to rotate in either of two rotational directions. Rotor 30 is connected to the fluid displacement members 20 via drive mechanism 24, which receives a rotary output from rotor 30 and provides a linear input to fluid displacement members 20. Drive mechanism 24 causes reciprocation of fluid displacement members 20 along pump axis PA-PA. Drive mechanism 24 can be of any desired configuration for receiving a rotational output from rotor 30 and providing a linear input to one or both of fluid displacement members 20.

Rotating rotor 30 in the first rotational direction causes drive mechanism 24 to displace fluid displacement members 20 in a first axial direction. Rotating rotor 30 in the second rotational direction causes drive mechanism 24 to displace fluid displacement members 20 in a second axial direction opposite the first axial direction. Drive mechanism 24 is directly connected to rotor 30 and fluid displacement members 20 are directly driven by drive mechanism 24. As such, motor 22 directly drives fluid displacement members 20 without the presence of intermediate gearing, such as speed reduction gearing.

Fluid displacement members 20 can be of any type suitable for pumping fluid from inlet manifold 12 to outlet manifold 14. For example, fluid displacement members 20 can include pistons, diaphragms, or be of any other type suitable for reciprocatingly pumping fluid. It is understood that while pump 10 is described as including multiple fluid displacement members 20, some examples of pump 10 include a single fluid displacement member 20.

In some examples, fluid displacement members 20 have a variable working surface area, which is the area of the surface that drives the process fluid. The working surface area can vary throughout the stroke. For example, a flexible member forming at least a portion of fluid displacement member 20, such as membranes 82 (best seen in FIGS. 3A and 3B), can flex to cause the variable working surface area. In some examples, the flexible member can contact a housing, such as fluid covers 18 (best seen in FIGS. 3A and 4A-4C), disposed opposite the flexible member, thereby reducing the working surface area as fluid displacement member 20 proceeds through a pumping stroke. The pressure output by pump 10 depends on the working surface area of the fluid displacement member 20. As the working surface area decrease, less current is required to cause pump 10 to operate at a given speed and pressure.

Controller 26 is configured to store software, implement functionality, and/or process instructions. Controller 26 is configured to perform any of the functions discussed herein, including receiving an output from any sensor referenced herein, detecting any condition or event referenced herein, and controlling operation of any components referenced herein. Controller 26 can be of any suitable configuration for controlling operation of motor 22, gathering data, processing data, etc. Controller 26 can include hardware, firmware, and/or stored software, and controller 26 can be entirely or partially mounted on one or more boards. Controller 26 can be of any type suitable for operating in accordance with the techniques described herein. While controller 26 is illustrated as a single unit, it is understood that controller 26 can be disposed across one or more boards. In some examples, controller 26 can be implemented as a plurality of discrete circuitry subassemblies.

Memory 274 configured to store software that, when executed by control circuitry 272, controls operation of motor 22. For example, control circuitry 272 can include one or more of a microprocessor, a controller, a digital signal processor (DSP), an application specific integrated circuit (ASIC), a field-programmable gate array (FPGA), or other equivalent discrete or integrated logic circuitry. Memory 274, in some examples, is described as computer-readable storage media. In some examples, a computer-readable storage medium can include a non-transitory medium. The term "non-transitory" can indicate that the storage medium is not embodied in a carrier wave or a propagated signal. In certain examples, a non-transitory storage medium can store data that can, over time, change (e.g., in RAM or cache). In some examples, memory 274 is a temporary memory, meaning that a primary purpose of memory 274 is not long-term storage. Memory 274, in some examples, is described as volatile memory, meaning that memory 274 does not maintain stored contents when power to controller 26 is turned off. Examples of volatile memories can include random access memories (RAM), dynamic random access memories (DRAM), static random access memories (SRAM), and other forms of volatile memories. Memory 274, in one example, is used by software or applications running on control circuitry 272 to temporarily store information during program execution. Memory 274, in some examples, also includes one or more computer-readable storage media. Memory 274 can further be configured for long-term storage of information. Memory 274 can be configured to store larger amounts of information than volatile memory. In some examples, memory 274 includes non-volatile storage elements. Examples of such non-volatile storage elements can include magnetic hard discs, optical discs, floppy discs, flash memories, or forms of electrically programmable memories (EPROM) or electrically erasable and programmable (EEPROM) memories.

User interface 27 can be any graphical and/or mechanical interface that enables user interaction with controller 26. For example, user interface 27 can implement a graphical user interface displayed at a display device of user interface 27 for presenting information to and/or receiving input from a user. User interface 27 can include graphical navigation and control elements, such as graphical buttons or other graphical control elements presented at the display device. User interface 27, in some examples, includes physical navigation and control elements, such as physically actuated buttons or other physical navigation and control elements. In general, user interface 27 can include any input and/or output devices and control elements that can enable user interaction with controller 26.

Pump 10 can be controlled based on any desired output parameter. In some examples, pump 10 is configured to provide a process fluid flow based on a desired pressure, flow rate, and/or any other desirable operating parameter. In some examples, pump 10 is configured such that the user can control operation of pump 10 based on an operating capacity of pump 10. For example, the user can set pump 10 to operate at 50% capacity, during which a target operating parameter, such as speed and/or pressure, is half of a maximum operating parameter. In some examples, pump 10 does not include a fluid sensor, such as a pressure sensor or flow rate sensor. In some examples, the pumping system including pump 10 does not include a fluid sensor disposed downstream of pump 10. In some examples, the pumping system does not include a fluid sensor disposed upstream of pump 10.

Controller 26 controls operation of pump 10 to drive reciprocation of fluid displacement members 20 at a target speed and to output fluid at a target pressure. Pump 10 can include closed-loop speed control based on data provided by position sensors 62. Position sensors 62 sense rotation of rotor 30 and a rotational speed of rotor 30 can be determined based on the data from position sensors 62. The rotational speed can provide the axial displacement speed of fluid displacement members 20. As such, position sensor 62 can also be considered as a speed sensor. The ratio of rotational speed to axial speed is known based on the configuration of the drive mechanism. When utilizing a drive mechanism having a screw, such as drive mechanism 24 having screw 92 (best seen in FIGS. 4A and 12), axial speed is a function of rotational speed and the lead of screw 92. Controller 26 can operate pump 10 such that the actual speed does not exceed the target speed. The speed corresponds to flow rate output by pump 10. As such, a higher speed provides a higher flow rate while a lower speed provides a lower flow rate.

Controller 26 controls the pressure output of pump 10 by controlling the current flow to pump 10. Motor 22 has a maximum operating current. Controller 26 is configured to control operation of motor 22 such that the maximum current, which can be either the maximum operating current or target operating current, is not exceeded. Controller 26 current-limits pump 10 such that the current applied to motor does not exceed the maximum current. The current provided to motor 22 controls the torque output by motor 22, thereby controlling the pressure and flow rate output by pump 10.

The target pressure and target speed can be provided to controller 26 by user interface 27. In some examples, the target pressure and target speed can be set by a single input to controller 26. For example, user interface 27 can include a parameter input that provides both pressure commands and speed commands to controller 26. For example, user interface 27 can be or include a knob that the user can adjust to set the operating parameters of pump 10, the knob forming the parameter input. It is understood, however, that the parameter input can be of any desired configuration, including analog or digital slider, scale, button, knob, dial, etc. Adjusting the parameter input provides both pressure commands and speed commands to controller 26 to set the target pressure and target speed. The pressure and speed can be linked together to change proportionally to each other when the input is set/adjusted. For example, adjusting the parameter input to increase the target pressure will also increase the target speed, while adjusting the parameter input to decrease the target pressure will also decrease the target speed. One input thereby results in a change to both the pressure threshold and the speed threshold. The user can thereby adjust both pressure and speed at a single instance in time by providing the single input to the controller 26 by the parameter input.

During operation, controller 26 regulates power to stator 28 to drive rotation of rotor 30 about pump axis PA-PA. Controller 26 provides up to the maximum current and drives rotation of rotor 30 up to the target operating speed. Controller 26 can control voltage to control the speed of rotor 30. The current through motor 12 determines the torque exerted on rotor 30, thereby determining the pressure output by pump 10. If the target operating speed is reached, then controller 26 continues to provide current to motor 22 to operate at the target operating speed. If the maximum current is reached, then motor 22 can continue to operate at that maximum current regardless of the actual speed. Pump 10 is thereby configured to pump process fluid at a set pressure. Pump 10 can operate according to a constant pressure mode.

Pump 10 is operable in a pumping state and a stalled state. Pump 10 can maintain constant process fluid pressure throughout operation. In some examples, pump 10 is configured to output process fluid at about 100 pounds per square inch (psi). In the pumping state, controller 26 provides current to rotor 30 and rotor 30 applies torque to drive mechanism 24 and rotates about pump axis PA-PA, causing fluid displacement member 20 to apply force to the process fluid and displace axially along pump axis PA-PA. In the stalled state, rotor 30 applies torque to drive mechanism 24 and does not rotate about pump axis PA-PA, such that fluid displacement member 20 applies force to the process fluid and does not displace axially along pump axis PA-PA. A stall can occur, for example, when pump 10 is deadheaded due to the closure of a downstream valve. Pump 10 continues to apply pressure to the process fluid when pump 10 is stalled. As such, motor 22 is powered with pump 10 in either the pumping state or in the stalled state.

Controller 26 supplies current to stator 28 such that rotor 30 applies torque to drive mechanism 24, causing fluid displacement member 20 to continue to exert force on the process fluid. In the stalled state, controller 26 causes a continuous flow of current to motor 22 causing rotor 30 to apply continuous torque to drive mechanism 24. Controller 26 can determine if motor 22 is stalled based on data provided by position sensor 62 indicating whether rotor 30 is rotating. Drive mechanism 24 converts the torque to a linear driving force such that drive mechanism 24 applies continuous force to fluid displacement member 20. Rotor 30 does not rotate during the stall due to the back pressure in the system being greater than the target pressure. Rotor 30 applies torque with zero rotational speed when pump 10 is in the stalled state. Pump 10 is entirely mechanically driven in that rotor 30 mechanically causes fluid displacement members 20 to apply pressure to the process fluid during the stalled state. Pump 10 does not include any internal working fluid for applying force to fluid displacement members 20. The pressure applied is electromechanically generated, by motor 22 and drive mechanism 24, not fluidly generated by compressed air or hydraulic fluid. Controller 26 can provide more power to motor 22 with motor 22 rotating than when the motor 22 is stalled. Current can remain constant both in the stall and when rotating, but voltage can change to alter the speed. As such, voltage is at a minimum when at zero speed and with pressure at the desired level, because no additional speed is required to get to pressure. Voltage increases to increase the speed of motor 22, resulting in additional power during rotation. As the motor 22 is commutated, power is applied according to a sinusoidal waveform. For example, motor 22 can receive AC power. For example, the power can be provided to the windings of the motor 22 according to an electrically offset sinusoidal waveform. For example, a motor with three phases can have each phase receive a power signal 120-degrees electrically offset from each other. With motor 22 stalled, the signals are maintained at the point of stall such that a constant signal is provided with motor 22 in the stalled state. As such, at least one phase of motor 22 can be considered to receive a DC signal with motor 22 in the stalled state. Motor 22 can thereby receive two types of electrical signals during operation, a first during rotation and a second during stall. The first can be sinusoidal and the second can be constant. The first can be AC and the second can be considered to be DC. The first power signal can be greater than the second power signal.

The continuous current flow regulated by controller 26 causes pump 10 to apply continuous pressure to the process fluid via fluid displacement members 20. The pressure setting of the motor can correspond with the amount of current (or other measure of power) supplied to the motor, such that a higher pressure setting corresponds with greater current and a lower pressure setting correspond with lesser current. In some examples, a set current can be provided to motor 22 throughout the stall such that the pump 10 can apply a continuous uniform force on the process fluid. For example, the maximum current can be provided to motor 22 throughout the stall. In some examples, controller 26 can vary the current provided to motor 22 during the stalled state. For example, the current can be pulsed such that current is constantly supplied to stator 28, but at different levels. As such, pump 10 can apply continuous and variable force to the process fluid. In some examples, the current can be pulsed between the maximum current and one or more currents lesser than the maximum current. For example, controller 26 can maintain the current at a lower level and then pulse the current to the maximum based on a schedule, among other options. Pump 10 returns to the pumping state when the back pressure of the process fluid drops sufficiently such that the current provide to motor 22 can cause rotation of rotor 30. Pump 10 thereby returns to the pumping state when the force exerted on the process fluid overcomes the back pressure of the process fluid.

Controller 26 can be configured to operate motor 12 in both a constant current mode and a pulsed current mode during the stalled state. For example, controller 26 can initially supply a constant, steady current to the motor 12 when in the stalled state. The constant, steady current can be supplied for a first period of the stalled state. The controller 26 can provide pulsed current to the motor 12 during a second period of the stalled state. For example, the first period can be associated with a first amount of time (e.g., 5 seconds, 30 seconds, 1 minute, etc.) during which the constant, steady current is supplied. If the pump 10 remains stalled after the first periods times out, then controller 26 can supply the pulsed current.

A stall occurs when the driving force on the rotor equals the reaction force of the downstream fluid from one of the two fluid displacement members and the hydraulic resistance to suction of fluid from the other one of the two fluid displacement members. The pump exits the stall when the downstream pressure decreases, such that the forces are no longer in balance and the rotor overcomes the forces acting on the first and second fluid displacement members. It is understood that the pump may not include a pressure sensor that measures downstream fluid pressure and provides feedback to the controller. Rather, pressure is controlled based on a user setting corresponding to a level of current (or other level of power) supplied to the motor and whether that level is able to overcome the downstream pressure.

Stalling pump 10 in response to process fluid back pressure provides significant advantages. The user can deadhead pump 10 without damaging the internal components of pump 10. Controller 26 regulates to the maximum current, causing pump 10 to output a constant pressure. Pump 10 continuously applies pressure to the process fluid, allowing pump 10 to quickly resume operating and outputting constant pressure when the downstream pressure is relieved. Pulsing the current during a stall reduces heat generated by stator 28 and uses less energy.

As discussed above, fluid displacement members 20 can have variable working surface areas. As the working surface area changes, the current required to drive rotor 30 to output the desired pressure changes. The current provided to motor 22 gives the torque applied by rotor 30, which torque translates to force applied across the working surface area of the fluid displacement member 20, which provides the pressure output. The current required to maintain a target pressure output thereby decreases as the working surface area decreases. As such, less current is required when the working surface area is smaller, such as at the end of a pumping stroke, than when the working surface area is larger. In some examples, the working surface area of fluid displacement members 20 can change by up to 50%. In some examples, the working surface area of the fluid displacement members 20 can change by up to 30%. In some examples, the working surface area of the fluid displacement members 20 can change by at least 10%. In some examples, the working surface area of the fluid displacement members 20 can change by 20-30%.

Controller 26 is configured to vary the current supplied to motor 22 to compensate for a variable working surface area of fluid displacement member 20. As the working surface area decreases, controller 26 reduces the current supplied to stator 28 to maintain the constant pressure output by pump 10. Controller 26 provides the most current for a stroke during the portion of the stroke when fluid displacement member 20 has the largest working surface area. In some examples, the working surface area of fluid displacement member 20 is largest when fluid displacement member 20 is beginning a pumping stroke. In some examples, the working surface area of fluid displacement member 20 is largest at the end of a pumping stroke. The working surface area of fluid displacement member 20 changes as fluid displacement member 20 proceeds through the stroke. Controller 26 decreases the current provided to motor 22 as fluid displacement member 20 proceeds through a pumping stroke if the working surface area of fluid displacement member 20 decreases through the pumping stroke. Controller 26 increases the current provided to motor 22 as fluid displacement member 20 proceeds through the pumping stroke if the working surface area of fluid displacement member 20 increases through the pumping stroke. Controller 26 provides the least current for that stroke when the working surface area is smallest.

In some examples, the working surface area variation can be stored in memory 274 such that controller 26 varies the current based on data recalled from memory 274. Controller 26 can be configured to cross-check the position of fluid displacement member 20 with data from a position sensor, such as position sensor 62, so that the current can be varied based on the phase of the stroke to account for greater/lesser working surface area of the fluid displacement member 20 in that phase of the stroke. In some examples, controller 26 varies the current based on target operating speed of rotor 30. Controller 26 is compensating for the variation in the working surface area during operation by varying the current supplied to motor 22. As such, pump 10 is configured to provide a constant downstream pressure regardless of the working surface area of fluid displacement members 20.

During operation, controller 26 axially locates and manages a stroke length of fluid displacement members 20. As discussed above, the axial displacement rate of fluid displacement members 20 is a function of rotation rate of rotor 30. In examples including screw 92, the axial displacement rate is a function of the rotation rate and the lead of screw 92. In some examples, pump 10 does not include an absolute position sensor for providing the axial location of reciprocating components. As such, controller 26 can axially locate the reciprocating components.

On system start up, controller 26 can operate in a start-up mode. In some examples, controller 26 causes pump 10 to operate according to a priming routine on system start up. Pump 10 can initially be dry and requires priming to operate effectively. During the priming routine, controller 26 regulates the speed of pump 10 to facilitate efficient priming. For example, controller 26 can control the speed of pump 10 based on a priming speed. The priming speed can be stored in memory 274 and recalled for the priming routine. The priming speed can be based on the target speed set for pump 10 or can be disconnected from the target speed. Controller 26 causes pump 10 to operate based on the priming speed to prime pump 10. After the priming routine is complete, controller 26 exits the priming routine and resumes normal control of motor 12. For example, after exiting the priming routine controller 26 can control the speed based on the target speed rather than the priming speed. Controller 26 can be configured to exit the priming routine based on any desired parameter. For example, controller 26 can be configured to exit the operating routine based on a threshold time, number of revolutions of rotor 30, number of pump cycles or strokes, the current draw of motor 12, etc. In some examples, controller 26 can actively determine when to exit the priming routine, such as where controller 26 exits the priming routine based on the current draw to motor 12. For example, controller 26 can determine that pump 10 has been primed based on increased current draw or a spike in current, which indicates that pump 10 is pumping against pressure.

In some examples, controller 26 causes pump 10 to operate according to an initialization routine on start-up, during which controller 26 axially locates fluid displacement members 20 within pump 10. Controller 26 locates fluid displacement members 20 and controls the stroke of fluid displacement members 20. Controller 26 axially locates fluid displacement members 20 relative to mechanical stops that define axial limits of a pump stoke. A mechanical stop can be the mechanical engagement of pump parts. For example, the mechanical stops can be points of contact between outer plates 80 (best seen in FIG. 4A) and the inner surfaces of fluid covers 18 (best seen in FIGS. 3A and 4A), among other options. Controller 26 can determine the axial location of fluid displacement members 20 based at least in part on the current provided to motor 22.

Controller 26 determines when fluid displacement members 20 encounter a mechanical stop based on a current spike occurring. A current spike occurs when the current provided to motor 22 reaches the maximum current. However, current spikes can occur when either a mechanical stop or a fluid stop are encountered. The mechanical stop, which can also be referred to as a hard stop, defines an axial limit of travel.

A fluid stop, which can also be referred to as a soft stop, is caused by increased back pressure that occurs due to increased fluid resistance. For example, a fluid stop is not attributable to the mechanical engagement of pump, but increased hydraulic resistance of process fluid downstream of the fluid displacement member. For example, a deadhead condition in which process fluid has no outlet can quickly result in current rise in the motor (beyond the current level the controller is programmed to provide at the current input setting) corresponding to a fluid stop. The mechanical stops provide useful data for determining a target stroke length. Fluid stops can occur at any point along the stroke due to increased back pressure.

Controller 26 is configured to positively identify stops as mechanical stops prior to exiting the start-up mode and beginning pumping. In some examples, a stop is classified as a fluid stop until threshold requirements are met for classifying the stop as a mechanical stop. Controller 26 can further determine whether the measured stroke length is a true stroke length that can be utilized during pumping based on the relative locations of stops.

A stop occurs when motor 22 applies torque to drive mechanism 24 without causing any rotation due to the stop. If any displacement is occurring, then a stop has not been encountered and motor 22 continues to drive fluid displacement members 20.

Current is provided to motor 22 to cause axial displacement of fluid displacement members 20 in either axial direction. During the initialization routine, less than the maximum current can provided to motor 22 to maintain axial displacement at a start-up speed slower than a maximum speed. The start-up speed can be less than about 50% of the maximum speed, among other options. Fluid displacement member 20 displaces at less than the maximum speed to prevent impact damage when a mechanical stop is encountered.

Controller 26 locates a first stop. Fluid displacement members 20 shift axially until a stop is encountered, which is indicated at least in part by a current spike detected by controller 26. As discussed above, controller 26 current-limits motor 22 such that motor 22 does not receive current above the maximum current. In some examples, controller 26 utilizes the maximum operating current during the initialization routine and the target operating current during pumping. Controller 26 can ramp the current to the maximum current when the stop is encountered to verify that the stop is a true stop, and not due to fluid pressure greater that the target operating pressure. Ramping the current in response to increased resistance maintains the axial displacement speed at or below the start-up speed. Motor 22 continues to drive axial displacement of fluid displacement members 20 until the first stop is encountered. Controller 26 can save the stop location in memory 274. Controller 26 then determines whether the stop is a mechanical stop.

In some examples, controller 26 can base the stop classification at least in part on whether displacement is sensed relative the stop location. In examples where fluid displacement members 20 are flexible, fluid displacement members 20 can displace beyond the stop location by a detectable distance. For example, membranes 80 (best seen in FIGS. 3A and 4A) allow displacement of fluid displacement members 20 beyond the stop location when force is increased in that axial direction. Fluid displacement members 20 may continue to slightly displace as the current is ramped to the maximum current. In some examples, position sensor 62 facilitates detection of displacement as small as 0.010 centimeters (0.004 inches). Controller 26 can classify the stop as a mechanical stop based on fluid displacement member 20 not displacing beyond the stop location. Controller 26 can determine that the stop is not a mechanical stop based on fluid displacement member 20 displacing beyond the stop location by any distance.

In some examples, controller 26 can classify the stop by probing the stop location. For example, controller 26 can reverse the rotational direction of rotor 30 to run in a second rotational direction to cause axial displacement away from the stop. Controller 26 can then cause rotation in the first rotational direction to drive fluid displacement members 20 back towards the first stop to generate an additional current spike. Controller 26 can compare the stop location associated with the second current spike in the first axial direction to the stop location associated with the first current spike in the first axial direction. Controller 26 can determine whether the stop is a mechanical stop based on a comparison of the stop locations. If, based on data from the position sensor 62, a screw 92 can travel a predetermined distance between two stops, then the two stops can be confirmed as mechanical stops. But if the screw 92 cannot travel that predetermined distance between the two stops, then at least one of the stops must be a fluid stop and controller 26 will cause continued probing to locate the mechanical stops. A suspected stop can then be eliminated by probing the stop location in a subsequent cycle by attempting to move past the stop, and if a current spike is not measured at the stop location on a subsequent stroke, then the suspect stop can be eliminated as a candidate for a mechanical stop due to it being a confirmed as a fluid stop. If the stop locations match, such that the stop locations are identical or differences between the stop locations do not exceed a threshold, then controller 26 can classify the stop as a mechanical stop. In some examples, controller 26 can require a threshold number of matching stop locations prior to classifying the stop as a mechanical stop, such as two, three, four, or more identical stop locations.

In some examples, controller 26 can classify the stop based on a profile of the current spike generated at the stop. The current can rise to the maximum current at different rates depending on whether the stop is a mechanical stop or a fluid stop. Mechanical stops generate a profile having a steeper slope in the current rise due to the mechanical stop preventing any axial displacement beyond the mechanical stop. Fluid stops generate a gentler slope in the current rise due to the fluid stop allowing some axial displacement between when the pressure is initially encountered and the end of axial displacement. In some examples, reference profiles can be stored in memory 274. Controller 26 can classify the stop based at least in part on a comparison of the measured current profile to the reference current profile.

Controller 26 can locate a second stop relative the first stop to measure a stroke length for use during pumping. Controller 26 provides current to motor 22 to cause rotation in a second rotational direction, such that fluid displacement members 20 are driven axially away from the first stop. Controller 26 cause axial displacement until a second stop is encountered, as indicated by a current spike. In some examples, controller 26 determines whether the second stop is a mechanical stop, such as by comparing current profiles, probing the stop location, or absence of relative axial displacement, among other options. In some examples, controller 26 locates the second stop after positively identifying the first stop as a mechanical stop.

In some examples, controller 26 compares the measured stroke length, which is the measured distance between stops, to a minimum stroke length, which can be recalled from memory 274. If the measured stroke length exceeds the minimum stroke length, then controller 26 can classify both stops as mechanical stops and exit the initialization routine. If the measured stroke length is less than the minimum stroke length, then one or both of the stops is not a true mechanical stop and controller 26 can continue to operate according to the initialization routine.

Controller 26 can be configured to exit the initialization routine based on any one or more of controller 26 locating a single mechanical stop, controller locating multiple mechanical stops, and/or a measured stroke length exceeding a reference stroke length, among other options. Controller 26 exits the start-up mode and enters a pumping mode. During the pumping mode, controller 26 provides up to the maximum current to motor 22 to drive reciprocation of fluid displacement members 20 and cause pumping by pump 10. During the pumping mode, controller 26 can control the stroke of fluid displacement members 20 based on the measured stroke length.

If controller 26 cannot positively locate one or more mechanical stops, then controller 26 can continue to operate according to the initialization routine until a mechanical stop is positively located. In some examples, controller 26 can provide a notification to the user, such as via user interface 27, based on controller 26 not positively locating a mechanical stop. For example, controller 26 can generate the alert based on a certain time period passing without completing the initialization routine. The alert can indicate that pump 10 is deadheaded and the downstream pressure should be relieved and/or that pump 10 requires servicing.

Figure 20A:
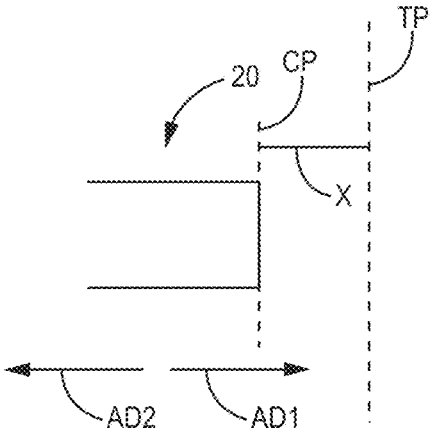
FIG. 20A is a block diagram illustrating a first changeover location relative a target point.
Figure 20B:
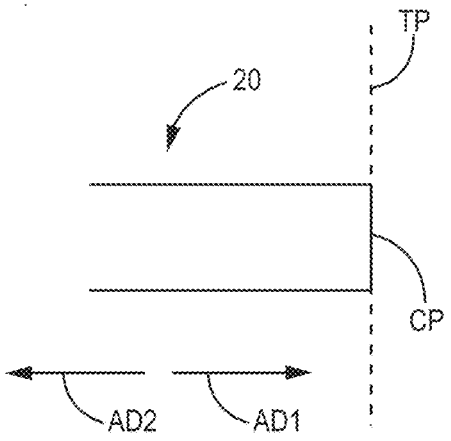
FIG. 20B is a block diagram illustrating a second changeover location relative the target point.
Figure 20C:
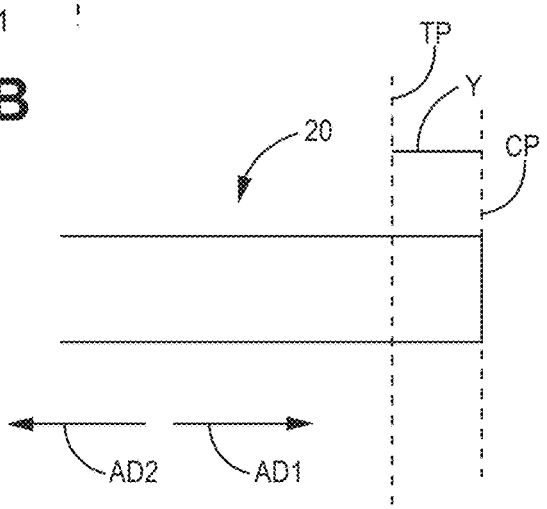
FIG. 20C is a block diagram illustrating a third changeover location relative the target point.

Controller 26 can control the stroke of pump 10 relative a target turnaround point TP during pumping. As best seen in FIGS. 20A-20C and with continued reference to FIG. 19, controller 26 can control the stroke to align fluid displacement member 20 with target point TP when the stroke changes over. FIGS. 20A-20C are schematic diagrams showing the axial location of a fluid displacement member 20 relative target point TP.

Target point TP is a target location at which fluid displacement member 20 stops displacing in a first axial direction and begins displacing in a second axial direction. For example, target point TP can be a location where fluid displacement member 20 completes a pumping stroke and begins a suction stroke. The relative axial location of target point TP can be stored in memory 274.

During changeover, controller 26 causes motor 22 to begin reversing as fluid displacement member 20 approaches target point TP. Controller 26 begins decelerating motor 22 to align fluid displacement member 20 with target point TP when fluid displacement member 20 stops displacing in the first axial direction at changeover. As motor 22 decelerates, fluid displacement member 20 continues to displace in the first axial direction. Controller 26 determines the final location of fluid displacement member 20 relative target point TP and utilizes that information to adjust the stroke length, such as by adjusting the point of deceleration relative target point TP. Controller 26 can thereby adjust and optimize the stroke length during pumping.

As shown in FIGS. 20A-20C, fluid displacement member 20 can undershoot (FIG. 20A), align with (FIG. 20B) or overshoot (FIG. 20C) target point TP during changeover. The stopping distance required to decelerate and reverse the direction of axial displacement varies depending on the process fluid load on fluid displacement members 20. A larger load will speed deceleration of motor 22 as the load provides resistance that assists deceleration. As such, the greatest stopping distance occurs when pump 10 is operating dry, without a process fluid load.

As shown in FIG. 20A, fluid displacement member 20 can undershoot target point TP during a changeover. As show in FIG. 20C, fluid displacement member 20 can overshoot target point TP during a change over. Controller 26 determines the undershoot distance X and/or the overshoot distance Y between target point TP and the actual changeover point CP. Controller 26 adjusts the point of deceleration for a subsequent pump stroke based on the distance X, Y. As such, distances X and Y provide an adjustment factor.

Controller 26 can modify the deceleration point where motor 22 begins to decelerate based on the adjustment factor. In examples where fluid displacement member 20 undershoots target point TP, controller 26 can shift the axial position of deceleration in the first axial direction AD1 and towards target point TP. Controller 26 alters the axial location where deceleration begins such that fluid displacement member 20 begins to decelerate closer to target point TP relative the previous stroke. In the example shown, the axial location can be modified by the undershoot distance X such that fluid displacement member 20 is X distance closer to target point TP when deceleration is initiated relative to the previous stroke.

In examples where fluid displacement member 20 overshoots target point TP, controller 26 can shift the axial point of deceleration in the second axial direction AD2 and towards target point TP. Controller 26 alters the axial location where deceleration initiates such that fluid displacement member 20 begins to decelerate further from target point TP relative the previous stroke. In the example shown, the axial location can be modified by the overshoot distance Y such that fluid displacement member 20 is Y distance closer to target point TP when deceleration is initiated relative to the previous stroke.

Controller 26 can independently optimize the stroke length in each of the first axial direction AD1 and the second axial direction AD2. For example, controller 26 can determine a first adjustment factor for travel in the first axial direction and a second adjustment factor for travel in the second axial direction. Controller 26 can adjust the stroke length in the first axial direction AD1 based on the first adjustment factor and can adjust the stroke length in the second axial direction based on the second adjustment factor.

In some examples, controller 26 can optimize stroke length in only one of the axial directions. For example, controller 26 can determine an adjustment factor for travel in the first axial direction AD1 and drive displacement in the second axial direction based on one of a measured stroke length and a stroke length stored in memory 274. The adjustment factor can be utilized to adjust the axial location of deceleration on the subsequent stroke in the first axial direction AD1.

Controller 26 can continuously optimize the stroke length in the first axial direction AD1 and the second axial direction AD2. For example, controller 26 can determine a first adjustment factor at the end of travel in the first axial direction AD1. Controller 26 can modify the axial location of deceleration for the subsequent stroke in the second axial direction AD2 based on the first adjustment factor. Controller 26 can determine a second adjustment factor at the end of travel in the second axial direction AD2. Controller 26 can modify the return stroke in the first direction AD1 based on the second adjustment factor. Controller 26 can continue to generate adjustment factors and modify the stroke length based on the adjustment factors throughout operation.

In some examples, controller 26 is configured to operate motor 12 in a short stroke mode and a standard stroke mode. During the standard stroke mode, controller 26 can cause the fluid displacement members 20 to displace a full stroke length, as discussed above. During the short stroke mode, controller 26 causes fluid displacement members 20 to have shorter stroke lengths as compared to the full stroke length. For example, controller 26 can control the stroke length to be half (50%) of the full stroke length, among other options (e.g., 25%, 33%, 75% of the full stroke length). Controller 26 thereby controls the stroke length such that the pump stroke occurs in a first displacement range during the standard stroke mode and a second displacement range during the short stroke mode. The second displacement range is shorter than the first displacement range and can be, in some examples, a subset of the first displacement range. For example, the second displacement range can be fully disposed within the first displacement range along the reciprocation axis.

Controller 26 can continue to control operation of motor 12 based on the target operating speed during the short stroke mode, such that fluid displacement members 20 continue to shift axially at the same speed. The shorter stroke length results in a greater number of changeovers (where movement changes from a first one of axial directions AD1, AD2 to the other one of axial directions AD1, AD2). In some examples, controller 26 can increase the target operating speed during the short stroke mode to increase the linear displacement speed of fluid displacement members 20 and further increase the changeover rate. The more frequent changeover causes pump 10 to operate according to an increased number of pump cycles per unit time during the short stroke mode as compared to the standard stroke mode. In some examples, controller 26 can increase the displacement rate during the short stroke mode to further increase the changeover rate.

Downstream pressure pulses can be generated during changeover. Controller 26 operating motor 12 in the short stroke mode provides smoother downstream flow. The pressure fluctuation is reduced by the reduction in the stroke length and corresponding increase in changeover rate. Increasing the changeover and decreasing stroke length provides more, smaller pressure fluctuations as compared to the full stroke length, which results in fewer, larger fluctuations. The smaller fluctuations during the short stroke mode are also closer together in time, resulting in a smoother output from pump 10.

Controller 26 can be further configured to determine the existence of a pumping error based on operating parameters of motor 12. A pumping error can be an error associated with the fluid moving/flow regulating components of the pump 10. For example, a diaphragm can experience a leak, a check valve can be stuck closed/open, a check valve can be leaky, etc. During operation, controller 26 monitors operation of motor 12 and can determine an error in the pump 10 based on the data regarding the operating parameters of motor 12. Controller 26 can determine that the error exists based on an unexpected operating parameter. For example, controller 26 can determine that an error has occurred based on the actual operating parameter of the motor 12 differing from an expected value of the operating parameter for a particular phase of a pump cycle or stroke.

In one example, controller 26 can cause reciprocation of a fluid displacement member 20 by motor 12. Controller 26 monitors the current, or other operating parameter of motor 12, such as speed, and determines the status of pump 10 based on the value of that actual parameter. For example, controller 26 may experience an unexpected current draw during a portion of the pump cycle and can determine the existence of an error based on that unexpected current draw for that portion of the pump cycle. At a certain point in the pump cycle, controller 26 can detect an unexpected drop/rise in the current, which can be indicative of an error. At a certain point in the pump cycle, controller 26 can detect an unexpected drop/rise in speed, which can be indicative of an error. Controller 26 can be configured to generate an error code and provide the error information to the user, such as by user interface 27.

In some examples, controller 26 can be configured to determine the existence of a pump error based on the operating parameters experienced during the stroke of a first fluid displacement member compared to the stroke of a second fluid displacement member. The operating parameters for each of the fluid displacement members should be the balanced for the same parts of the monitored strokes. Controller 26 can compare operating parameters during a pumping stroke of the first fluid displacement member relative to operating parameters during a pumping stroke of the second fluid displacement member. Controller 26 can determine the existence of an error based on a variation in the operating parameters experienced during the two strokes. In some examples, controller 26 can compare the variation to a threshold and determine the existence of an error based on a magnitude of the variation reaching or exceeding the threshold. In some examples, controller 26 can determine a difference in load experienced by the fluid displacement members 20, such as based on the current feedback, and determines the existence of an error based on those differences. The controller 26 can base the comparison on the operating parameters experienced at the same point in the pump cycle for each fluid displacement member 20. For example, the controller 26 can compare the operating parameters for a first diaphragm at the beginning of its pumping stroke to the operating parameters for a second diaphragm at the beginning of its pumping stroke.

For example, if the second diaphragm has a leak through the diaphragm or a leaky inlet valve, then less current draw will be experienced during the pressure stroke of the second diaphragm due to the leaking fluid. Controller 26 can sense the differences in load between the first and second diaphragms and determine the existence of an error based on that comparison. While controller 26 is described as detecting errors based on current, it is understood that controller 26 can be configured to detect errors based on any desired operating parameter. For example, controller 26 can determine the existence of a pump error based on the actual speed experienced during the two pump strokes. Monitoring motor operating parameters to determine errors facilitates error detection without requiring calibration. The direct comparison can indicate an error based on variations experienced during pumping.

Figure 21:
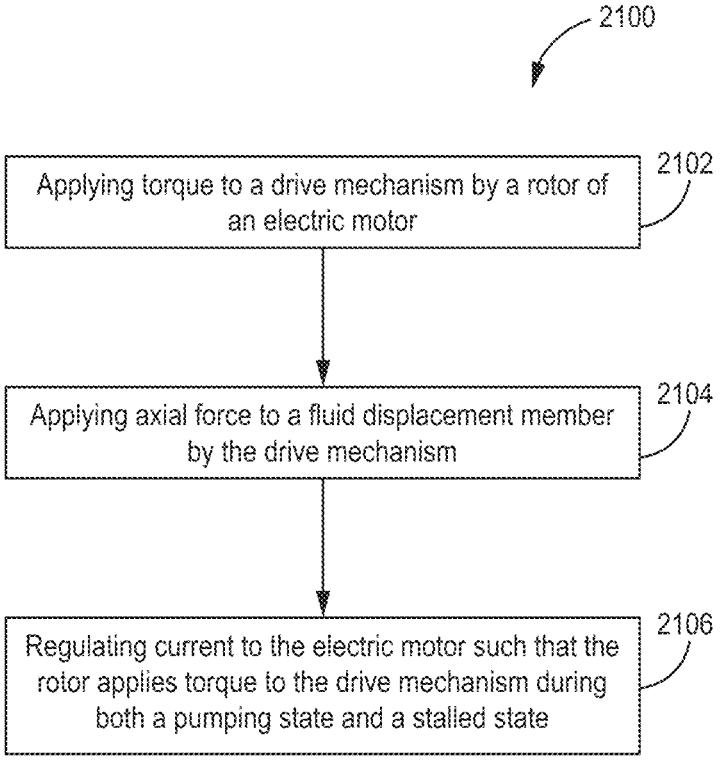
FIG. 21 is a flowchart illustrating a method of operating a reciprocating pump.

FIG. 21 is a flowchart illustrating method 2100. Method 2100 is a method of operating a reciprocating pump, such as pump 10 (best seen in FIGS. 3A-4D). In step 2102 an electric motor, such as electric motor 22 (FIGS. 4A-4D), applies torque to a drive mechanism, such as drive mechanism 24 (best seen in FIG. 12), drive mechanism 24' (FIG. 13), or drive mechanism 24" (FIG. 14).

In step 2104, the drive mechanism applies an axial force to a fluid displacement member, such as fluid displacement members 20 (best seen in FIGS. 3A and 4A), fluid displacement member 20' (FIG. 7), or fluid displacement member 20" (FIG. 10). The fluid displacement member can be disposed coaxially with the rotor such that the rotor rotates about a pump axis that the fluid displacement member reciprocates along.

In step 2106, a controller, such as controller 26 (FIGS. 1C and 19), regulates current flow to the motor. The current is applied to cause the rotor, such as rotor 30 (best seen in FIGS. 3A-4C and 12), to apply the torque to the drive mechanism, such as drive mechanism 24 (best seen in FIG. 12), drive mechanism 24' (FIG. 13), or drive mechanism 24" (FIG. 14). The controller regulates the current such that current is supplied both when the pump is in a pumping state and when the pump is in a stalled state. In the pumping state, the rotor is rotating and the fluid displacement member is displacing axially. In the stalled state, a back pressure on the fluid displacement member prevents the fluid displacement member from displacing axially and the rotor from rotating.

The controller causes current to be continuously provided to motor such that rotor applies torque to the drive mechanism throughout the pumping and stalled states. As such, the fluid displacement member continues to apply force to the pumped fluid. In some examples, the controller can vary the current to the electric motor. For example, the controller can cause the current to be pulsed to the motor during the stalled state. The pulsed current causes the rotor to apply varying amounts of torque, but the rotor continues to apply some torque throughout the stall.

Once the back pressure drops below the target pumping pressure, the fluid displacement member can shift axially. The pump is thus in the pumping state. The controller can regulate current to the motor during the pumping state to operate the pump at the target pressure.

Method 2100 provides significant advantages. The user can deadhead the pump without damaging the internal components of the pump. The controller regulates to the maximum current, causing the pump to output at a target pressure. The pump continuously applies pressure to the process fluid in both the pumping state and the stalled state, thereby facilitating the pump quickly resuming pumping when the back pressure is relieved. The pump begins operating in the pumping mode when the back pressure drops below the target pressure. Pulsing the current during a stall reduces heat generated during the stall and conserves energy.

Figure 22:
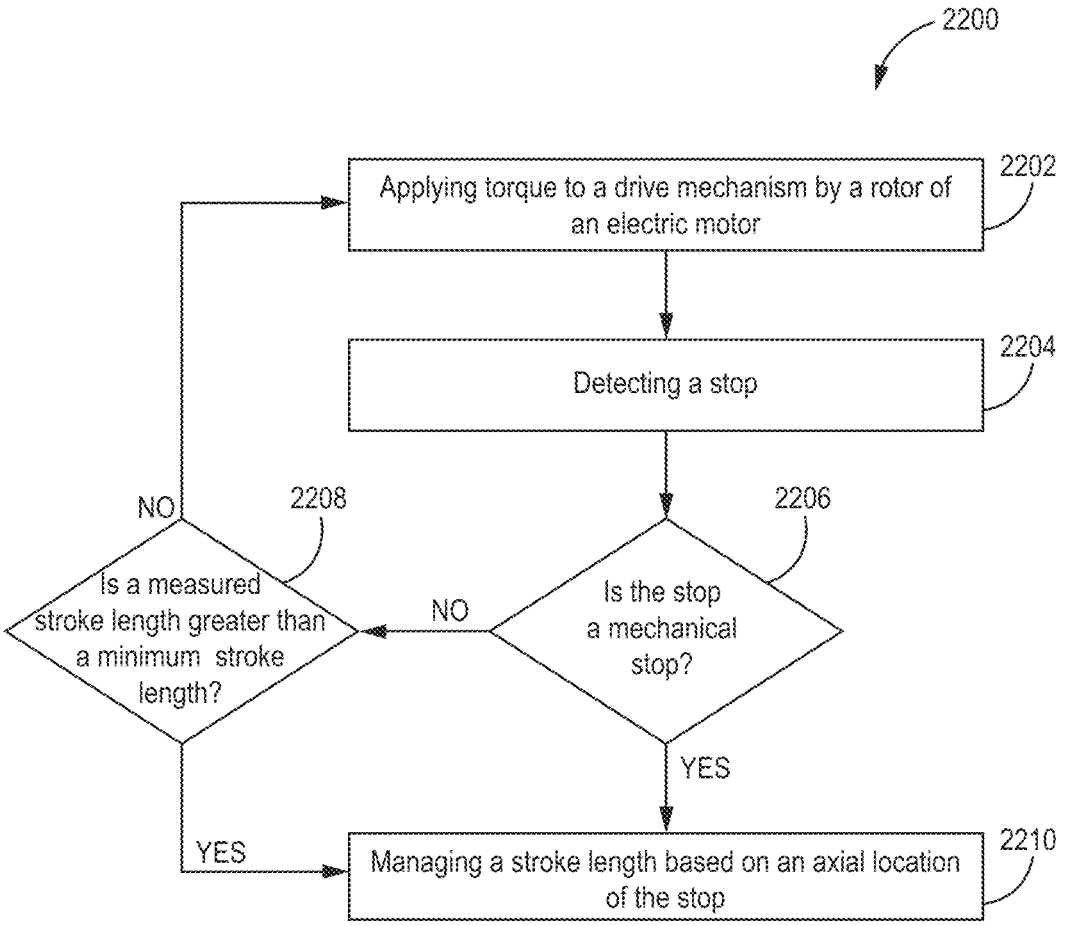
FIG. 22 is a flowchart illustrating a method of operating a reciprocating pump.

FIG. 22 is a flowchart illustrating method 2200. Method 2200 is a method of operating a pump, such as pump 10 (best seen in FIGS. 3A-4D). In step 2202 an electric motor, such as electric motor 22 (FIGS. 4A-4D), drives a fluid displacement member, such as fluid displacement members 20 (best seen in FIGS. 3A and 4A), fluid displacement member 20' (FIG. 7), or fluid displacement member 20" (FIG. 10), axially on a pump axis. Method 2200 can be implemented at any point during pumping. In some examples, method 2200 is a start-up routine that occurs when the pump is initially powered and prior to entering a pumping state.

In step 2204 a stop is detected by a controller, such as controller 26 (FIGS. 1C and 19). A stop can be detected based on the controller detecting a current spike and based on the fluid displacement member stopping axial displacement. A current spike occurs when the current supplied to the motor rises to a maximum current. If a current spike is detected but fluid displacement member is still shifting axially, then a stop has not been encountered.

In step 2206, the controller determines whether the stop is a mechanical stop or a fluid stop. A mechanical stop is a stop that physically defines a stroke limit of the fluid displacement member. For example, the mechanical stop can be an axial location where the fluid displacement member contacts an inner surface of a fluid cover, such as fluid covers 18 (best seen in FIGS. 3A and 4A). A fluid stop is caused by increased back pressure in the system. Fluid stops can occur at any axial location along the stroke. The controller can determine whether the stop is a mechanical stop in any desired manner. For example, the controller can cause displacement in a second axial direction until another stop is encountered. The controller can compare a distance between the first and second stops to determine a measured stroke length and can further compare that measured stroke length to a minimum and/or other reference stroke length. The controller can drive the fluid displacement member in the first axial direction multiple times to generate a plurality of stop locations in that first axial direction. The plurality of stop locations can be compared to determine the stop type. The controller can compare the slope of a current profile of the current spike to a reference profile to determine the stop type. It is understood that the stop type can be identified in any desired manner.

If the answer in step 2206 is NO, such that the stop cannot be positively identified as a mechanical stop, then method 2200 proceeds to step 2208. If the answer in step 2206 is YES, then method 2200 proceeds to step 2210.

In step 2208, the controller determines if a measured stroke length, between two stops encountered in opposite axial directions, is greater than a minimum stroke length. If the answer in step 2208 is NO, then method proceeds back to step 2202 and the controller continues searching for the locations of mechanical stops. If the answer in step 2208 is YES, then method 2200 proceeds to step 2210.

In step 2210, the controller manages a stroke length based on the axial location of one or more stops. For example, the controller can control the stroke length to prevent the fluid displacement member from contacting the mechanical stop. In some examples, the controller can base the stroke length on the minimum stroke length and a single stop. In some examples, the controller can locate multiple mechanical stops and manage the stroke length between those two mechanical stops.

Method 2200 provides significant advantages. The pump may not include an absolute position sensor such that the axial locations of the fluid displacement members are not known at start up. The controller locates the stops to provide an optimal stroke length and prevent undesired contact between mechanical stops and fluid displacement members. The locations of at least one stop can be positively identified as mechanical stops prior to entering a pumping mode. Positively identifying at least one mechanical stop prevents damage due to false positives, such as fluid stops.

Figure 23:
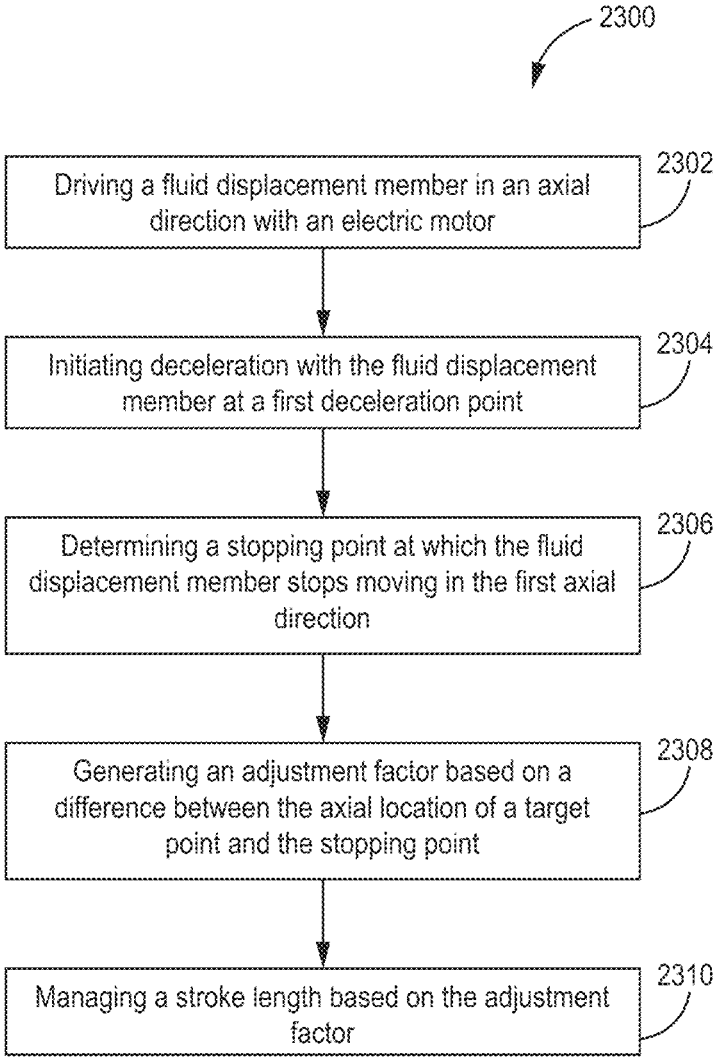
FIG. 23 is a flowchart illustrating a method of operating a reciprocating pump.

FIG. 23 is a flowchart illustrating method 2300. Method 2300 is a method of operating a pump, such as pump 10 (best seen in FIGS. 3A-4C). In step 2302 an electric motor, such as electric motor 22 (FIGS. 4A-4D drives a fluid displacement member, such as fluid displacement members 20 (best seen in FIGS. 3A and 4A), fluid displacement member 20' (FIG. 7), or fluid displacement member 20" (FIG. 10), in a first axial direction on a pump axis.

In step 2304, the controller initiates deceleration of a rotor of the electric motor, such as rotor 30 (best seen in FIGS. 3A-4D and 12). The controller decelerates the rotor as the fluid displacement members approaches the end of a stroke to cause the fluid displacement member to changeover and begin an opposite stroke. The controller initiates deceleration when the fluid displacement member is at an axial location corresponding to a first deceleration point. In step 2306, the controller determines a stopping point for the fluid displacement member. The stopping point is the point at which the fluid displacement member stops displacing in the first axially direction.

The controller controls deceleration and changeover to align the stopping point with a target point. In step 2308, the controller determines an offset between the stopping point and the target point. The controller determines an adjustment factor based on the axial spacing between the stopping point and the target point. In step 2310, the controller manages the stroke length based on the adjustment factor. The controller can adjust a deceleration point where deceleration is initiated based on the adjustment factor. For example, the controller can initiate deceleration at a second deceleration point axially closer to the target point relative the first deceleration point when the fluid displacement member undershot the target point. The controller can initiate deceleration at a second deceleration point axially further from the target point relative the first deceleration point when the fluid displacement member overshot the target point. The controller can be configured to continuously manage the stroke length based on the stopping points and the target points throughout operation. The target points can be at any desired axial location. Continuously monitoring and adjusting the stroke length causes the pump to operate at an optimum stroke. In addition, the stroke length adjustment prevents accumulation of drive errors that can affect the stroke length.

Figure 24:
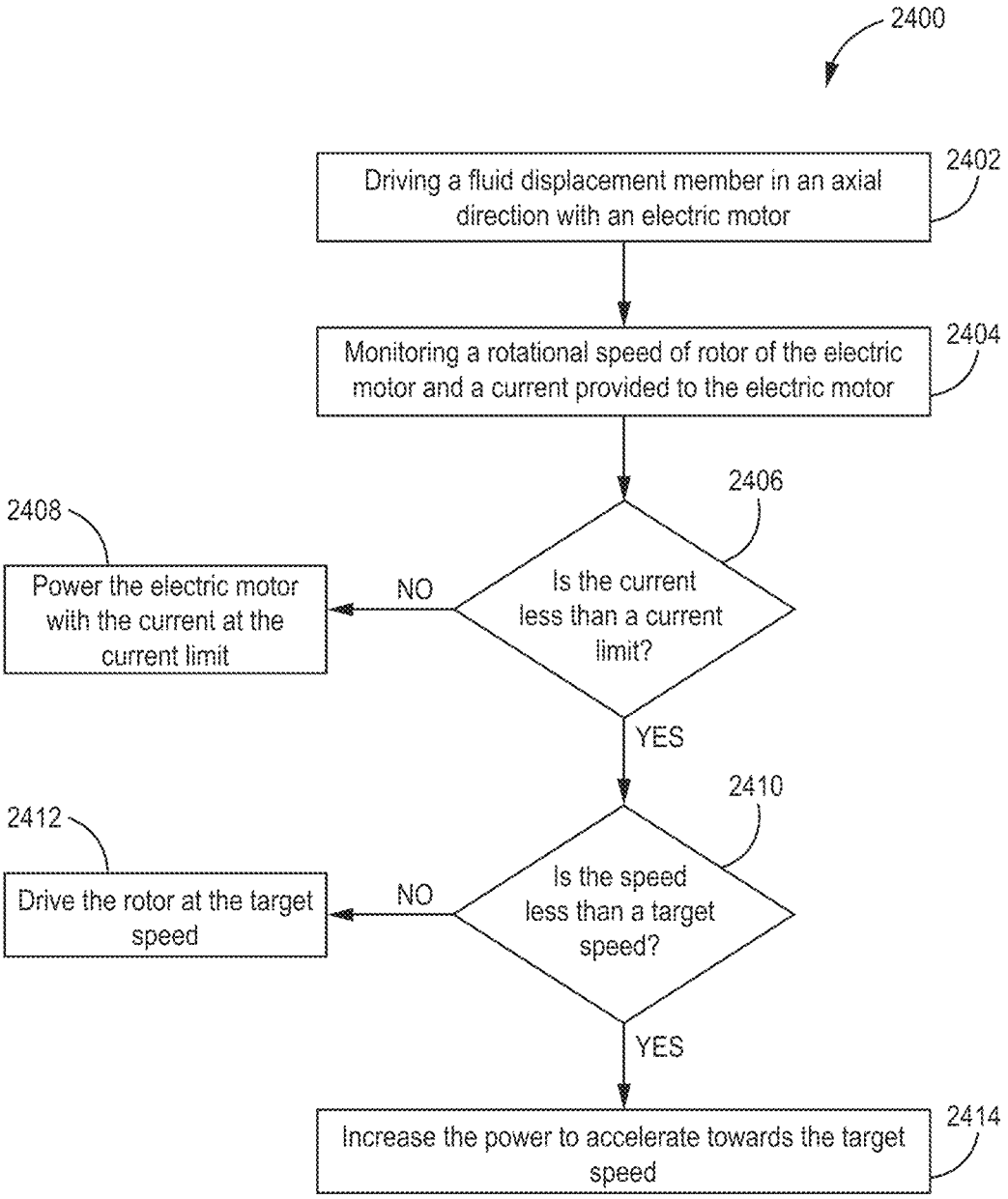
FIG. 24 is a flowchart illustrating a method of operating a reciprocating pump.

FIG. 24 is a flowchart illustrating method 2400. Method 2400 is a method of operating a pump, such as pump 10 (best seen in FIGS. 3A-4C). In step 2402 an electric motor, such as electric motor 22 (FIGS. 4A-4D) drives a fluid displacement member, such as fluid displacement members 20 (best seen in FIGS. 3A and 4A), fluid displacement member 20' (FIG. 7), or fluid displacement member 20" (FIG. 10), in a first axial direction on a pump axis.

In step 2404, a controller, such as controller 26 (FIGS. 1C and 19), monitors a rotational speed of the rotor and a current provided to the electric motor. For example, the controller can determine the rotational speed based on data provided by a position sensor, such as position sensor 62 (best seen in FIGS. 3A, 17A, and 18). The axial displacement speed of the fluid displacement member is a function of the rotational speed of the rotor, such that the rotational speed provides the axial speed. The controller regulates both speed and current to cause the pump to output process fluid at a target pumping pressure.

In step 2406, the controller determines if the current provided to the motor is less than a current limit, which can be a maximum operating current or a target operating current. In some examples, the current limit can change throughout the pumping stroke. For example, the fluid displacement member can have a variable working surface area throughout the pumping stroke. The variable working surface area can increase or decrease as the fluid displacement member is driven through the pumping stroke. As such, less current can be required at the end of the pumping stroke, when the working surface area decreases, than at the beginning of the pumping stroke to achieve the target pumping pressure, or more current can be required at the end of the pumping stroke, when the working surface area increases, than at the beginning of the pumping stroke to achieve the target pumping pressure. The controller can control operation based on a variable current limit. If the answer in step 2406 is NO, such that the actual current is at the current limit, then method 2400 proceeds to step 2408. In step 2408 the controller continues to provide current to the motor at the current limit to operate the pump. If the answer in step 2406 is YES, then method 2400 proceeds to step 2410.

In step 2410, the controller determines if the actual speed is less than a speed limit. The speed limit can be a maximum operating speed or a target operating speed. If the answer in step 2410 is NO, such that the current operating speed is at the speed limit, then method 2400 proceeds to step 2412 and the controller can cause the motor to continue to operate at the current speed. If the answer in step 2410 is YES, then method proceeds to step 2414. In step 2414, the controller increases the power (such as voltage or current) provided to the motor to accelerate the speed of rotor rotation towards the speed limit.

Method 2400 provides significant advantages. In some examples, the pump does not include a pressure sensor. The pump can output process fluid at a target pressure based on the speed of rotation, which correlates to a speed of axial displacement, and the current provided to the motor. The controller controls pumping such that the pump can operate in a constant pressure mode where speed and current are controlled to cause the pump to output at the target pressure. Variable working surface areas of the fluid displacement members can cause pressure variations due to the changing surface area throughout the pump stroke. The controller adjusts the current limit throughout the pump stroke to account for the variable working surface area and cause the pump to operate according to the target pressure.

Figure 25A:
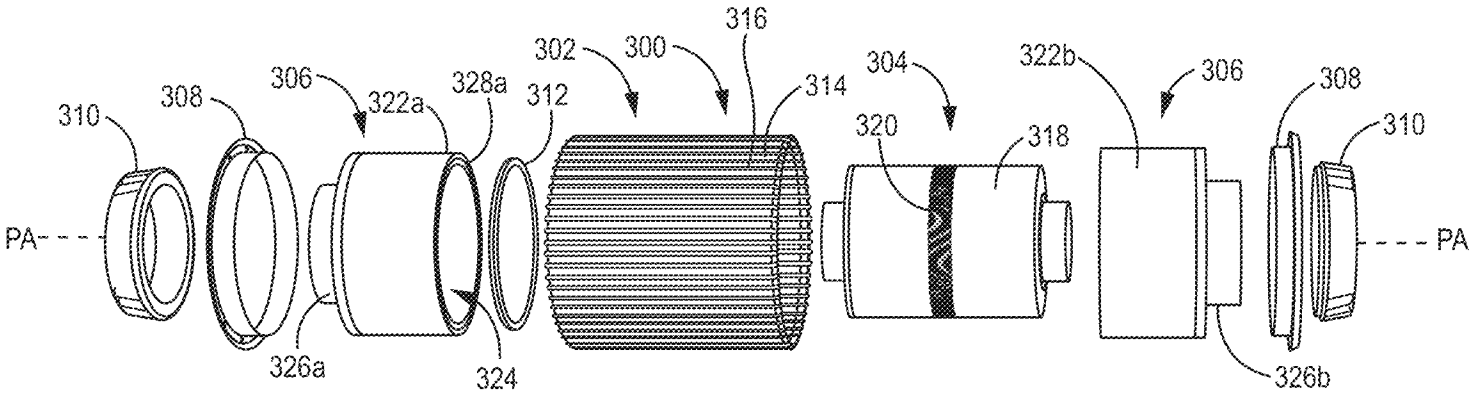
FIG. 25A is an isometric view of a rotor assembly.
Figure 25C:
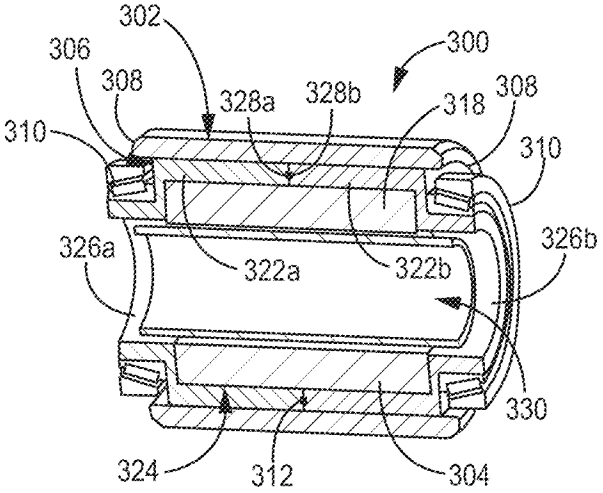
FIG. 25C is a cross-sectional view of the rotor assembly of FIG. 25A.
Figure 25B:
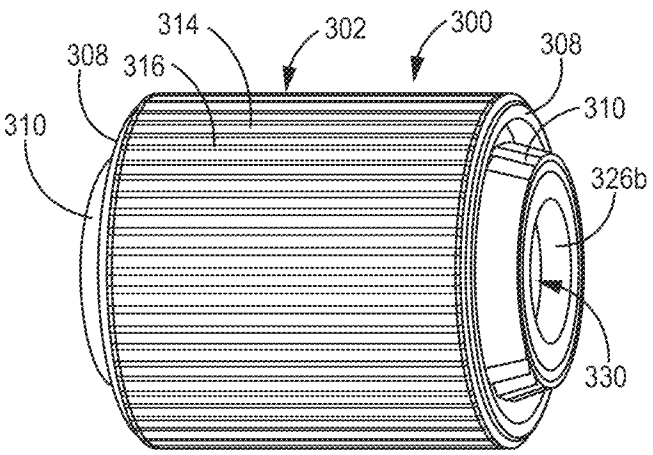
FIG. 25B is an exploded view of the rotor assembly of FIG. 25A.

FIG. 25A is an isometric view of rotor assembly 300. FIG. 25B is an exploded view of rotor assembly 300. FIG. 25C is a cross-sectional view of rotor assembly 300. FIGS. 25A-25C will be discussed together. Rotor assembly 300 is substantially similar to rotor 30 and is configured to rotate about axis PA due to power through a stator, such as stator 28. Rotor assembly 300 includes permanent magnet array 302, drive component 304, rotor body 306, support rings 308, bearings 310, and seal 312. Permanent magnet array 302 includes permanent magnets 314 and back irons 316. Drive component 304 includes body 318, which includes interface strip 320. Rotor body 306 includes body components 322*a*, 322*b* and receiving chamber 324. Body components 322*a*, 322*b* respectively include axial projections 326*a*, 326*b* and seal grooves 328*a*, 328*b*.

Rotor assembly 300 is an assembly configured to form the rotating component of an electric motor, such as motor 22. Rotor body 306 forms a clamshell housing drive component 304. Permanent magnet array 302 is disposed on the outer surface of rotor body 306. Support rings 308 are disposed on opposite axial ends of rotor body 306 and hold permanent magnet array 302 on rotor body 306. Support rings 308 can be secured to rotor body 306 in any desired manner, such as by fasteners, adhesive, or press-fitting, among other options. Permanent magnet array 302 can be fixed to rotor body 306 by adhesive, such as a potting compound. The potting compound can further fix support rings 308 to rotor body 306. It is understood that some examples of rotor assembly 300 do not include support rings 308. Bearings 310 are substantially similar to bearings 54*a*, 54*b* and are disposed on axial projections 326*a*, 326*b* body components 322*a*, 322*b*. Bearings 310 are configured to support both radial and axial loads. For example, bearings 310 can be tapered roller bearings.

Body components 322*a*, 322*b* form the clamshell of rotor body 306 and define receiving chamber 324. Seal 312 is disposed in seal grooves 328*a*, 328*b* and between body components 322*a*, 322*b*. Seal 312 prevents the potting compound from migrating between body components 322*a*, 322*b*.

Drive component 304 is disposed in receiving chamber 324. Receiving chamber 324 is defined by body components 322*a*, 322*b*. Body components 322*a*, 322*b* are fixed to drive component such that drive component 304 rotates with body components 322*a*, 322*b*. Body components 322*a*, 322*b* radially overlap with the axial ends of drive component 304 to axially fix drive component 304 within receiving chamber 324. Drive component 304 does not rotate relative body components 322*a*, 322*b*. For example, body components 322*a*, 322*b* can be press-fit onto body 318 and that interference fit can fix drive component 304 to body components 322*a*, 322*b*. In some examples, drive component 304 is fixed to body components 322*a*, 322*b* by adhesive. It is understood that other fixation options are possible.

Interface strip 320 is disposed circumferentially around body 318 of drive component 304. Interface strip 320 further secures body components 322*a*, 322*b* to drive component 304. For example, interface strip 320 can be knurled, grooved, or of any other configuration suitable for fixing drive component 304 to body components 322*a*, 322*b*. In some examples, interface strip 320 is formed across a full length of body 318. In some examples, drive component 304 does not include interface strip 320.

Drive component 304 can be a drive nut, similar to drive nut 90, configured to provide the rotating component of a drive mechanism, similar to drive mechanisms 24, 24', 24", that converts the rotation of rotor assembly 300 into a linear output. Bore 330 extends axially through rotor assembly 300 and, in the example shown, is defined by drive component 304.

Rotor assembly 300 provides significant advantages. Rotor body 306 being of a clamshell configuration facilitates a larger diameter of drive component 304, and thus a larger diameter of bore 330 through drive component 304. The larger diameter of bore 330 facilitates use of more robust driving components, such as balls and rollers, and facilitates the use of a larger diameter linear displacement member, such as screw 92. A more robust, larger linear displacement member can generate greater pumping pressures and react greater loads.

Figure 26:
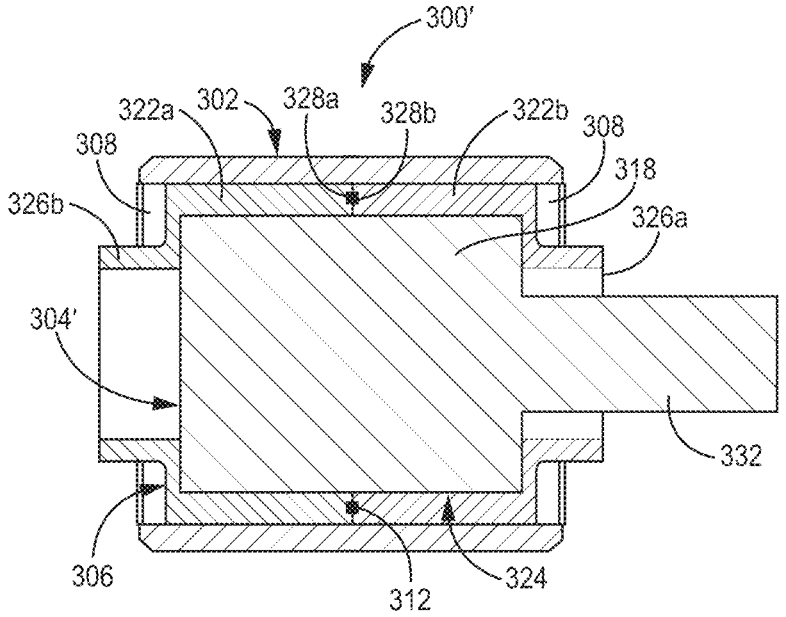
FIG. 26 is a cross-sectional view of a rotor assembly.

FIG. 26 is a cross-sectional view of rotor assembly 300'. Rotor assembly 300' is substantially similar to rotor assembly 300 (FIGS. 25A-25C), except rotor assembly 300' is configured to provide a rotary, instead of linear, output from the motor of rotor assembly 300'. Drive component 304' includes body 318' and shaft 332. Shaft 332 projects beyond an axial end of rotor body 306 and forms an output shaft of rotor assembly 300'. Shaft 332 provides a rotary output from rotor assembly 300'. While drive component 304' is shown as including a single shaft 332, it is understood that drive component 304' can include a second shaft extending from an opposite axial end of drive component 304' from shaft 332.

Figure 27:
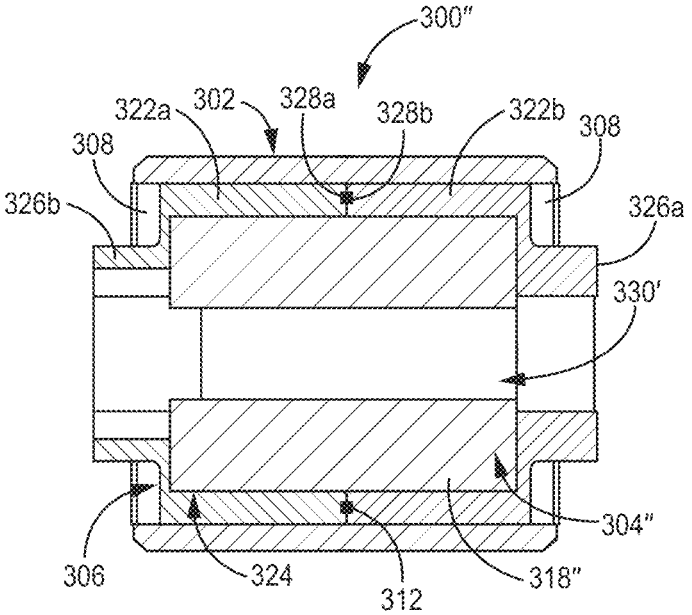
FIG. 27 is a cross-sectional view of a rotor assembly.

FIG. 27 is a cross-sectional view of rotor assembly 300". Rotor assembly 300" is substantially similar to rotor assembly 300' (FIG. 26) and rotor assembly 300 (FIGS. 25A-25C). Similar to rotor assembly 300', rotor assembly 300" is configured to provide a rotary output from the motor of rotor assembly 300". Drive component 304" includes body 318". Body 318" defines bore 330'. Body 318" is configured to receive a shaft within bore 330'. Drive component 304" is configured to transmit rotational forces to drive rotation of the shaft by an interface between the surface of bore 330' and the shaft. For example, the shaft and bore 330' can include a keyed interface or the bore 330' can include a contour configured to interface with a contour of the shaft, among other options.

While the pumping assemblies of this disclosure and claims are discussed in the context of a double displacement pump, it is understood that the pumping assemblies and controls can be utilized in a variety of fluid handing contexts and systems and are not limited to those discussed. Any one or more of the pumping assemblies discussed can be utilized alone or in unison with one or more additional pumps to transfer fluid for any desired purpose, such as location transfer, spraying, metering, application, etc.

DISCUSSION OF NON-EXCLUSIVE EXAMPLES

The following are non-exclusive descriptions of possible embodiments of the present disclosure.

A displacement pump for pumping a fluid comprising an electric motor including a stator and a rotor, the rotor configured to rotate about a pump axis; a fluid displacement member configured to pump fluid by linear reciprocation of the fluid displacement member; and a drive mechanism connected to the rotor and the fluid displacement member, the drive mechanism configured to convert a rotational output from the rotor into a linear input to the fluid displacement member. The drive mechanism includes a screw connected to the fluid displacement member and disposed coaxially with the rotor; and a plurality of rolling elements disposed between the screw and the rotor, wherein the plurality of rolling elements support the screw relative the rotor and are configured to be driven by rotation of the rotor to drive the screw axially.

The displacement pump of the preceding paragraph can optionally include, additionally and/or alternatively, any one or more of the following features, configurations and/or additional components:

The drive mechanism comprises inner threading that rotates with the rotor; and outer threading on the screw; wherein each rolling element of the plurality of rolling elements interfaces with both of the inner threading and the outer threading, and the inner threading does not contact the outer threading.

The screw extends within each of the rotor and the stator; the screw, the plurality of rolling elements, and the rotor are coaxially aligned along the pump axis; and the screw, the plurality of rolling elements, and the rotor are arranged directly radially outward from the pump axis in the order: the screw, then the plurality of rolling elements, and then the rotor.

A first fluid displacement member configured to pump fluid and a second fluid displacement member; wherein the fluid displacement member is the first fluid displacement member; wherein the screw is fixed to both of the first and the second fluid displacement members; and wherein the first and the second fluid displacement members are respectively located on opposite ends of the screw such that the screw is directly between the first and the second fluid displacement members.

The rotor turns in a first rotational direction to drive the screw linearly along the pump axis in a first direction to simultaneously move the first fluid displacement member through a pumping stroke and the second fluid displacement member through a suction stroke, and the rotor turns in a second rotational direction to drive the screw linearly along the pump axis in a second direction to simultaneously move the first fluid displacement member through a suction stroke and the second fluid displacement member through a pumping stroke.

The first fluid displacement member is a first diaphragm, the second fluid displacement member is a second diaphragm, and both the rotor and the plurality of rolling elements are located axially between the first diaphragm and the second diaphragm.

The plurality of rolling elements includes balls.

The plurality of rolling elements includes toothed rollers.

The drive mechanism further includes a drive nut connected to the rotor such that rotation of the rotor drives rotation of the drive nut, and wherein the plurality of rolling elements are disposed between the drive nut and the screw.

The plurality of rolling elements are arranged in an elongate annular array, the annular array of rolling elements disposed coaxially with the fluid displacement member.

The fluid displacement member comprises a diaphragm.

The diaphragm includes a diaphragm plate connected to the screw and a flexible membrane extending radially relative to the diaphragm plate.

The rotor is supported by a first bearing and a second bearing; the first bearing is capable of supporting both axial and radial forces; and the second bearing is capable of supporting both axial and radial forces.

Each bearing includes an array of rollers, each roller orientated along an axis of the roller at an angle such that the axis of the roller is neither parallel nor orthogonal to the axis of the screw.

The first bearing is a tapered roller bearing and the second bearing is a tapered roller bearing.

The first bearing is disposed at a first axial end of the rotor and the second bearing is disposed at a second axial end of the rotor.

A locking nut connected to a stator housing supporting the stator, the locking nut preloading the first and second bearings.

The locking nut is disposed adjacent to the first bearing.

The locking nut engages an outer race of the first bearing.

The locking nut is threadingly connected to the stator housing.

The locking nut includes exterior threading.

The locking nut supports a grease cap of the first bearing.

The first bearing and the second bearing support a drive nut disposed between the plurality of rolling elements and the rotor, wherein the drive nut is connected to the rotor to rotate with the rotor.

The drive nut is connected to a first inner race that forms an inner race of the first bearing and to a second inner race that forms an inner race of the second bearing.

The fluid displacement member includes a first fluid displacement member connected to a first end of the screw and a second fluid displacement member connected to a second end of the screw.

The stator is configured to drive the rotor in both a first rotational direction and a second rotational direction opposite the first rotational direction to drive reciprocation of the screw.

A method of pumping includes driving rotation of a rotor of an electric motor; linearly displacing a screw in a first axial direction such that the screw drives a first fluid displacement member attached to a first end of the screw through a first stroke, wherein the screw is coaxial with the rotor and supported by a plurality of rolling elements disposed between the rotor and the screw, and wherein the first stroke is one of a pumping stroke and a suction stroke; and linearly displacing the screw in a second axial direction opposite the first axial direction by the plurality of rolling elements.

The method of the preceding paragraph can optionally include, additionally and/or alternatively, any one or more of the following features, configurations and/or additional components:

Driving rotation of the rotor includes: rotating the rotor in a first rotational direction to drive the screw in the first axial direction; and rotating the rotor in a second rotational direction opposite the first rotational direction to drive the screw in the second axial direction.

Linearly displacing the screw in the first axial direction further causes the screw to drive a second fluid displacement member attached to a second end of the screw through a second stroke opposite the first stroke.

A displacement pump for pumping a fluid comprising an electric motor disposed in a pump housing, the electric motor comprising a stator and a rotor, the rotor configured to rotate about a pump axis; a fluid displacement member configured to pump fluid by linear reciprocation of the fluid displacement member, the fluid displacement member interfacing with the pump housing such that the fluid displacement member is prevented from rotating relative to the pump housing; and a drive mechanism connected to the rotor and to the fluid displacement member, the drive mechanism comprising a screw connected to the fluid displacement member, the drive mechanism configured to receive rotational output from the rotor and convert the rotational output from the rotor into a linear input to the fluid displacement member to linearly reciprocate the fluid displacement member; wherein the screw is prevented from being rotated by the rotational output by being rotationally fixed with respect to the fluid displacement member.

The displacement pump of the preceding paragraph can optionally include, additionally and/or alternatively, any one or more of the following features, configurations and/or additional components:

A first fluid displacement member configured to pump fluid and a second fluid displacement member; wherein the fluid displacement member is the first fluid displacement member; wherein the screw is rotationally fixed to both of the first and the second fluid displacement members such that the first and the second fluid displacement members prevent rotation of the screw.

The first fluid displacement member comprises a first diaphragm and the second fluid displacement member comprises a second diaphragm.

The fluid displacement member comprises a diaphragm having a diaphragm plate and a membrane extending between the diaphragm plate and the pump housing; wherein the screw is connected to the diaphragm plate and the membrane interfaces with the pump housing.

At least a portion of the membrane is clamped between the pump housing and a fluid cover, and the diaphragm and the fluid cover define a pumping chamber.

The portion of the membrane is an outer edge of the membrane.

The portion of the membrane includes a circumferential bead.

An end of the screw extends into a receiving chamber formed on the diaphragm plate.

The end of the screw includes a first contoured surface and the receiving chamber includes a second contoured surface configured to mate with the first contoured surface to prevent the screw from rotating relative to the diaphragm plate.

A set screw extends into the diaphragm plate and the screw.

The set screw extends axially.

A diaphragm screw extends through the diaphragm plate and into the screw to secure the screw to the diaphragm plate.

An end of the screw extends into a receiving chamber formed on the diaphragm plate and a diaphragm screw extends through the diaphragm plate and into the screw.

The fluid displacement member includes a first fluid displacement member secured to a first end of the screw and a second fluid displacement member secured to a second end of the screw.

A displacement pump for pumping a fluid includes an electric motor disposed in a pump housing and including a stator and a rotor rotatable about a pump axis; a fluid displacement member configured to reciprocate on the pump axis to pump fluid, the fluid displacement member interfacing with the pump housing at a first interface; and a drive mechanism connected to the rotor and to the fluid displacement member and configured to convert a rotational output from the rotor into a linear input to the fluid displacement member, wherein the drive mechanism includes a screw connected to the fluid displacement member at a second interface; wherein the first interface and the second interface prevent the screw from rotating about the pump axis and relative to the fluid displacement member and the pump housing.

The displacement pump of the preceding paragraph can optionally include, additionally and/or alternatively, any one or more of the following features, configurations and/or additional components:

The fluid displacement member includes one of a diaphragm and a piston.

The first interface includes a portion of the fluid displacement member clamped between the pump housing and a fluid cover connected to the pump housing, the fluid cover and the fluid displacement member at least partially defining a process fluid chamber.

The second interface includes a first surface contour at an end of the screw contacting a second surface contour formed on the fluid displacement member.

A method of pumping fluid by a reciprocating pump includes driving rotation of a rotor of an electric motor by a stator of the electric motor; causing, by rotation of the rotor, a screw disposed coaxially with the rotor to reciprocate along a pump axis, the screw driving a fluid displacement member through a suction stroke and a pumping stroke; preventing rotation of the fluid displacement member relative to a pump housing of the pump by a first interface between the fluid displacement member and the pump housing; and preventing rotation of the screw about the axis by the first interface and a second interface between the screw and the fluid displacement member.

The method of the preceding paragraph can optionally include, additionally and/or alternatively, any one or more of the following features, configurations and/or additional components:

Preventing rotation of the fluid displacement member relative to the pump housing of by the interface between the fluid displacement member and the pump housing includes securing a membrane of the fluid displacement member to a pump housing.

Securing the membrane of the fluid displacement member to the pump housing includes clamping a circumferential edge of the membrane between a fluid cover of the pump and the pump housing.

Preventing rotation of the fluid displacement member relative to the pump housing of by the interface between the fluid displacement member and the pump housing includes preventing rotation of a piston by an interface between a first surface contour of the piston and a second surface contour defining at least a portion of a piston bore, wherein the piston forms the fluid displacement member and is configured to reciprocate within the piston bore.

A double diaphragm pump having an electric motor includes a housing; an electric motor comprising a stator and a rotor, the rotor configured to rotate to generate rotational input; a screw that receives the rotational input and converts the rotational input into linear input; a first diaphragm and a second diaphragm, the screw located between the first and second diaphragms, each of the first and second diaphragms receiving the linear input such that each of the first and second diaphragms reciprocate to pump fluid; wherein each of the first and second diaphragms are rotationally fixed by the housing; and wherein the first and second diaphragms are rotationally fixed with respect to the screw such that the screw is prevented from rotating, despite the rotational input, by the first and second diaphragms rotationally fixing the screw.

A displacement pump for pumping a fluid includes an electric motor disposed in a pump housing, the electric motor comprising a stator and a rotor, the rotor configured to rotate about a pump axis; a fluid displacement member configured to pump fluid by linear reciprocation of the fluid displacement member, the fluid displacement member interfacing with the pump housing such that the fluid displacement member is prevented from rotating relative to the pump housing; and a drive mechanism connected to the rotor and to the fluid displacement member, the drive mechanism comprising a screw connected to the fluid displacement member, the drive mechanism configured to receive rotational output from the rotor and convert the rotational output from the rotor into a linear input to the fluid displacement member to linearly reciprocate the fluid displacement member; wherein the screw is prevented from being rotated by the rotational output by an interface between the screw and the pump housing.

The displacement pump of the preceding paragraph can optionally include, additionally and/or alternatively, any one or more of the following features, configurations and/or additional components:

The interface is formed by a projection disposed in a slot, wherein the projection extends from one of the screw and the pump housing, wherein the slot formed in the other one of the screw and the pump housing.

A displacement pump for pumping a fluid includes an electric motor disposed in a pump housing and including a stator and a rotor; a fluid displacement member configured to pump fluid; and a screw connected to the fluid displacement member, the screw operably connected to the rotor such that rotation of the rotor drives linear displacement of the screw along a pump axis. The screw includes a screw body; and a lubricant pathway extending through the screw body and configured to provide lubricant to an interface between the screw and the rotor.

The displacement pump of the preceding paragraph can optionally include, additionally and/or alternatively, any one or more of the following features, configurations and/or additional components:

A drive nut disposed radially between the rotor and the screw body, the drive nut receiving a rotational output from the rotor and driving the screw linearly.

The drive nut includes a plurality of rolling elements disposed between the rotor and the screw, the rolling elements engaging the screw to drive the screw linearly.

The plurality of rolling elements includes at least one of balls and toothed rollers.

The lubricant pathway includes a first bore extending into the screw body and a second bore extending into the screw body and intersecting with the first bore.

The first bore extends into the screw body from a first axial end of the screw body.

The second bore extends on a second bore axis, the second bore axis transverse to the pump axis.

The second bore axis is orthogonal to the pump axis.

The second bore extends between the first bore and an exterior surface of the screw.

An outlet of the second bore is disposed at an end of the second bore opposite the first bore and is intermediate threads of the screw.

A grease fitting is disposed in the first bore and connected to the screw body.

The first bore extends into the screw body from a first axial end of the screw body, and wherein the first bore includes a first diameter portion having a first diameter and extending from the first axial end and a second diameter portion having a second diameter and extending from the first diameter portion, the first diameter being larger than the second diameter.

The grease fitting is disposed at an intersection between the first diameter portion and the second diameter portion.

The fluid displacement member is connected to the screw by a fastener extending into and connecting with the first diameter portion.

The fastener and first diameter portion are connected by interfaced threading.

The second bore has a third diameter smaller than the second diameter.

The fluid displacement member is a first fluid displacement member connected to a first axial end of the screw body, and wherein a second fluid displacement member connected to a second axial end of the screw body.

The screw further comprises a first bore extending into the first axial end of the screw body; and a second bore extending into the second axial end of the screw body; wherein the first bore forms a portion of the lubricant pathway.

A grease fitting disposed in the first bore; wherein the first fluid displacement member is connected to the screw by a first fastener extending into the first bore; and wherein the second fluid displacement member is connected to the screw by a second fastener extending into the second bore.

The second bore is fluidly isolated from the first bore.

The lubricant pathway includes an inlet.

The inlet is a grease zerk located within the screw.

The inlet is accessible for introducing grease while the screw is located within the rotor.

A first fluid displacement member configured to pump fluid and a second fluid displacement member; wherein the fluid displacement member is the first fluid displacement member; wherein each of the first fluid displacement member and the second fluid displacement member are connected to the screw.

The first fluid displacement member comprises a first diaphragm and the second fluid displacement member comprises a second diaphragm.

A method of lubricating an electric displacement pump includes providing lubricant to an interface between a screw and a rotor of a pump motor of the pump via a lubricant pathway extending through the screw, wherein the screw is disposed coaxially with the rotor.

The method of the preceding paragraph can optionally include, additionally and/or alternatively, any one or more of the following features, configurations and/or additional components:

Disconnecting a fluid displacement member from the screw.

Disconnecting the fluid displacement member from the screw includes removing a fastener from a bore extending into the screw.

Removing the fastener from the bore extending into the screw includes unthreading the fastener from the bore.

The bore forms a portion of the lubricant pathway such that the step of providing lubricant to the interface between the screw and the rotor includes providing lubricant through the bore extending into the screw.

Providing lubricant to the interface between the screw and the rotor includes providing lubricant through a bore extending into the screw, the bore configured to receive a fastener to secure a fluid displacement member to the screw.

Providing lubricant to the interface between the screw and the rotor includes inserting an applicator of a lubricant gun into the bore and engaging the applicator with a grease fitting disposed within the bore.

A displacement pump for pumping a fluid includes an electric motor at least partially disposed in a pump housing and including a stator and a rotor; a first fluid displacement member connected to the rotor such that a rotational output from the rotor provides a linear reciprocating input to the first fluid displacement member; wherein the first fluid displacement member fluidly separates a first process fluid chamber disposed on a first side of the first fluid displacement member from a first cooling chamber disposed on a second side of the first fluid displacement member; wherein the first fluid displacement member simultaneously pumps process fluid through the first process fluid chamber and pumps air through the first cooling chamber.

The displacement pump of the preceding paragraph can optionally include, additionally and/or alternatively, any one or more of the following features, configurations and/or additional components:

A second fluid displacement member connected to the rotor to be driven by the rotor, the second fluid displacement member fluidly separating a second process fluid chamber disposed on a first side of the second fluid displacement member from a second cooling chamber disposed on a second side of the second fluid displacement member; wherein the second fluid displacement member is configured to simultaneously pump process fluid through the second process fluid chamber and pump air through the second cooling chamber.

A first check valve is disposed upstream of the first cooling chamber to allow flow into the first cooling chamber, at least one passage extends between the first cooling chamber and second cooling chamber, and a second check valve is disposed downstream of the second cooling chamber to allow flow out of the second cooling chamber.

The at least one passage includes at least one rotor passage that rotates with the rotor.

The at least one passage includes at least one stator passage that remains static relative to the stator.

The at least one stator passage is disposed between the stator and a control housing.

An internal check valve disposed at an outlet of the at least one passage such that the internal check valve prevents air from backflowing into the at least one passage from the second cooling chamber.

The internal check valve is a flapper valve.

A flapper of the flapper valve is secured to the pump housing by a grease cap associated with a bearing supporting the rotor.

The at least one passage includes a first passage and a second passage, wherein at least a portion of the first passage is formed by at least one rotor passage through the rotor, wherein the second passage includes and at least one stator passage, and wherein the internal check valve controls flow out of both the at least one rotor passage and the at least one stator passage.

The first check valve is mounted to a valve plate and the second check valve is mounted to the valve plate.

A flow directing member, the flow directing member configured to direct one of an exhaust flow of the air exiting the second check valve and an inlet flow of air flowing to the first check valve such that the one of the exhaust flow and the inlet flow flows over an exterior of the pump housing.

The exterior of the pump housing includes at least heat sink increasing a surface area of the exterior of the pump housing to facilitate heat transfer, and wherein the flow directing member directs the one of the exhaust flow and the inlet flow over the at least one projection.

A first diaphragm plate exposed to one of the first cooling chamber and the first process chamber; and a membrane extending radially relative to the first diaphragm plate; wherein the first diaphragm plate includes at least one first heat sink formed on the first diaphragm plate.

A fastener connects the first diaphragm plate to a screw, the screw receiving the rotational output from the rotor and providing the linear input to the fluid displacement member.

A second diaphragm plate exposed to the other one of the first cooling chamber and the first process chamber, wherein an inner portion of the membrane is captured between the first diaphragm plate and the second diaphragm plate.

The second diaphragm plate includes at least one second heat sink formed on the second diaphragm plate.

The first fluid displacement member reciprocates in a first direction and a second direction; the first fluid displacement member simultaneously performs a pumping stroke of the process fluid and a suction stroke of the air as the first fluid displacement member moves in the first direction; and the first fluid displacement member simultaneously performs a pumping stroke of the air and a suction stroke of the process fluid as the first fluid displacement member moves in the second direction.

The air pumped by the first fluid displacement member is forced through the electric motor to remove heat from the electric motor.

A drive mechanism connected to the rotor and the first fluid displacement member, the drive mechanism configured to convert a rotational output from the rotor into a linear input to the first fluid displacement member; wherein the air pumped by the first fluid displacement member is forced to contact the drive mechanism and remove heat from the drive mechanism.

The drive mechanism includes a screw connected to the fluid displacement member and disposed coaxially with the rotor.

A double diaphragm pump having an electric motor includes a housing; an electric motor comprising a stator and a rotor, the rotor configured to rotate to generate rotational input; a first diaphragm connected to the rotor such that a rotational output from the rotor provides a linear reciprocating input to the first diaphragm; a second diaphragm connected to the rotor such that a rotational output from the rotor provides a linear reciprocating input to the second diaphragm; wherein the first diaphragm fluidly separates a first process fluid chamber disposed on a first side of the first diaphragm from a first cooling chamber disposed on a second side of the first diaphragm; wherein the second diaphragm fluidly separates a second process fluid chamber disposed on a first side of the second diaphragm from a second cooling chamber disposed on a second side of the second diaphragm; wherein the first diaphragm and the second diaphragm reciprocate in a first direction and a second direction, wherein the first diaphragm simultaneously performs a pumping stroke of the process fluid and a suction stroke of the air as the first diaphragm moves in the first direction; wherein the second diaphragm simultaneously performs a suction stroke of the process fluid and a pumping stroke of the air as the second diaphragm moves in the first direction; wherein the first diaphragm simultaneously performs a pumping stroke of the air and a suction stroke of the process fluid as the first diaphragm moves in the second direction; and wherein the second diaphragm simultaneously performs a pumping stroke of the process fluid and a suction stroke of the air as the second diaphragm moves in the second direction.

The double diaphragm pump of the preceding paragraph can optionally include, additionally and/or alternatively, any one or more of the following features, configurations and/or additional components:

The air pumped by the first diaphragm and the second diaphragm is forced through the electric motor to remove heat from the electric motor.

A drive mechanism connected to the rotor, the first diaphragm, and the second diaphragm, wherein the drive mechanism is configured to convert a rotational output from the rotor into a linear input to the first diaphragm and the second diaphragm; wherein the air pumped by the first diaphragm is forced to contact the drive mechanism and remove heat from the drive mechanism.

The air pumped from the first cooling chamber is pumped to the second cooling chamber.

A method of cooling an electrically operated pump includes driving reciprocation of a first fluid displacement member and a second fluid displacement member by an electric motor having a rotor configured to rotate about a pump axis, wherein the first fluid displacement member and the second fluid displacement member are disposed coaxially with the rotor and connected to the rotor via a drive mechanism; drawing air into a first cooling chamber of a cooling circuit of the pump by the first fluid displacement member, the first cooling chamber disposed between the first fluid displacement member and the rotor; pumping the air from first cooling chamber to a second cooling chamber disposed between the second fluid displacement member and the rotor; and driving the air out of the second cooling chamber by the second fluid displacement member to exhaust the air from the cooling circuit.

The method of the preceding paragraph can optionally include, additionally and/or alternatively, any one or more of the following features, configurations and/or additional components:

Directing an external airflow outside of a pump housing within which the electric motor is disposed such that the external airflow flows over at least one heat sink formed on the pump housing.

Pumping the air from first cooling chamber to a second cooling chamber disposed between the second fluid displacement member and the rotor includes flowing the air through at least one passage extending between the first cooling chamber and the second cooling chamber.

Flowing the air through at least one passage extending between the first cooling chamber and the second cooling chamber includes flowing the air through a stator air passage, the stator air passage remaining stationary relative to the stator during pumping.

Flowing the air through at least one passage extending between the first cooling chamber and the second cooling chamber includes flowing the air through an air passage formed at least partially by a rotor passage rotating about the pump axis with the rotor.

Preventing air disposed within the second cooling chamber from backflowing into the at least one passage by an internal check valve disposed between the at least one passage and the second cooling chamber.

Controlling airflow into the first cooling chamber with a first check valve; and controlling airflow out of the second cooling chamber with a second check valve.

A displacement pump for pumping a fluid includes an electric motor including a rotor and a stator, the rotor located within the stator; a fluid displacement member configured to pump fluid and disposed coaxially with the rotor; a drive mechanism connected to the rotor and the fluid displacement member, the drive mechanism configured to convert a rotational output from the rotor into a linear input to the fluid displacement member; and a position sensor including a sensing component disposed radially inside the rotor, the position sensor configured to sense rotation of the rotor and to provide data to a controller.

The displacement pump of the preceding paragraph can optionally include, additionally and/or alternatively, any one or more of the following features, configurations and/or additional components:

A permanent magnet array of the rotor includes a plurality of back irons and a plurality of permanent magnets.

The sensing component is disposed radially inward of a radially inner edge of a permanent magnet array of the rotor.

The rotor includes an axial extension projecting from an axial end of the rotor, and wherein at least a portion of the sensing component extends below the axial extension such that the axial extension is disposed between the position sensor and the permanent magnet array.

The position sensor is disposed radially outward from a bearing supporting the rotor.

The position sensor includes an array of Hall-effect sensors.

The position sensor is mounted to the stator.

A displacement pump for pumping a fluid includes an electric motor including a stator and a rotor; a fluid displacement member configured to pump fluid and disposed coaxially with the rotor; a drive mechanism connected to the rotor and the fluid displacement member, the drive mechanism configured to convert a rotational output from the rotor into a linear input to the fluid displacement member; and a controller configured to: regulate current flow to the electric motor such that the rotor applies torque to the drive mechanism with the pump in both a pumping state and a stalled state; wherein in the pumping state, the rotor applies torque to the drive mechanism and rotates about the pump axis causing the fluid displacement member to apply force to a process fluid and displace axially along the pump axis; and wherein in the stalled state, the rotor applies torque to the drive mechanism and does not rotate about the pump axis such that the fluid displacement member applies force to the process fluid and does not displace axially due to the force being insufficient to overcome the downstream pressure of the process fluid.

The displacement pump of the preceding paragraph can optionally include, additionally and/or alternatively, any one or more of the following features, configurations and/or additional components:

The controller is further configured to regulate the current flow to the electric motor with the pump in the stalled state such that the current provided is a maximum current.

The maximum current is a maximum operating current.

The maximum current is a target operating current.

The controller is further configured to pulse the current to the electric motor with the pump in the stalled state.

The pump does not include a working fluid for causing the fluid displacement member to apply force to the process fluid.

A dual pump for pumping a fluid includes an electric motor comprising a stator and a rotor, the rotor configured to generate rotational output; a controller configured to regulate current flow to the electric motor; a drive mechanism comprising a screw, the screw extending within the rotor, the screw configured to receive the rotational output and convert the rotational output into linearly reciprocating motion of the screw, wherein rotation of the rotor in a first direction drives the screws to linearly move in a first direction along an axis, and rotation of the rotor in a second direction drives the screws to linearly move in a second direction along the axis; a first fluid displacement member and a second fluid displacement member, the screw located between the first and the second fluid displacement members, the screw translating the first and the second fluid displacement members in the first direction along the axis when the rotor rotates in the first direction and in the second direction along the axis when the rotor rotates in the second direction; wherein: the first fluid displacement performs a pumping stroke of the process fluid and the second fluid displacement performs a suction stroke of the process fluid as the screw moves in the first direction, the first fluid displacement performs a suction stroke of the process fluid and the second fluid displacement performs a pumping stroke of the process fluid as the screw moves in the second direction, the controller regulates output pressure of the process fluid by regulating current flow to the motor such that the rotor rotates to cause the first and the second fluid displacement members to reciprocate to pump the process fluid until pressure of the process fluid stalls the rotor while the first fluid displacement member is in the pump stroke and the second fluid displacement member is in the suction stroke even while current continues to be supplied to the motor by the controller, the first and the second fluid displacement members resuming pumping when the pressure of the process fluid drops enough for the rotor to overcome the stall and resume rotating.

The dual pump of the preceding paragraph can optionally include, additionally and/or alternatively, any one or more of the following features, configurations and/or additional components:

The controller is configured to receive a pressure output setting for the pump from a user, the pressure output setting corresponding to a current level at which the controller supplies the current to the motor.

The dual pump does not include a pressure transducer that influences the level of power supplied by the controller to the motor.

The controller is configured to regulate the current flow to the motor based on data other than pressure information from a pressure transducer.

A method of operating a reciprocating pump includes electromagnetically applying a rotational force to a rotor of an electric motor; applying, by the rotor, torque to a drive mechanism; applying, by the drive mechanism, axial force to a fluid displacement member configured to reciprocate on a pump axis to pump process fluid; regulating, by a controller, a flow of current to a stator of the electric motor such that the rotational force is applied to the rotor during both a pumping state and a stalled state; wherein in the pumping state, the rotor applies torque to the drive mechanism and rotates about the pump axis causing the fluid displacement member to apply force to a process fluid and displace axially along the pump axis; and wherein in the stalled state, the rotor applies torque to the drive mechanism and does not rotate about the pump axis such that the fluid displacement member applies force to the process fluid and does not displace axially.

The method of the preceding paragraph can optionally include, additionally and/or alternatively, any one or more of the following features, configurations and/or additional components:

The drive mechanism is at least partially disposed within the rotor.

Applying, by the drive mechanism, axial force to the fluid displacement member includes applying, by a drive nut of the drive mechanism connected to the rotor to rotate with the rotor, axial force to a screw of the drive mechanism, the screw disposed coaxially with the fluid displacement member; and applying, by the screw, the axial force to the fluid displacement member.

Applying, by the rotor, torque to the drive mechanism includes applying, by the rotor, torque to a drive nut connected to the rotor to rotate with the rotor, the drive nut disposed coaxially with a screw and configured to drive axial displacement of the screw.

Applying force to the screw by a rolling element disposed between the drive nut and the screw.

Regulating, by the controller, the flow of current to the stator includes pulsing the current in the stalled state such that the rotor applies varying amounts of torque to the drive mechanism when in the stalled state.

Pulsing the current between a first current and a second current, the first current being a maximum operating current, and the second current being a current less than the maximum operating current.

Pulsing the current between first current and a second current, the first current being a set point current less than a maximum operating current, and the second current being a current less than the set point current.

The set point current is a target operating current for the pump.

A method of operating a reciprocating pump includes providing electric current to an electric motor disposed on a pump axis and connected to a fluid displacement member configured to reciprocate along the pump axis; and regulating, by a controller, current flow to the electric motor to control a pressure output by the pump to a target pressure.

The method of the preceding paragraph can optionally include, additionally and/or alternatively, any one or more of the following features, configurations and/or additional components:

Regulating, by the controller, current flow to the electric motor when the pump is in a pumping state, such that the current is maintained at or below a maximum current; regulating, by the controller, current flow to the electric motor when the pump is in a stalled state, such that the fluid displacement member applies force to a process fluid with the pump in the stalled state.

Determining, by the controller, that the pump is in the pumping state based on a rotor of the electric motor rotating about the pump axis.

Regulating, by the controller, the current flow to the electric motor when the pump is in the stalled state includes pulsing the current provided to the electric motor.

Regulating, by the controller, the current flow to the electric motor when the pump is in the stalled state includes maintaining the current at the maximum current.

A displacement pump for pumping a fluid includes an electric motor including a stator and a rotor configured to rotate about a pump axis; a fluid displacement member configured to pump fluid and disposed coaxially with the rotor; a drive mechanism connected to the rotor and the fluid displacement member, the drive mechanism configured to convert a rotational output from the rotor into a linear input to the fluid displacement member; and a controller configured to: cause current to be provided to the stator to drive rotation of the rotor, thereby driving reciprocation of the fluid displacement member; and regulate the current flow to the electric motor to control a pressure output by the pump to a target pressure.

The displacement pump of the preceding paragraph can optionally include, additionally and/or alternatively, any one or more of the following features, configurations and/or additional components:

The controller regulates the current flow to the electric motor without pressure feedback from a pressure sensor.

The controller is configured to regulate the current flow such that the actual current does not exceed a maximum current for the target pressure, and wherein the controller is further configured to regulate a rotational speed of the rotor such that an actual rotational speed does not exceed a maximum speed.

The controller is configured to set both the maximum current and the maximum speed based on a single parameter input received by the controller.

The fluid displacement member includes a variable working surface area, and wherein the controller is configured to vary the current throughout a stroke of the fluid displacement member to control the pressure output to the target pressure.

A method of operating a reciprocating pump includes driving, by an electric motor, reciprocation of a fluid displacement member along a pump axis, the fluid displacement member disposed coaxially with a rotor of the electric motor; regulating, by a controller, a rotational speed of the rotor thereby directly controlling an axial speed of the fluid displacement member such that the rotational speed is at or below a maximum speed; and regulating, by the controller, current provided to the electric motor such that the current provided is at or below a maximum current.

The method of the preceding paragraph can optionally include, additionally and/or alternatively, any one or more of the following features, configurations and/or additional components:

The fluid displacement member includes a variable working surface area.

Varying, by the controller, current provided to the electric motor such that a first current is provided to the electric motor at a beginning of a pumping stroke of the fluid displacement member and a second current is provided to the electric motor at an end of the pumping stroke.

A method of operating a reciprocating pump includes driving, by an electric motor, reciprocation of a fluid displacement member along a pump axis, the fluid displacement member disposed coaxially with a rotor of the electric motor, wherein the fluid displacement member includes a variable working surface area; and varying, by a controller, current provided to the electric motor such that a first current is provided to the electric motor at a beginning of a pumping stroke of the fluid displacement member and a second current is provided to the electric motor at an end of the pumping stroke, the second current less than the first current.

A displacement pump for pumping a fluid includes an electric motor including a stator and a rotor configured to rotate about a pump axis; a fluid displacement member configured to pump fluid and disposed coaxially with the rotor; a drive mechanism connected to the rotor and the fluid displacement member, the drive mechanism comprising a screw and configured to convert a rotational output from the rotor into a linear input to the fluid displacement member; and a controller configured to operate the pump in a start-up mode and a pumping mode, wherein during the start-up mode the controller is configured to: cause the motor to drive the fluid displacement member in a first axial direction; and determine an axial location of the fluid displacement member based on the controller detecting a first current spike when the fluid displacement member encounters a first stop.

The displacement pump of the preceding paragraph can optionally include, additionally and/or alternatively, any one or more of the following features, configurations and/or additional components:

The controller is further configured to determine whether the first stop is a mechanical stop.

The mechanical stop corresponds with a travel limit of the fluid displacement member.

The controller is configured to cause the motor drive the fluid displacement member in a second axial direction opposite the first axial direction; detect a second stop; measure a stroke length between the first stop and the second stop; and compare the measured stroke length to a reference stroke length to determine a stop type of the first stop.

The controller is configured to classify at least one of the first stop and the second stop as a fluid stop based on the measured stroke length being less than the reference stroke length.

The controller is configured to determine a stop type of the first stop based on a comparison of a plurality of stop locations.

The controller is configured to determine that the first stop is a mechanical stop based on the comparison indicating that differences between the plurality of stop locations are less than a threshold difference.

The mechanical stop corresponds with a travel limit of the fluid displacement member.

The controller is configured to determine that the first stop is a fluid stop based on the comparison indicating at least one difference between the plurality of stop locations exceeds a threshold difference.

The fluid stop is due to downstream fluid pressure acting on the fluid displacement member.

The controller is configured to determine a stop type of the first stop based on a slope of a current profile of the first current spike.

The axial location is determined based on rotations of the rotor.

A displacement pump for pumping a fluid includes an electric motor including a stator and a rotor configured to rotate about a pump axis; a first fluid displacement member configured to pump fluid and disposed coaxially with the rotor; a second fluid displacement member configured to pump fluid and disposed coaxially with the rotor; a drive mechanism connected to the rotor and the first and second fluid displacement members, the drive mechanism comprising a screw and configured to convert a rotational output from the rotor into a linear input to the first and second fluid displacement members; and a controller configured to operate the pump in a start-up mode and a pumping mode. During the start-up mode the controller is configured to cause the motor to drive the first and second fluid displacement members in a first axial direction; and determine an axial location of at least one of the first and second fluid displacement members based on the controller detecting a first current spike when the at least one of the first and second fluid displacement members encounters a first stop. Moving the first and second fluid displacement members in the first axial direction moves one of the first and second fluid displacement members through a pumping stroke and moves the other of the first and second fluid displacement members through a suction stroke. Moving the first and second fluid displacement members in a second axial direction opposite the first axial direction moves the one of the first and second fluid displacement members through a suction stroke and moves the other of the first and second fluid displacement members through a pumping stroke.

A method of operating a reciprocating pump includes driving, by an electric motor, a first fluid displacement member in a first axial direction on a pump axis, the first fluid displacement member disposed coaxially with a rotor of the electric motor; and determining, by a controller, an axial location of the first fluid displacement member based on the controller detecting a first current spike due to the first fluid displacement member encountering a first stop and the rotor stopping rotation.

The method of the preceding paragraph can optionally include, additionally and/or alternatively, any one or more of the following features, configurations and/or additional components:

Driving the first fluid displacement member in the first axial direction a plurality of times to generate a plurality of stop locations; and determining, by the controller, a stop type of the first stop based on axial locations of each of the plurality of stop locations.

Comparing the plurality of stop locations to determine the stop type; and classifying the first stop as a mechanical stop based on differences between the stop locations being less than a threshold difference.

Comparing the plurality of stop locations to determine the stop type; and determining that the first stop is a fluid stop based on the comparison indicating differences between any two of the plurality of stop locations exceeding a threshold difference.

Driving, by the electric motor, a second fluid displacement member in a second axial direction opposite the first axial direction along the pump axis, the second fluid displacement member disposed coaxially with the rotor; detecting a second current spike due to the second fluid displacement member encountering a second stop and the rotor stopping rotation; and determining, by a controller, a measured stroke length based on an axial location of the first current spike and an axial location of the second current spike.

Comparing the measured stroke length to a reference stroke length; and classifying at least one of the first stop and the second stop as one of a mechanical stop and a fluid stop based on the comparison of the measured stroke length and the reference stroke length.

Classifying the first stop as one of a mechanical stop and a fluid stop based on a current profile generated by the first current spike.

Driving, by the electric motor, a second fluid displacement member in a second axial direction opposite the first axial direction along the pump axis, the second fluid displacement member disposed coaxially with the rotor; and determining, by the controller, an axial location of the second fluid displacement member based on the controller detecting a second current spike due to the second fluid displacement member encountering a second stop and the rotor stopping rotation.

Recording the locations of the first stop and the second stop as travel limits for the first fluid displacement member and the second fluid displacement member, such that a distance between the first stop and the second stop defines a maximum stroke length.

A method of operating a reciprocating pump includes driving, by an electric motor, a first fluid displacement member through a pumping stroke in a first axial direction along a pump axis, the first fluid displacement member disposed coaxially with a rotor of the electric motor; initiating, by a controller, deceleration of the rotor when the first fluid displacement member is at a first deceleration point disposed a first axial distance from a first target point along the pump axis; determining, by the controller, a first adjustment factor based on a first axial distance between a first stopping point and the first target point, wherein the first stopping point is an axial location where the first fluid displacement member stops displacing in the first axial direction; and managing, by the controller, a stroke length based on the first adjustment factor.

The method of the preceding paragraph can optionally include, additionally and/or alternatively, any one or more of the following features, configurations and/or additional components:

Managing, by the controller, the stroke length includes altering an axial location of the first deceleration point based on the first adjustment factor.

Shifting a location of the first deceleration point axially closer to the target point based on the stopping point undershooting the target point.

Shifting a location of the first deceleration point axially further from the target point based on the stopping point overshooting the target point.

Adjusting an axial location of a second deceleration point for a second fluid displacement member configured to shift through a second pumping stroke in a second axial direction opposite the first axial direction based on the first adjustment factor.

Managing, by the controller, the stroke length includes controlling a second stroke length in a second axial direction opposite the first axial direction based on the first adjustment factor.

Generating a second adjustment factor based on a second axial distance between a second stopping point, where a second fluid displacement member stops displacing in the second axial direction, relative to the second target point;

Adjusting a first stroke length in the first axial direction based on the second adjustment factor.

A rotor assembly for an electric motor includes a rotor body formed from a first body component and a second body component; a drive component disposed within a chamber defined by the first body component and the second body component; and a permanent magnet array disposed on an outer surface of the rotor body; wherein the first body component and the second body component form a clamshell receiving the drive component.

The rotor assembly of the preceding paragraph can optionally include, additionally and/or alternatively, any one or more of the following features, configurations and/or additional components:

A first bearing assembly mounted to the first body component; and a second bearing assembly mounted to the second body component.

The drive component is a drive nut of a drive mechanism configured to convert a rotary motion of rotor body to linear motion of a linear displacement member.

The linear displacement member is a screw.

The drive component includes a shaft extending axially beyond an outer axial end of the first body component.

The drive component defines a bore configured to receive a shaft, the bore interfacing with the shaft to drive rotation of the shaft.

A displacement pump for pumping a fluid includes an electric motor including a stator and a rotor; a fluid displacement member connected to the rotor such that a rotational output from the rotor provides a linear reciprocating input to the first fluid displacement member; and a controller configured to regulate current flow to the electric motor based on a current limit to thereby regulate an output pressure of the fluid pumped by the fluid displacement member; regulate a rotational speed of the rotor based on a speed limit to thereby regulate an output flowrate of the fluid pumped by the fluid displacement member; set a current limit and a speed limit based on a single parameter command received by the controller.

The displacement pump of the preceding paragraph can optionally include, additionally and/or alternatively, any one or more of the following features, configurations and/or additional components:

A user interface operatively connected to the controller, the user interface including a parameter input configured to provide the single parameter command to the controller.

The parameter input is one of a knob, a dial, a button, and a slider.

A method of operating a reciprocating pump includes electromagnetically applying a rotational force to a rotor of an electric motor; applying, by the rotor, torque to a drive mechanism; applying, by the drive mechanism, axial force to a fluid displacement member configured to reciprocate on a pump axis to pump process fluid; regulating, by a controller, a flow of current to a stator of the electric motor based on a current limit; regulating, by the controller, a speed of the rotor based on a speed limit; generating the single parameter command based on a single input from a user; and setting, by the controller, both the current limit and the speed limit based on the single parameter command received by the controller.

The method of the preceding paragraph can optionally include, additionally and/or alternatively, any one or more of the following features, configurations and/or additional components:

Setting, by the controller, both the current limit and the speed limit based on the single parameter command received by the controller includes proportionally adjusting the current limit and the speed limit based on the single parameter command.

A displacement pump for pumping a fluid includes an electric motor including a stator and a rotor configured to rotate about a pump axis; a fluid displacement member operatively connected to the rotor to be reciprocated to pump fluid; a controller configured to operate the motor in a start-up mode and a pumping mode, wherein during the pumping mode the controller is configured to operate the electric motor based on a target current and a target speed, and wherein during the start-up mode the controller is configured to operate the electric motor based on a maximum priming speed that less than the target speed.

The displacement pump of the preceding paragraph can optionally include, additionally and/or alternatively, any one or more of the following features, configurations and/or additional components:

The controller is further configured to exit the start-up mode and enter the pumping mode based on an operating parameter reaching a threshold.

The operating parameter is one of a time of operation, a number of pump cycles of the fluid displacement member, a number of pump strokes of the fluid displacement member, a count of rotations of the rotor, and a current draw of the electric motor.

The controller is configured to operate the pump in the start-up mode on power up.

A method of operating a reciprocating pump includes electromagnetically applying a rotational force to a rotor of an electric motor; applying, by the rotor, torque to a drive mechanism; applying, by the drive mechanism, axial force to a fluid displacement member configured to reciprocate on a pump axis to pump process fluid; regulating, by a controller, power to the electric motor to control an actual speed of the rotor during a start-up mode such that the actual speed is less than a maximum priming speed; regulating, by a controller, the power to the electric motor to control an actual speed of the rotor during a pumping mode such that the actual speed is less than a target speed; wherein the maximum priming speed is less than the target speed.

A method of operating a reciprocating pump includes driving, by an electric motor, a first fluid displacement member through a pumping stroke in a first axial direction along a pump axis, the first fluid displacement member disposed coaxially with a rotor of the electric motor; and managing, by the controller, a stroke length of the first fluid displacement member during a first operating mode and a second operating mode such that the stroke length during the second operating mode is shorter than the stoke length during the first operating mode.

The method of the preceding paragraph can optionally include, additionally and/or alternatively, any one or more of the following features, configurations and/or additional components:

Increasing a number of changeovers between stroke directions for the first fluid displacement member while in the second operating mode relative to the first operating mode.

Regulating, by the controller, an actual speed of the first fluid displacement member during the first operating mode based on a maximum speed; and regulating, by the controller, an actual speed of the first fluid displacement member during the second operating mode based on the maximum speed.

Regulating, by the controller, an actual speed of the first fluid displacement member during the first operating mode based on a first maximum speed; and regulating, by the controller, an actual speed of the first fluid displacement member during the second operating mode based on a second maximum speed greater than the first maximum speed.

A method of operating a reciprocating pump includes driving, by an electric motor, a first fluid displacement member through a pumping stroke in a first axial direction along a pump axis, the first fluid displacement member disposed coaxially with a rotor of the electric motor; and managing, by the controller, a stroke of the first fluid displacement member during a first operating mode such that a pump stroke occurs in a first displacement range along the pump axis; and managing, by the controller, a stroke of the first fluid displacement member during a first operating mode such that the pump stroke occurs in a second displacement range along the pump axis, wherein the second displacement range is a subset of the first displacement range.

A displacement pump for pumping a fluid includes an electric motor including a stator and a rotor configured to rotate about a pump axis; a fluid displacement member operatively connected to the rotor to be reciprocated along the pump axis to pump fluid; a controller configured to operate the motor in a first operating mode and a second operating mode. During the first operating mode the controller is configured to manage a stroke length of the fluid displacement member such that a pump stroke of the fluid displacement member occurs in a first displacement range along the pump axis. During the second operating mode the controller is configured to manage the stroke length of the fluid displacement member such that the pump stroke of the fluid displacement member occurs in a second displacement range along the pump axis. The second displacement range has a smaller axial extent than the first displacement range.

The displacement pump of the preceding paragraph can optionally include, additionally and/or alternatively, any one or more of the following features, configurations and/or additional components:

The second displacement range is a subset of the first displacement range.

A second fluid displacement member configured to pump fluid and disposed coaxially with the rotor.

A drive mechanism connected to the rotor and the first and second fluid displacement members, the drive mechanism comprising a screw and configured to convert a rotational output from the rotor into a linear input to the first fluid displacement member and the second fluid displacement member.

A method of operating a reciprocating pump includes driving, by an electric motor, reciprocation of a first fluid displacement member and a second fluid displacement member to pump fluid; and monitoring, by a controller, an actual operating parameter of the electric motor; and determining, by the controller, that an error has occurred based on the actual operating parameter differing from an expected operating parameter during a particular phase of a pump cycle.

The method of the preceding paragraph can optionally include, additionally and/or alternatively, any one or more of the following features, configurations and/or additional components:

Monitoring, by the controller, the actual operating parameter of the electric motor includes monitoring, by the controller, the actual current draw of the electric motor; and determining, by the controller, that the error has occurred based on the actual operating parameter differing from the expected operating parameter during the particular phase of the pump cycle includes determining, by the controller, that the error has occurred based on the actual current draw differing from the expected current draw.

Monitoring, by the controller, the actual operating parameter of the electric motor includes monitoring, by the controller, the actual speed of the electric motor; and determining, by the controller, that the error has occurred based on the actual operating parameter differing from the expected operating parameter during the particular phase of the pump cycle includes determining, by the controller, that the error has occurred based on the actual speed differing from the expected speed.

Determining, by the controller, that the error has occurred based on the actual operating parameter differing from the expected operating parameter during the particular phase of the pump cycle includes comparing a first value of the actual operating parameter during a pumping stroke of the first fluid displacement member to a second value of the actual operating parameter during a pumping stroke of the second fluid displacement member; and determining, by the controller, that the error has occurred based on the comparison of the first value and the second value indicating a variation between the first value and the second value.

Determining, by the controller, that the error has occurred based on the comparison of the first value and the second value indicating the variation between the first value and the second value includes determining that the error has occurred based on the variation exceeding a threshold.

Determining, by the controller, the first value of the actual operating parameter at a beginning of the pumping stroke of the first fluid displacement member; and determining, by the controller, the second value of the actual operating parameter at a beginning of the pumping stroke of the second fluid displacement member.

Displacing, by the electric motor, the first fluid displacement member through a pumping stroke in a first axial direction along a pump axis; displacing, by the electric motor, the second fluid displacement member through a pumping stroke in a second axial direction along the pump axis, the second axial direction being opposite the first axial direction.

Driving rotation of a rotor of the electric motor about the pump axis, such that the rotor, the first fluid displacement member, and the second fluid displacement member are disposed coaxially on the pump axis.

Generating, by the controller, an error code for the error.

Providing, by the controller, the error code to a user interface; and providing, by the user interface, the error code to a user.

A displacement pump for pumping a fluid includes an electric motor including a stator and a rotor configured to rotate about a pump axis; a drive connected to the rotor, the drive configured to convert a rotational output from the rotor into a linear input; a first fluid displacement member connected to the drive to be driven by the linear input; a controller configured to: cause current to be provided to the stator to drive rotation of the rotor, thereby driving reciprocation of the fluid displacement member; and monitor an actual operating parameter of the electric motor; and determine that an error has occurred based on the actual operating parameter differing from an expected operating parameter during a particular phase of a pump cycle.

The displacement pump of the preceding paragraph can optionally include, additionally and/or alternatively, any one or more of the following features, configurations and/or additional components:

A second fluid displacement member connected to the drive to be driven by the linear input.

The controller is further configured to compare a first value of the actual operating parameter during a pumping stroke of the first fluid displacement member to a second value of the actual operating parameter during a pumping stroke of the second fluid displacement member; and determine that the error has occurred based on the comparison of the first value and the second value indicating a variation between the first value and the second value.

The controller is further configured to monitor an actual current draw of the electric motor, the actual current draw forming the actual operating parameter; and determine that the error has occurred based on the actual current draw differing from an expected current draw.

The controller is further configured to monitor an actual speed of the electric motor, the actual speed forming the actual operating parameter; and determine that the error has occurred based on the actual speed differing from an expected speed.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A displacement pump for pumping a fluid, the pump comprising:

a pump body comprising a central portion, a first end wall having a first central aperture, and a second end wall having a second central aperture, the central portion defining a motor housing, and wherein the first end wall and the second end wall are removably mounted to the motor housing;

an upstream inlet manifold;

a downstream outlet manifold;

a first diaphragm configured to flex to displace the fluid through a first process fluid chamber to the downstream outlet manifold, the first process fluid chamber receiving the fluid from the upstream inlet manifold;

a first fluid cover which defines part of the first process fluid chamber, a circumferential edge of the first diaphragm clamped between the first fluid cover and the first end wall;

a second diaphragm configured to flex to displace the fluid through a second process fluid chamber to the downstream outlet manifold, the second process fluid chamber receiving the fluid from the upstream inlet manifold, wherein fluid output from the first process fluid chamber and the second process fluid chamber are combined in the downstream outlet manifold, and the first end wall and the second end wall are both located between the first diaphragm and the second diaphragm;

a second fluid cover which defines part of the second process fluid chamber, a circumferential edge of the second diaphragm clamped between the second fluid cover and the second end wall;

a screw shaft located directly between the first and the second diaphragms, the screw shaft connected to both of the first and the second diaphragms such that movement of the screw shaft along a pump axis flexes both the first and the second diaphragms to displace the fluid, the screw shaft extending through the first central aperture of the first end wall and the second central aperture of the second end wall;

a drive nut located around the screw shaft and between the first and the second diaphragms;

a plurality of rolling elements arrayed around the screw shaft and located between the first and the second diaphragms, the plurality of rolling elements engaging both of the drive nut and the screw shaft and configured to transmit rotational motion from the drive nut to the screw shaft while the plurality of rolling elements roll around the screw shaft to cause the screw shaft to linearly translate along the pump axis; and an electric motor located within the motor housing and between the first end wall and the second end wall, the electric motor including a stator and a rotor, the rotor configured to rotate coaxial with the pump axis, the rotor axially overlapping the screw shaft and the plurality of rolling elements, the rotor connected to the drive nut such that the drive nut rotates with the rotor;

wherein each of the first end wall, the second end wall, and the central portion extends radially outward beyond the electric motor; and wherein the first end wall is connected to the central portion at a first annular interface that is radially outward of the electric motor and the second end wall is connected to the central portion at a second annular interface that is radially outward of the electric motor.

2. The displacement pump of claim 1, wherein:

the drive nut includes inner threading that rotates with the rotor; and the screw shaft includes outer threading;

each rolling element of the plurality of rolling elements is configured to interface with both of the inner threading and the outer threading; and the inner threading does not contact the outer threading.

3. The displacement pump of claim 1, wherein:

the screw shaft extends within each of the rotor and the stator;

the screw shaft, the plurality of rolling elements, and the rotor are coaxially aligned along the pump axis; and the screw shaft, the plurality of rolling elements, and the rotor are arranged radially outward from the pump axis in the order: the screw shaft, then the plurality of rolling elements, and then the rotor.

4. The displacement pump of claim 1, wherein:

wherein the rotor turns in a first rotational direction to drive the screw shaft linearly along the pump axis in a first direction to simultaneously move the first diaphragm through a pumping stroke and the second diaphragm through a suction stroke, and the rotor turns in a second rotational direction to drive the screw shaft linearly along the pump axis in a second direction to simultaneously move the first diaphragm through a suction stroke and the second diaphragm through a pumping stroke.

5. The displacement pump of claim 1, wherein the plurality of rolling elements are arranged in an elongate annular array, the annular array of the rolling elements disposed coaxially with the first diaphragm.

6. The displacement pump of claim 1, wherein the first diaphragm includes a diaphragm plate connected to the screw shaft and a flexible membrane extending radially outward relative to the diaphragm plate.

7. The displacement pump of claim 1, wherein:

the rotor is supported by a first bearing and a second bearing;

the first bearing is capable of supporting both axial and radial forces; and the second bearing is capable of supporting both axial and radial forces.

8. The displacement pump of claim 7, wherein each of the first bearing and the second bearing includes an array of rollers, each roller orientated along an axis of the roller at an angle such that the axis of the roller is neither parallel nor orthogonal to the pump axis.

9. The displacement pump of claim 7, wherein the first bearing is a tapered roller bearing and the second bearing is a tapered roller bearing.

10. The displacement pump of claim 7, further comprising:

a locking nut connected to a stator housing supporting the stator, the locking nut preloading the first bearing and the second bearing.

11. The displacement pump of claim 10, wherein the locking nut is disposed adjacent to the first bearing and engages an outer race of the first bearing.

12. The displacement pump of claim 10, wherein the locking nut is connected to the stator housing by a threaded interface.

13. The displacement pump of claim 10, wherein the locking nut supports a grease cap of the first bearing.

14. The displacement pump of claim 7, wherein at least part of each of the first bearing and the second bearing are radially within an annular array of magnets supported by the rotor.

15. The displacement pump of claim 7, wherein the first bearing and the second bearing interface with the drive nut.

16. The displacement pump of claim 1, wherein the stator is configured to drive the rotor in both a first rotational direction and a second rotational direction opposite the first rotational direction to drive reciprocation of the screw shaft.

17. The displacement pump of claim 1, wherein the drive nut does not directly contact the screw shaft.

18. The displacement pump of claim 1, wherein the screw shaft is prevented from being rotated by a rotational output of the electric motor by being rotationally fixed with respect to the first diaphragm.

19. The displacement pump of claim 1, wherein the screw shaft includes:

a screw body; and a lubricant pathway extending axially through the screw body and further having an outlet radially within the rotor, the lubricant pathway configured to provide lubricant to a space radially between the screw shaft and the drive nut to lubricate the screw shaft and the drive nut.

20. The displacement pump of claim 1, wherein one or both of the first end wall and the second end wall comprises an end cap.

21. The displacement pump of claim 1, wherein the screw shaft comprises a section having external threading.

22. A displacement pump for pumping a fluid, the displacement pump comprising:

an upstream inlet manifold;

a downstream outlet manifold;

a first diaphragm configured to flex to displace the fluid through a first process fluid chamber to the downstream outlet manifold, the first process fluid chamber receiving the fluid from the upstream inlet manifold;

a second diaphragm configured to flex to displace the fluid through a second process fluid chamber to the downstream outlet manifold, the second process fluid chamber receiving the fluid from the upstream inlet manifold, wherein fluid output from the first process fluid chamber and the second process fluid chamber are combined in the downstream outlet manifold;

a pump body comprising a central portion, a first end wall having a first aperture, and a second end wall having a second aperture, the central portion defining a motor housing and located between the first diaphragm and the second diaphragm, and wherein the first end wall and the second end wall are removably mounted to the motor housing;

a screw shaft located directly between the first and the second diaphragms, the screw shaft connected to both of the first and the second diaphragms such that movement of the screw shaft along a pump axis flexes both the first and the second diaphragms to displace the fluid, the screw shaft configured to be moved through the first central aperture of the first end wall and the second central aperture of the second end wall;

a drive nut located around the screw shaft and between the first and the second diaphragms, the drive nut including a nut body, a first nut end extending axially from a first end of the nut body, a second nut end extending axially from a second end of the nut body, a first nut notch formed at an interface between the nut body and the first nut end, and a second nut notch formed at an interface between the nut body and the second nut end;

a plurality of rolling elements arrayed around the screw shaft and located between the first and the second diaphragms, the plurality of rolling elements engaging both of the drive nut and the screw shaft and configured to transmit rotational motion from the drive nut to the screw shaft while the plurality of rolling elements roll around the screw shaft to cause the screw shaft to linearly translate along the pump axis;

an electric motor disposed within the motor housing and including a stator and a rotor separated by an air gap disposed radially between the stator and the rotor, the rotor including a rotor body and a permanent magnet array supported by the rotor body, the rotor configured to rotate coaxial with the pump axis, the rotor axially overlapping the screw shaft and the plurality of rolling elements, the rotor body connected to the drive nut such that the drive nut rotates with the rotor;

a first bearing located between the first diaphragm and the second diaphragm, the first bearing located radially inward of a permanent magnet array of the rotor and radially outward of the plurality of rolling elements, wherein the first bearing includes a first inner race and a first outer race, the first outer race supported by the pump body; and a second bearing located between the first diaphragm and the second diaphragm, the second bearing located radially inward of the permanent magnet array and radially outward of the plurality of rolling elements, wherein the second bearing includes a second inner race and a second outer race, the second outer race supported by the pump body;

wherein the drive nut is connected to the first inner race of the first bearing at a first axial end of the drive nut, wherein the first inner race of the first bearing is disposed in the first nut notch formed on the drive nut, the first nut notch oriented axially outward from the electric motor and towards the first diaphragm;

wherein the drive nut is connected to the second inner race of the second bearing at a second axial end of the drive nut, wherein the second inner race of the second bearing is disposed in the second nut notch formed on the drive nut, the second nut notch oriented axially outward from the electric motor and towards the second diaphragm;

wherein an interface between the rotor body and the drive nut is aligned with the first inner race such that a line parallel to the pump axis extends through each of the first inner race and the interface between the rotor body and the drive nut;

wherein the second inner race is formed separately from the first inner race;

wherein the first end wall includes a first wall notch receiving the first outer race of the first bearing, the first wall notch oriented axially inward towards the electric motor;

wherein the second end wall includes a second wall notch receiving a second outer race of the second bearing, the second wall notch oriented axially inward towards the electric motor;

wherein the first end wall braces the first outer race such that a portion of the first end wall is disposed between the first outer race and the first diaphragm; and wherein an outer circumferential edge of the first diaphragm is clamped between the first end wall and the first fluid cover and an outer circumferential edge of the second diaphragm is clamped between the second end wall and the second fluid cover.

* * * * *